US008131199B2

(12) United States Patent
Watanabe et al.

(10) Patent No.: US 8,131,199 B2
(45) Date of Patent: Mar. 6, 2012

(54) CLEANING DEVICE FOR IMAGE FORMING APPARATUS, AND PROCESS CARTRIDGE HAVING CLEANING DEVICE

(75) Inventors: Kazuhiko Watanabe, Tokyo (JP); Yoshiki Hozumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 331 days.

(21) Appl. No.: 12/558,934

(22) Filed: Sep. 14, 2009

(65) Prior Publication Data

US 2010/0067949 A1 Mar. 18, 2010

(30) Foreign Application Priority Data

Sep. 16, 2008 (JP) ..... 2008-237176
Nov. 17, 2008 (JP) ..... 2008-293009

(51) Int. Cl.
*G03G 21/00* (2006.01)

(52) U.S. Cl. ..... 399/350; 399/351

(58) Field of Classification Search ..... 399/107, 399/111, 123, 343, 350, 351; 15/256.51
See application file for complete search history.

(56) References Cited

U.S. PATENT DOCUMENTS

| | | | | |
|---|---|---|---|---|
| 6,282,400 | B1 * | 8/2001 | Aoki et al. | 399/350 |
| 7,369,807 | B2 | 5/2008 | Naruse et al. | |
| 7,415,238 | B2 | 8/2008 | Watanabe et al. | |
| 7,610,008 | B2 | 10/2009 | Watanabe et al. | |
| 7,970,334 | B2 * | 6/2011 | Yamashita et al. | 399/346 |
| 2008/0063448 | A1 | 3/2008 | Hozumi et al. | |

FOREIGN PATENT DOCUMENTS

| | | |
|---|---|---|
| JP | 60-198574 | 10/1985 |
| JP | 2006-178164 | 7/2006 |
| JP | 2007-108481 | 4/2007 |
| JP | 2008-96965 | 4/2008 |

OTHER PUBLICATIONS

U.S. Appl. No. 12/559,903, filed Sep. 15, 2009, Hozumi, et al.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A cleaning device for cleaning a surface moving member such as an image carrier of an image forming apparatus, and a process cartridge having the cleaning device. The cleaning device has a cleaning member that is brought into uniform abutment against the surface moving member in a longitudinal direction of the surface moving member. A high removing performance can be obtained while preventing the abrasion of the surface moving member and the cleaning blade, and the state of abutment between the surface moving member and the cleaning blade is securely maintained over time.

17 Claims, 29 Drawing Sheets

FIG. 17

| | TONER PARTICLE DIAMETER (AVERAGE) | | AVERAGE CIRCULARITY DEGREE | SHAPE FACTOR | |
|---|---|---|---|---|---|
| | TONER PARTICLE DIAMETER (μm) | Dv/Dn | | SF-1 | SF-2 |
| TONER 1 | 3.5 | 1.34 | 0.998 | 105 | 102 |
| TONER 2 | 4.8 | 1.14 | 0.961 | 120 | 115 |
| TONER 3 | 2.4 | 1.14 | 0.985 | 141 | 135 |
| TONER 4 | 5.9 | 1.13 | 0.933 | 159 | 150 |
| TONER 5 | 5.5 | 1.22 | 0.921 | 170 | 180 |
| TONER 6 | 5.7 | 1.46 | 0.937 | 148 | 138 |
| TONER 7 | 7.2 | 1.22 | 0.975 | 176 | 160 |
| TONER 8 | 8.0 | 1.24 | 0.948 | 185 | 190 |

CLEANING DEVICE FOR IMAGE FORMING APPARATUS, AND PROCESS CARTRIDGE HAVING CLEANING DEVICE

BACKGROUND OF THE INVENTION

1. Field of the Invention

The present invention relates to an image forming apparatus, such as a copying machine, facsimile device, and a printer. Particularly, the present invention relates to a cleaning device that has a cleaning blade or other cleaning member for coming into contact with a surface of an image carrying body serving as a surface moving member of the image forming apparatus to remove unnecessary objects adhering to the surface moving member, as well as to a process cartridge having this cleaning device.

2. Description of the Related Art

These types of conventional image forming apparatuses normally have a surface moving member, which is, in other words, an image carrying body such as a photosensitive drum and an intermediate transfer belt, and a surface transfer member such as a recording material conveying belt. Generally, because various problems are caused when an unnecessary object adheres to a surface of such a surface moving member, cleaning means for removing the adhered object from the surface of the surface moving member is required. As this cleaning means, a blade type cleaning device has been widely used. This blade type cleaning device with a simple configuration and excellent adhered object removing performance pushes a cleaning blade made of polyurethane rubber or other elastic member against the surface of the surface moving member to remove the adhered object from the surface.

The cleaning devices disclosed in the following patent publications are known as such a cleaning blade type cleaning device.

Japanese Patent Application Publication No. 2007-108481 (to be referred to as "Prior Art 1" hereinafter)

Japanese Patent Application Publication No. S60-198574 (to be referred to as "Prior Art 2" hereinafter)

Japanese Patent Application Publication No. 2006-178164 (to be referred to as "Prior Art 3" hereinafter)

Japanese Patent Application Publication No. 2008-233319 (to be referred to as "Prior Art 4" hereinafter)

Japanese Patent Application Publication No. 2008-096965 (to be referred to as "Prior Art 5" hereinafter)

Incidentally, as the blade type cleaning device, for example, two types of the cleaning devices are known: the trailing type cleaning device disclosed in Prior Art 2 described above, and a counter type cleaning device disclosed in Prior Art 3 described above. Generally, in the counter type cleaning device, the abutment pressure of the cleaning blade on the surface of the surface moving member can be made higher than that of the trailing type cleaning device. Therefore, the advantage of the counter type cleaning device is that the performance for removing the adhered object on the surface of the surface moving member is higher than that of the trailing type cleaning device. For this reason, the counter type cleaning device is adopted when high removing performance for removing the adhered object is required. Particularly, in a recent electrophotographic image forming apparatus, toner that has a spherical shape and small diameter, such as, particularly, polymer toner, is usually used, and high removing performance is required in order to remove this type of toner as the adhered object. Thus, because the removing performance of the trailing type cleaning device is not sufficient, the counter type cleaning device is adopted.

In such a counter type cleaning device, when the amount of abutment of the cleaning blade against the surface of the surface moving member from a supporting member supporting the cleaning blade is increased in order to raise the abutment pressure of the cleaning blade on the surface of the surface moving member, as disclosed in Prior Arts 1 and 2 described above, the cleaning blade is bent and consequently the contact area between the cleaning blade and the surface of the surface moving member increases. Therefore, the problem is that the abutment pressure of the cleaning blade against the surface of the surface moving member ends up decreasing.

Therefore, in order to increase the abutment pressure, Prior Arts 3 and 4 described above, for example, proposes a configuration in which the amount of abutment of the cleaning blade from the supporting member supporting the cleaning blade is made zero. In this configuration, because the cleaning blade deforms only by its own elasticity, the contact area between the cleaning blade and the surface moving member is prevented from increasing, and the cleaning blade is brought into abutment against the surface moving member by high pressure, improving the cleanability of the abutting part. However, because the cleaning blade deforms only by its own elasticity, simply using the configuration of reducing the amount of abutment to zero makes it difficult for the cleaning blade to follow a change in the position of the surface moving member that is caused when the surface transfer member is moved. When the part accuracy or assembly accuracy of the cleaning blade or the surface moving member is degraded, the cleaning blade cannot abut evenly against the surface of the surface moving member in the longitudinal direction of the cleaning blade, and therefore it is difficult to secure even cleanability.

Prior Art 4 proposes a technology for improving the followability of the cleaning blade by providing a degree of freedom to the support of the supporting member supporting the cleaning blade. For example, in order to clean small-diameter toner or spherical toner in an excellent manner, it is desired that the cleaning blade be brought into abutment more evenly against the surface of the surface moving member, so that the reliability of the cleaning performance and the reliability of the image formation performance can be improved.

In the conventional counter type cleaning device, on the other hand, when the cleaning blade is pressed strongly against the surface of the surface moving member to achieve high removing performance for removing the adhered object, the surface moving member or the cleaning blade itself becomes worn, reducing the life of the surface moving member or the cleaning blade.

In order to solve such problems, the cleaning device disclosed in Prior Art 5 is known. In this cleaning device, a warpage restricting member restricts warpage of a cleaning blade that is generated when this cleaning blade that is long in a width direction of a surface moving member is pressed against the surface of the surface moving member. As a result, compared to a cleaning blade whose warpage is not restricted, the length of an abutting part in a surface moving member surface moving direction between the cleaning blade and the surface of the surface moving member (to be referred to as "abutment width" hereinafter) can be reduced. In other words, in the conventional counter type cleaning device in which the warpage of the cleaning blade is not restricted, warpage and deformation of the cleaning blade occur by pressing the abutting side of the cleaning blade against the surface of the surface moving member. The greater the warpage or deformation of the cleaning blade gets, the longer the abutment width becomes. In this cleaning device, because the warpage of the cleaning blade is restricted by the warpage restricting member, the abutment width is mainly determined by the deformation of the cleaning blade only. Therefore, unlike the conventional counter type cleaning device in which the warpage of the cleaning device is not restricted, this cleaning device can reduce the abutment width. Further, even when the same amount of abutment pressure is used, the shorter the abutment width is, the less the surface moving member or the cleaning blade wears. Hence, unlike the counter type cleaning device in which the warpage of the cleaning blade is not restricted, this cleaning device can prevent the surface moving member or the cleaning blade from becoming worn.

However, in an image forming apparatus, the positional relationship between the surface moving member and the cleaning blade changes due to deformation of members that is caused by the manufacturing tolerances or environmental variations within the image forming apparatus main body. In the cleaning device disclosed in Prior Art 5, the change in the positional relationship between the surface moving member and the cleaning blade may not be able to appropriately maintain the state of abutment between the surface moving member and the cleaning blade in the longitudinal direction of the cleaning blade. In short, in some sections this abutment in the longitudinal direction may not be formed. In the configuration in which the warpage of the cleaning blade is not restricted, the warpage of the cleaning blade is eliminated in spite of the change in the positional relationship, and consequently the change in the positional relationship is absorbed and the state of abutment can be maintained. However, in the configuration of this cleaning device in which the warpage of the cleaning blade is restricted, the cleaning blade does not warp, and therefore it is difficult to correct the change in the positional relationship. When adopting the configuration in which the warpage of the cleaning blade is restricted, such as the configuration of this cleaning device functioning as the cleaning means for cleaning the surface moving member, the cleaning device needs to have a configuration for absorbing or correcting the change of the positional relationship, otherwise the state of abutment in the abutting part cannot be maintained over time, due to the change in the positional relationship. Consequently, a problem arises that some sections on the surface moving member cannot be cleaned sufficiently.

Therefore, in order to solve the problems described above, in the cleaning device disclosed in Prior Art 4, engaged means provided in a holding member for folding the cleaning blade is engaged with engaging means supported in the device main body, with a degree of freedom, whereby the holding member can be displaced with respect to the device main body. Because the holding member is displaced with respect to the device main body, a change in the positional relationship between the members that is caused by the manufacturing tolerances or environmental variations can be corrected, and the state of abutment between the surface moving member and the cleaning blade can be maintained. As a result, the occurrence of abutment variations in the longitudinal direction of the cleaning blade can be prevented, and the state of abutment between the cleaning blade and the surface of the surface moving member can be maintained over time.

However, even with the configuration of this cleaning device in which the engaged means of the holding member and the engaging means on the device main body side are engaged with each other with a degree of freedom, in some cases the state of abutment in the abutting part cannot be maintained due to the change in the positional relationship. The reason is as described hereinafter.

First, a section that can be displaced integrally in relation to the device main body configured by the cleaning blade and the holding member is formed as a blade unit. As with the cleaning device described in the previous application, the engagement between the engaged means of the holding means and the engaging means on the device main body side is achieved in two sections of both ends of the holding member in a longitudinal direction thereof. Further, the positions of the cleaning device main body and surface moving member are fixed. In this case, when four positions are defined in the device main body, that is, when the positions on the both ends in the longitudinal direction of an abutting side where the cleaning blade abuts against the surface moving member and the positions of the engaging means in the two sections in the holding member are defined, the positional relationship between the blade unit and the device main body can be specified.

In consideration of the case where two objects with which the deformation can be neglected are brought into contact with each other and positioned, they can be positioned by bringing three points into contact with one another outside a straight line. Furthermore, when a straight line that connects two points out of the three contacting points is taken as a positioning reference line, and one of the two objects rotate around the abovementioned reference line with respect to the other object, the remaining one point out of the three points becomes a point that is brought into contact with the two objects.

Then, the relationship between these two objects is considered as the relationship between the blade unit and the cleaning device. When the two objects are brought into contact with the device main body in three sections out of the four points (including the surface moving member fixed to the device main body), the position of the remaining one section in relation to the device main body is determined depending on the positions of the three sections. Therefore, when the straight line connecting the engaged means on the two sections of the holding member becomes the abovementioned reference line, in a state in which one end of the abutting side in the longitudinal direction abuts against the surface moving member, the position of the blared unit in relation to the device main body is determined based on three points, that is, the two engaged means and one abutting end of the abutting side. When there is a change in the positional relationship between the abovementioned members in the configuration where the position of the blade unit is determined by the three points, out of the both ends of the abutting side of the cleaning blade, the one end configuring the positioned three points and the other end that does not configure the three points are abutted in a different state. In some cases the other end does not come into contact with the surface moving member.

SUMMARY OF THE INVENTION

An object of the present invention is to provide a cleaning device that is capable of removing unnecessary objects adhering to the surfaces of various surface moving members.

Another object of the present invention is to provide a cleaning device, which has a cleaning blade that abuts evenly against a surface of a surface moving member in a longitudinal direction to remove an unnecessary object adhering to the surface.

Another object of the present invention is to provide a cleaning device that can securely maintain the state of abutment between a surface moving member and a cleaning blade over time.

Yet another object of the present invention is to provide a cleaning device that can reduce abrasion of a surface moving member and a cleaning blade.

Still another object of the present invention is to provide a process cartridge having the cleaning device described above.

Still yet another object of the present invention is to provide an image forming apparatus having the cleaning device or the process cartridge described above.

In an aspect of the present invention, a cleaning device removes an object adhering to a surface of a surface moving member to be cleaned. The cleaning device comprises a long plate-shaped elastic member; a holding member for holding the plate-shaped elastic member; an engaged device provided in the holding member; an engaging device engaged with the engaged device and supported in a device main body; and a warpage regulating device for regulating warpage of the plate-shaped elastic member that is generated by pressing the plate-shaped elastic member against a surface of the surface moving member. The engaged device and the engaging device are engaged with each other on a surface moving direction downstream side of the surface moving member from a normal line of a section of the surface of the surface moving member against which the plate-shaped elastic member abuts. The holding member holds the plate-shaped elastic member by means of the warpage regulating device. The plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member. The engaging device and the engaged device are configured to be engaged with each other with a degree of freedom such that the holding member is displaceable with respect to the device main body. The holding member is positioned in relation to the device main body, such that one side of the plate-shaped elastic member abutting against the surface of the surface moving member and extending in the longitudinal direction contains two contact parts out of three contact parts between the holding member and the device main body, the three contact parts being outside a straight line for positioning the holding member in relation to the device main body.

In another aspect of the present invention, a cleaning device removes an object adhering to a surface of a surface moving member to be cleaned. The cleaning device comprises a long plate-shaped elastic member; a holding member for holding the plate-shaped elastic member; an engaged device provided in the holding member; an engaging device engaged with the engaged device and supported in a device main body; a warpage regulating device for regulating warpage of the plate-shaped elastic member that is generated by pressing the plate-shaped elastic member against a surface of the surface moving member; and a biasing device for biasing the plate-shaped elastic member and the holding member toward the surface moving member. The engaged device and the engaging device are engaged with each other on a surface moving direction downstream side of the surface moving member from a normal line of a section of the surface of the surface moving member against which the plate-shaped elastic member abuts. The holding member holds the plate-shaped elastic member by means of the warpage regulating device. The plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member. The engaging device and the engaged device are configured to be engaged with each other with a degree of freedom such that the holding member is displaceable with respect to the device main body, and a pressing force applied to the surface of the surface moving member by one side of the plate-shaped elastic member abutting against the surface of the surface moving member and extending in the longitudinal direction is greater than a pressing force applied to the engaging device by the engaged device of the holding member, the pressing forces being generated by the biasing device biasing the plate-shaped elastic member and the holding member.

In another aspect of the present invention, a cleaning device removes an object adhering to a surface of a surface moving member to be cleaned. The cleaning device comprises a long plate-shaped elastic member; a holding member for holding the plate-shaped elastic member; an engaged device provided in the holding member; an engaging device engaged with the engaged device and supported in a device main body; a warpage regulating device for regulating warpage of the plate-shaped elastic member that is generated by pressing the plate-shaped elastic member against a surface of the surface moving member; and a biasing device for biasing the holding member such that the surface of the surface moving member is pressed by one side of the plate-shaped elastic member abutting against the surface of the surface moving member and extending in a longitudinal direction. The engaged device and the engaging device are engaged with each other on a surface moving direction downstream side of the surface moving member from a normal line of a section of the surface of the surface moving member against which the plate-shaped elastic member abuts. The holding member holds the plate-shaped elastic member by means of the warpage regulating device. The plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member. The engaging device and the engaged device are configured to be engaged with each other with a degree of freedom such that the holding member is displaceable with respect to the device main body. The biasing device biases the holding member on a surface moving direction upstream side of the surface moving member from a gravity center position of an elastic member unit that integrally supports at least the plate-shaped elastic member and the holding member and is displaced with respect to the device main body.

In another aspect of the present invention, a cleaning device comprises a cleaning member, which abuts against a surface moving member to clean the surface moving member at one side on a leading end part side of the cleaning member that extends in a direction perpendicular to a moving direction of the surface moving member; and a supporting member that supports the cleaning member. A base end part of the cleaning member is supported by the supporting member such that a free length of an end part on the leading end part side becomes substantially zero to regulate warpage of the cleaning member when the cleaning member abuts against the surface moving member, and the end part separates from the supporting member when the cleaning member is not in abutment against the surface moving member, but abuts against the supporting member from the base end part throughout the one side when the cleaning member is in abutment against the surface moving member.

In another aspect of the present invention, a process cartridge is configured to be attachable to and detachable from a main body of an image forming apparatus for eventually transferring to a recording material an image formed on an image carrier functioning as a surface moving member, and integrally supports at least the image carrier and a cleaning device for removing an unwanted object adhering to the image carrier. The cleaning device comprises a long plate-shaped elastic member; a holding member for holding the plate-shaped elastic member; an engaged device provided in the holding member; an engaging device engaged with the engaged device and supported in a device main body; and a warpage regulating device for regulating warpage of the plate-shaped elastic member that is generated by pressing the plate-shaped elastic member against a surface of the surface moving member. The engaged device and the engaging device are engaged with each other on a surface moving direction downstream side of the surface moving member from a normal line of a section of the surface of the surface moving member against which the plate-shaped elastic member abuts. The holding member holds the plate-shaped elastic member by means of the warpage regulating device. The plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member. The engaging device and the engaged device are configured to be engaged with each other with a degree of freedom such that the holding member is displaceable with respect to the device main body. The holding member is positioned in relation to the device main body, such that one side of the plate-shaped elastic member abutting against the surface of the surface moving member and extending in the longitudinal direction contains two contact parts out of three contact parts between the holding member and the device main body, the three contact parts being outside a straight line for positioning the holding member in relation to the device main body.

In another aspect of the present invention, a process cartridge is configured to be attachable to and detachable from a main body of an image forming apparatus for eventually transferring to a recording material an image formed on an image carrier functioning as a surface moving member, and integrally supports at least the image carrier and cleaning device for removing an unwanted object adhering to the image carrier. The cleaning device comprises a long plate-shaped elastic member; a holding member for holding the plate-shaped elastic member; an engaged device provided in the holding member; an engaging device engaged with the engaged device and supported in a device main body; a warpage regulating device for regulating warpage of the plate-shaped elastic member that is generated by pressing the plate-shaped elastic member against a surface of the surface moving member; and a biasing device for biasing the plate-shaped elastic member and the holding member toward the surface moving member. The engaged device and the engaging device are engaged with each other on a surface moving direction downstream side of the surface moving member from a normal line of a section of the surface of the surface moving member against which the plate-shaped elastic member abuts. The holding member holds the plate-shaped elastic member by means of the warpage regulating device. The plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member. The engaging device and the engaged device are configured to be engaged with each other with a degree of freedom such that the holding member is displaceable with respect to the device main body. A pressing force applied to the surface of the surface moving member by one side of the plate-shaped elastic member abutting against the surface of the surface moving member and extending in the longitudinal direction is greater than a pressing force applied to the engaging device by the engaged means of the holding member, the pressing forces being generated by the biasing device biasing the plate-shaped elastic member and the holding member.

In another aspect of the present invention, a process cartridge is configured to be attachable to and detachable from a main body of an image forming apparatus for eventually transferring to a recording material an image formed on an image carrier functioning as a surface moving member, and integrally supports at least the image carrier and cleaning device for removing an unwanted object adhering to the image carrier. The cleaning device comprises a long plate-shaped elastic member; a holding member for holding the plate-shaped elastic member; an engaged device provided in the holding member; an engaging device engaged with the engaged device and supported in a device main body; a warpage regulating device for regulating warpage of the plate-shaped elastic member that is generated by pressing the plate-shaped elastic member against a surface of the surface moving member; and a biasing device for biasing the holding member such that the surface of the surface moving member is pressed by one side of the plate-shaped elastic member abutting against the surface of the surface moving member and extending in a longitudinal direction. The engaged device and the engaging device are engaged with each other on a surface moving direction downstream side of the surface moving member from a normal line of a section of the surface of the surface moving member against which the plate-shaped elastic member abuts. The holding member holds the plate-shaped elastic member by means of the warpage regulating device. The plate-shaped elastic member is pressed against the surface of the surface moving member such that one side of the plate-shaped elastic member that extends in the longitudinal direction is perpendicular to a surface moving direction of the surface moving member, to remove the object adhering to the surface of the surface moving member.

The engaging device and the engaged device are configured to be engaged with each other with a degree of freedom such that the holding member is displaceable with respect to the device main body. The biasing device biases the holding member on a surface moving direction upstream side of the surface moving member from a gravity center position of an elastic member unit that integrally supports at least the plate-shaped elastic member and the holding member and is displaced with respect to the device main body.

BRIEF DESCRIPTION OF THE DRAWINGS

The above and other objects, features and advantages of the present invention will become more apparent from the following detailed description taken with the accompanying drawings in which:

FIG. 17 is a table showing properties of [toner 1] to [toner 8] obtained in each example of the first embodiment;

DESCRIPTION OF THE PREFERRED EMBODIMENT(s)

Prior to explaining the present invention, the conventional cleaning devices of the present invention, that is, particularly the trailing type cleaning device and the counter type cleaning device, will be described hereinafter with reference to the drawings.

Figure 1A:
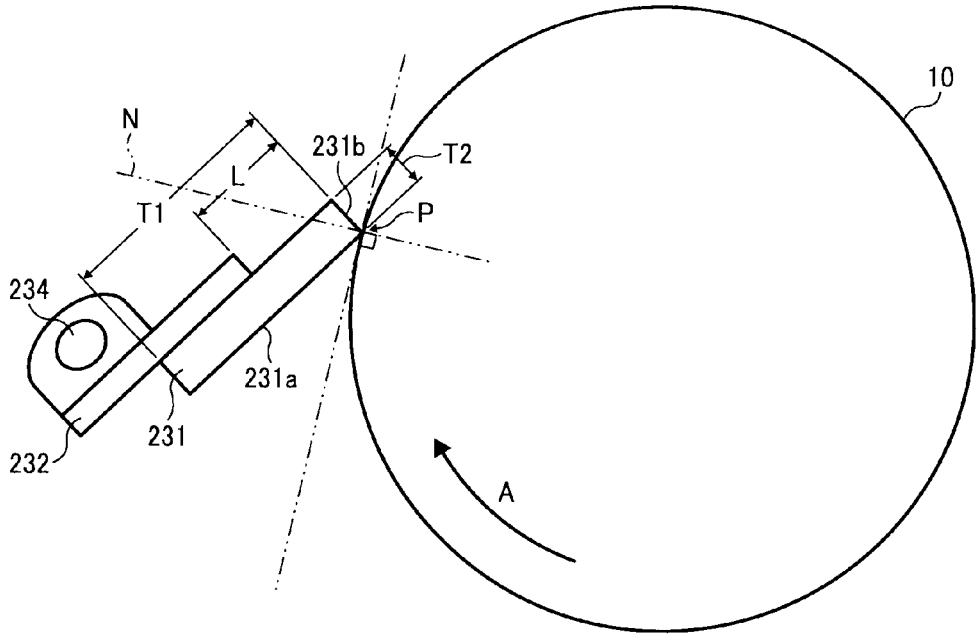
FIG. 1A PRIOR ART
FIG. 1A is a diagram for explaining a conventional trailing type cleaning device.

FIG. 1A shows a configuration of the conventional trailing cleaning device.

In this cleaning device, a long cleaning blade 231, which is made of an elastic member and extends along a rotating shaft direction of a drum-shaped photoreceptor (surface moving member) 10 that is perpendicular to a surface moving direction A of the photoreceptor, is configured such that one side thereof extending in its longitudinal direction (to be referred to as "abutting side" hereinafter) is pressed against the surface of the photoreceptor 10. In this trailing type cleaning device, the cleaning blade 231 is held by a cleaning blade holder 232, which is a holding member supported in the device main body and is located on a photoreceptor surface moving direction upstream side from a normal line N of an abutting section P on the photoreceptor surface abutting against the abutting side of the cleaning blade 231. In this specification, "trailing type" is a type of cleaning device in which the position of a supporting part 234 of the holding member holding an elastic member in relation to the device main body is located on the surface moving member surface moving direction upstream side from the normal line of the abutting section on the surface of the surface moving member abutting the abutting side of the elastic member.

Figure 1B:
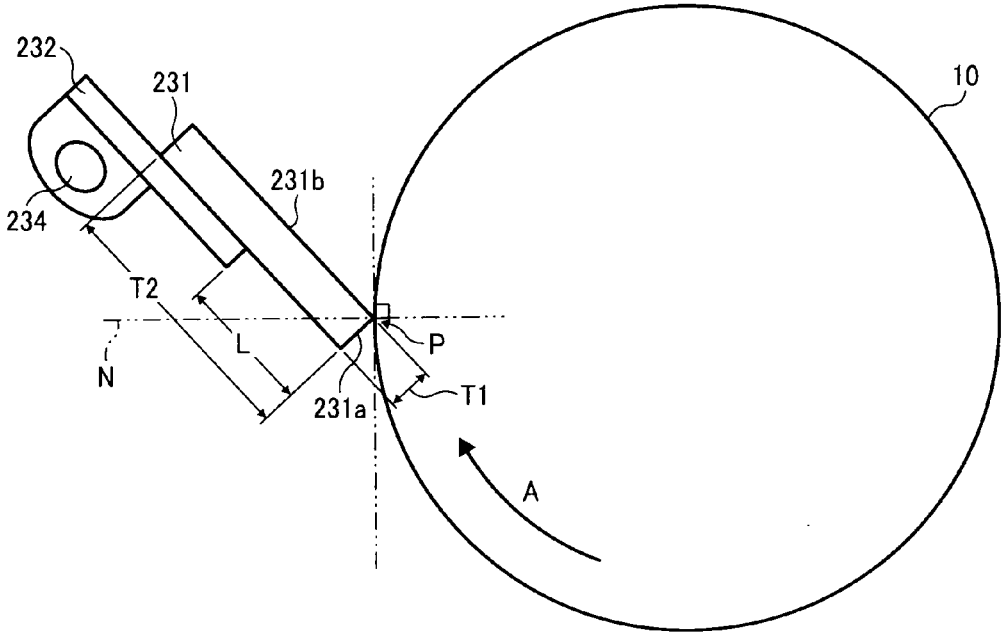
FIG. 1B PRIOR ART
FIG. 1B is a diagram for explaining a conventional counter type cleaning device.

FIG. 1B shows a configuration of the conventional counter type cleaning device.

In this cleaning device as well, the long cleaning blade 231, which is made of an elastic member extends along the rotating shaft direction of the photoreceptor that is perpendicular to the surface moving direction A of the photoreceptor, is configured such that the abutting side thereof extending in its longitudinal direction is pressed against the surface of the photoreceptor 10. In this counter type cleaning device, the cleaning blade 231 is held by the cleaning blade holder 232, which is supported in the device main body and is located on the photoreceptor surface moving direction downstream side from the normal line N of the abutting section P on the photoreceptor surface abutting against the abutting side of the cleaning blade 231. In this specification, "counter type" is a type of cleaning device in which the position of the supporting part 234 of the holding member holding the elastic member in relation to the device main body is located on the surface moving member surface moving direction downstream side from the normal line of the abutting section on the surface of the surface moving member abutting the abutting side of the elastic member.

The trailing type and counter type cleaning devices are described in further detail. In the trailing type cleaning device, the cleaning blade 231 warps when the cleaning blade 231 is pressed strongly in order to increase abutment pressure. Then, a face contact phenomenon occurs in which a cleaning blade upstream side face 231*a* that is positioned on the photoreceptor surface moving direction upstream side with respect to the abutting side of the cleaning blade 231 comes into contact with the photoreceptor surface. When the face contact occurs, the abutment area between the cleaning blade 231 and the photoreceptor surface increases drastically, and consequently the abutment pressure decreases even when the cleaning blade 231 is pressed strongly, deteriorating the removing performance.

In the case of the counter type cleaning device, on the other hand, even when the cleaning blade 231 is pressed strongly in order to increase the abutment pressure, the frictional force acts against warpage of the cleaning blade. For this reason, the cleaning blade 231 hardly warps. Therefore, the face contact phenomenon does not occur easily even when pressing the cleaning blade 231 strongly, and therefore a great pressing force can be applied to a small abutment area. As a result, high abutment pressure and high removing performance can be achieved. However, there are several unsolved problems, as described above.

Embodiments of the present invention that solve the above-mentioned several unsolved problems of the conventional technologies will be explained hereinafter with reference to the drawings.

It is to be noted that the reference numerals used in each embodiment are independent of the reference numerals of the other embodiments, i.e., the same reference numerals do not always designate the same structural elements.

FIRST EMBODIMENT

A first embodiment in which the present invention is applied to a printer functioning as an image forming apparatus is now described hereinafter.

Figure 2:
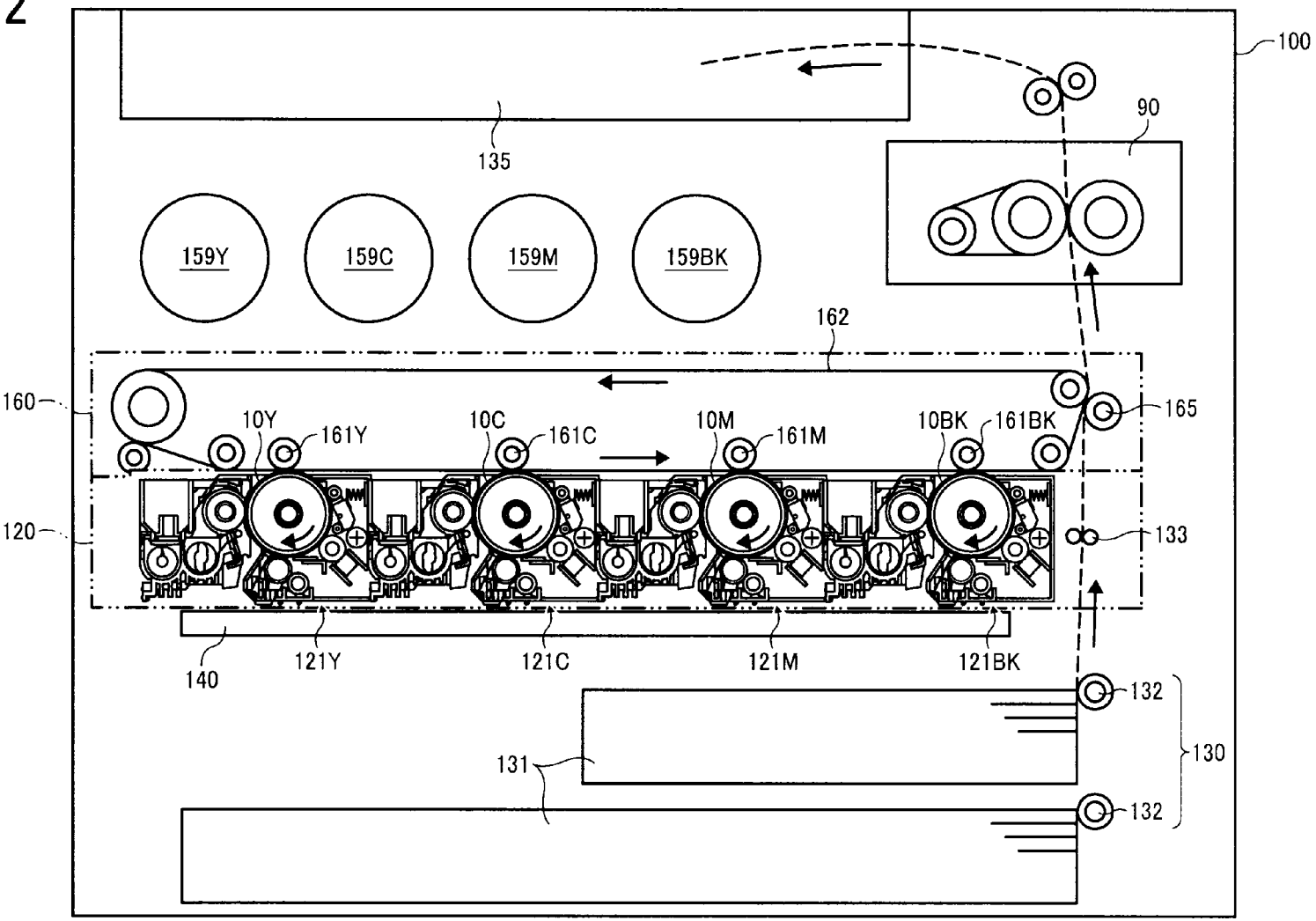
FIG. 2 is a diagram showing a schematic configuration of a cleaning device of a printer according to a first embodiment of the present invention.

FIG. 2 shows a schematic configuration of a printer 100, which is an image forming apparatus of the present embodiment.

The printer 100 for forming a full-color image is configured mainly by an image forming part 120, a secondary transfer device 160, and a sheet feeding part 130. Note in the following description that the notations of Y, C, M and Bk represent yellow, cyan, magenta, and black members, respectively.

In the image forming part 120, from the left-hand side of the diagram, a yellow toner process cartridge 121Y, a cyan toner process cartridge 121C, a magenta toner process cartridge 121M, and a black toner process cartridge 121Bk are provided. These process cartridges 121Y, 121C, 121M and 121Bk are arranged in substantially horizontally.

The secondary transfer device 160 is configured mainly by an endless intermediate transfer belt 162, which is an intermediate transfer body wrapped around a plurality of supporting rollers, primary transfer rollers 161Y, 161C, 161M and 161Bk, and a secondary transfer roller 165. The intermediate transfer belt 162 is disposed above the process cartridges 121Y, 121C, 121M and 121Bk, along a surface moving direction of drum-shaped photoreceptors 10Y, 10C, 10M and 10Bk that are latent image carriers functioning as surface moving members and image carriers provided in the respective process cartridges. The intermediate transfer belt 162 performs surface movement in synchronization with surface movement of the photoreceptors 10Y, 10C, 10M and 10Bk. Each of the primary transfer rollers 161Y, 161C, 161M and 161Bk is disposed on an inner circumferential surface side of the intermediate transfer belt 162, and an outer circumferential surface (surface) positioned on the lower side of the intermediate transfer belt 162 is weakly press-contacted with the outer circumferential surface (surface) of each of the photoreceptors 10Y, 10C, 10M and 10Bk by the primary transfer rollers.

A configuration and operation of forming a toner image on each of the photoreceptors 10Y, 10C, 10M and 103*k* and transferring the toner images to the intermediate transfer belt 162 are substantially the same for all of the process cartridges 121Y, 121C, 121M and 121Bk. However, the primary transfer rollers 161Y, 161C and 161M corresponding to the three color process cartridges 121Y, 121C and 121M are provided with a swing mechanism (not shown) for swinging these primary transfer rollers up and down. This swing mechanism operates to not bring the intermediate transfer belt 162 into contact with the photoreceptors 10Y, 10C and 10M when a color image is not formed.

The secondary transfer device 160 is configured to be attachable to and detachable from the main body of the printer 100. Specifically, by opening a front cover (not shown) on the near side of the page of FIG. 2, which covers the image forming part 120 of the printer 100, and sliding the secondary transfer device 160 from the far side of the page of FIG. 2 towards the near side, the secondary transfer device 160 can be detached from the main body of the printer 100. When attaching the secondary transfer device 160 to the main body of the printer 100, the opposite work from this detaching work may be performed.

An intermediate transfer belt cleaning device for removing residual toner after secondary transfer or other object adhering to the intermediate transfer belt 162 may be provided on the upstream side of the process cartridge 121Y, which is the surface moving direction downstream side of the secondary transfer roller 165 in the intermediate transfer belt 162. When the intermediate transfer belt cleaning device is provided, the same configuration as that of a photoreceptor cleaning device, which is described hereinafter, may be adopted for this intermediate transfer belt cleaning device. In addition, the intermediate transfer belt cleaning device may be integrated with the intermediate transfer belt 162 and provided to the secondary transfer device 160.

Toner process cartridges 159Y, 159C, 159M and 159Bk corresponding to the process cartridges 121Y, 121, 121M and 121Bk respectively are arranged in substantially horizontally on the upper side of the secondary transfer device 160.

An exposure device 140, which irradiates the surfaces of the charged photoreceptors 10Y, 10C, 10M and 10Bk with a laser beam, is disposed on the lower side of the process cartridges 121Y, 121C, 121M and 121Bk.

Furthermore, the sheet feeding part 130 is disposed on the lower side of the exposure device 140. The sheet feeding part 130 is provided with a sheet feeding cassette 131 for accommodating transfer sheets as recording materials, and a sheet feeding roller 132. A transfer sheet is fed through a resist roller pair 133 toward a secondary transfer nip part between the intermediate transfer belt 162 and the secondary transfer roller 165 in a predetermined timing.

A fixing device 90 is disposed on a transfer sheet conveying direction downstream side of the secondary transfer nip part. A discharged sheet storage 135 for storing a discharge roller and a discharged transfer sheet is disposed on the transfer sheet conveying direction downstream side of the fixing device 90.

Figure 3:
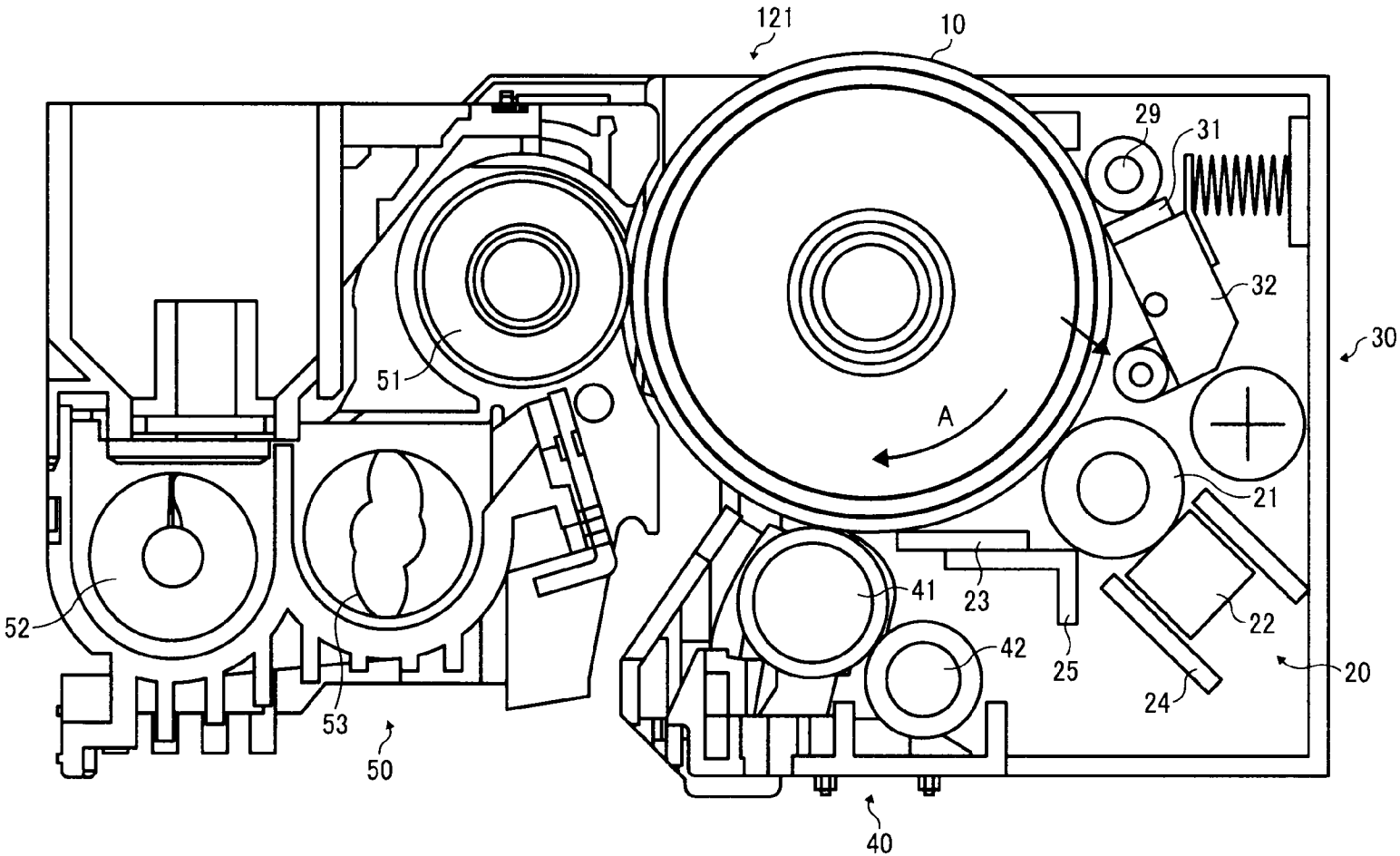
FIG. 3 is a diagram showing a schematic configuration of a process cartridge provided in the printer.

FIG. 3 shows a schematic configuration of the process cartridge 121 provided in the printer 100.

Because the process cartridges have substantially the same configuration, the notations Y, C, M and Bk for discriminating the process cartridges by the colors will be omitted to describe the configuration and operations of the process cartridges.

The process cartridge 121 has the photoreceptor 10, and a cleaning device 30, a charging device 40, and a developing device 50 that are arranged around the photoreceptor 10.

In order to remove transfer residual toner or other object adhering to a surface of the photoreceptor 10, the cleaning device 30 presses one side (abutting side) of a cleaning blade (to be referred to as "blade 31" hereinafter) elongated in a rotating shaft direction of the photoreceptor 10 and made of an elastic member, against a surface of the photoreceptor 10, the one side extending in a longitudinal direction of the photoreceptor 10. In the present embodiment, polyurethane rubber is used as the material of the blade 31, as polyurethane rubber is excellent in abrasion property and abrasion resistance against the photoreceptor 10, compare to other elastic material. The cleaning device 30 will be described hereinafter in more detail.

The cleaning device 30 may be provided with a lubricant application device 20. A the lubricant application device 20, the one configured by a solid lubricant 22, a lubricant supporting member 24 supporting the solid lubricant 22, and a lubricant application brush roller 21 rotating while contacting both the solid lubricant 22 and the photoreceptor 10 can be used. In this lubricant application device 20, a powder lubricant is scraped off from the solid lubricant 22 by the brush roller 21 and applied to the surface of the photoreceptor 10 by means of the brush roller 21. Furthermore, an application blade 23 may be disposed on the photoreceptor surface moving direction downstream side of the brush roller 21 so as to abut against the surface of the photoreceptor 10. This application blade 23 is supported by an application blade holder 25, with a tip end part of the application blade 23 abutting the surface of the photoreceptor 10, to even out the thickness of the lubricant applied to the surface of the photoreceptor 10.

The charging device 40 is configured mainly by a charging roller 41 disposed to abut against the photoreceptor 10, and a charging roller cleaner 42 that rotates while abutting against the charging roller 41.

The developing device 50 for supplying toner to the surface of the photoreceptor 10 and making an electrostatic latent image visible has a developing roller 51 serving as a developer carrier for carrying a developer to the surface. The developing device 50 is configured mainly by the developing roller 51, a stirring screw 52 stirring and conveying the developer stored in a developer storage, and a supply screw 53 supplying and conveying the stirred developer to the developing roller 51.

The four process cartridges 121 configured as described above can be attached/detached and/or replaced independently by a serviceman or a user. In the process cartridge 121 that is detached from the printer 100, the photoreceptor 10, charging device 40, developing device 50, and cleaning device 30 are configured so as to be replaceable with new devices independently. It should be noted that the process cartridge 121 may have a waste toner tank for recovering the transfer residual toner recovered by the cleaning device 30. In this case as well, the waste toner tank may be detachable and/or replaceable independently in the process cartridge 121, in order to improve convenience.

The operations of the printer 100 will be described next.

Once a print command is received, first the photoreceptor 10 is rotated in a direction of the arrow A shown in the diagram, and the surface of the photoreceptor 10 is uniformly charged to a predetermined polarity by the charging roller 41 of the charging device 40. The exposure device 140 irradiates the charged photoreceptor 10 with, for example, a colored laser beam that is subjected to light modulation in response to input color image data, and thereby forms an electrostatic latent image of each color on the surface of the photoreceptor 10. A developer of each color is supplied from the developing roller 51 of a developing device 50 of each color to each electrostatic latent image. The electrostatic latent image of each color is developed by the developer of each color to form a toner image of each color, and this toner image is made visible. Next, a transfer electric field is formed by applying a transfer voltage of opposite polarity to the polarity of the toner images, to the primary transfer roller 161, and a primary transfer nip is formed by weakly press-contacting the intermediate transfer belt 162 by means of the primary transfer roller 161. As a result of these actions, the toner images on the photoreceptor 10 are primarily transferred onto the intermediate transfer belt 162 efficiently. The toner images of the respective colors formed on the photoreceptors 10 are transferred onto the intermediate transfer belt 162 in a stacked manner, whereby a stack toner image is formed.

The transfer sheet accommodated in the sheet feeding cassette 131 is fed through the sheet feeding roller 132 and the resist roller pair 133 in a predetermined timing. Then, a transfer electric field is formed by applying a transfer voltage of opposite polarity to the polarity of the toner image, to the secondary transfer roller 165, and the stacked toner image that is primary transferred onto the intermediate transfer belt 162 is transferred to the transfer sheet. The stacked toner image that is secondarily transferred to the transfer sheet is sent to the fixing device 90 and thereby fixed by heat and pressure. The transfer sheet to which the toner images are fixed is discharged by the discharge roller and placed on the discharged sheet storage 135. On the other hand, the transfer residual toner remaining on the photoreceptor 10 after primary transfer is scraped off by the blade 31 of the cleaning device 30 and removed.

Next, the cleaning device 30, the characteristic part of the present invention, will be described in detail.

Figure 4:
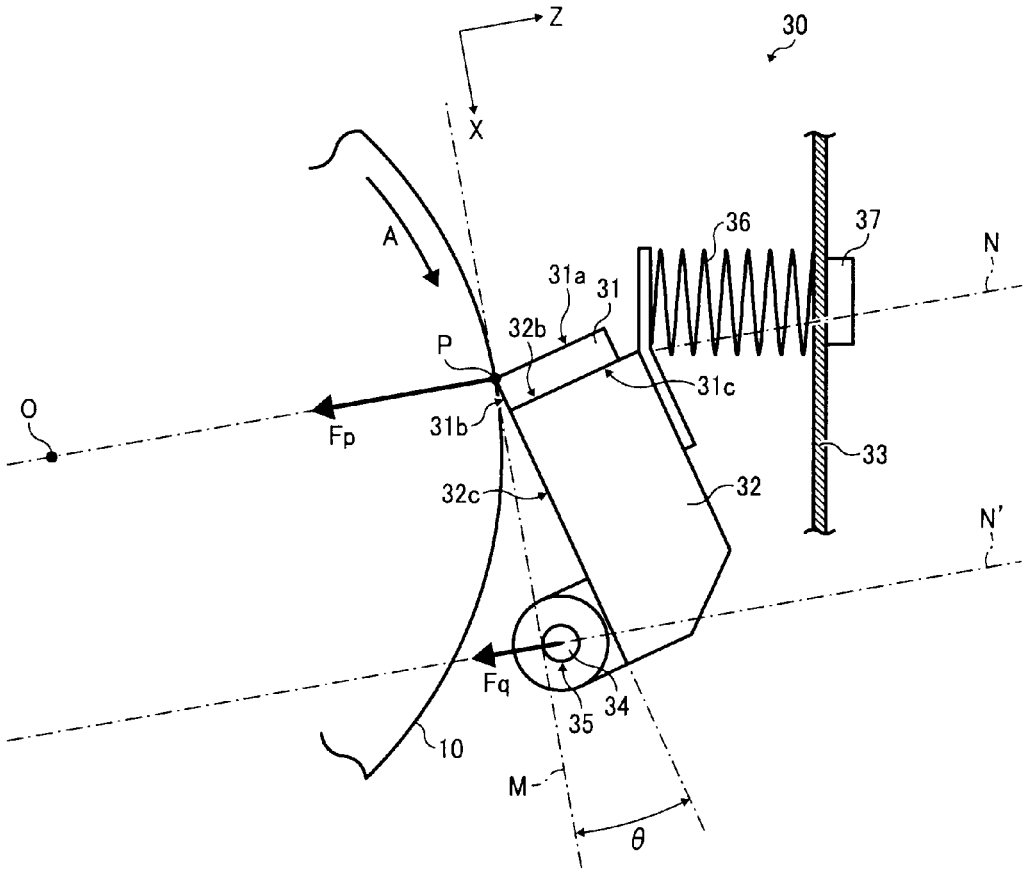
FIG. 4 is a diagram in which a main part of the cleaning device is viewed from a rotating shaft direction of a photoreceptor.
Figure 5:
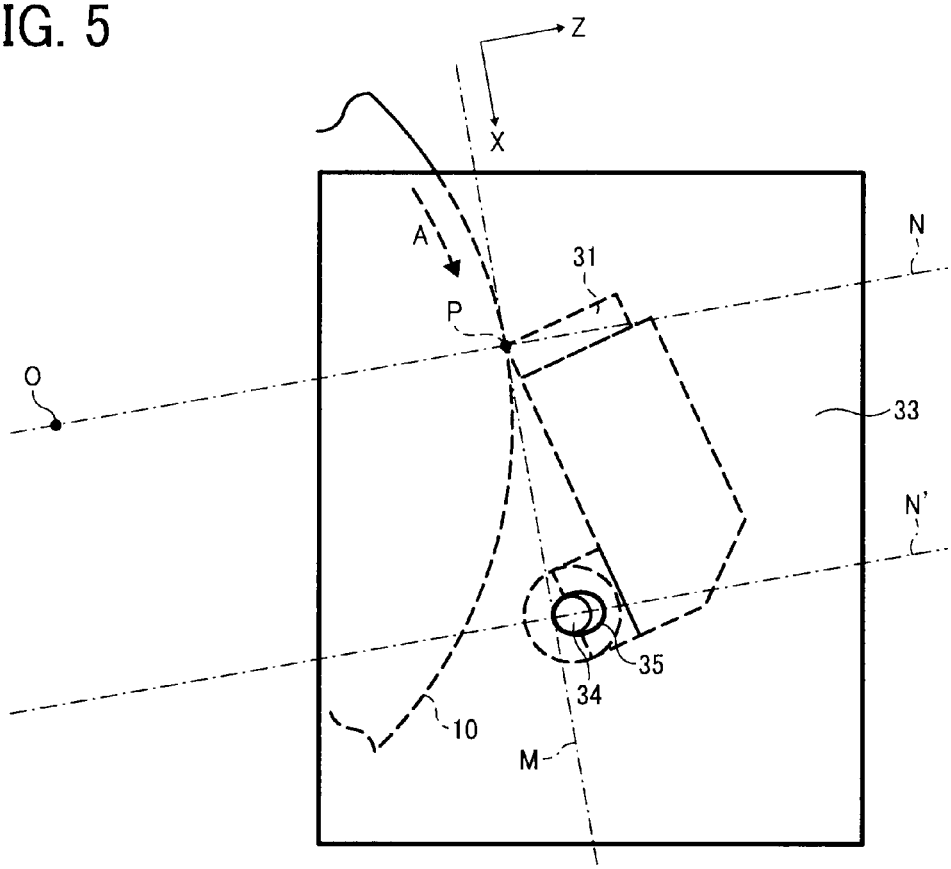
FIG. 5 is a diagram in which the main part of the cleaning device is viewed through a frame body.
Figure 6:
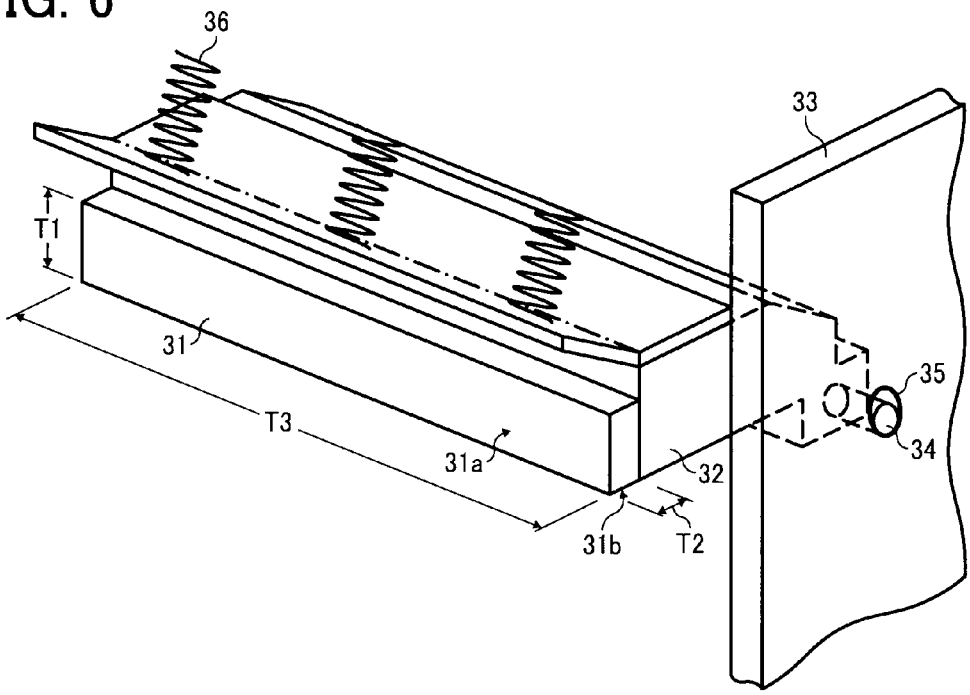
FIG. 6 is a perspective view showing the exterior of the main part of the cleaning device.

FIG. 4 is a diagram in which a main part of the cleaning device 30 is viewed from the rotating shaft direction (Y direction) of the photoreceptor 10. FIG. 5 is a diagram in which the main part of the cleaning device 30 is viewed through a frame body 33 holding the blade holder 32, showing the configurations of a bearing part 35 provided in the frame body 33 and a spindle 34 provided in the blade holder 32. FIG. 6 shows the configuration of the main part of the cleaning device 30.

The cleaning device 30 of the present embodiment mainly has the blade 31, which is a plate-shaped elastic member, and the blade holder 32, which is an elastic holding member holding the blade 31 and made of a rigid material.

The cleaning device 30 of the present embodiment is also configured such that the blade holder 32 is held so as to be rotatable with respect to the frame body 33 of the cleaning device 30, on the a photoreceptor surface moving direction downstream side from the normal line N of the abutting section P of the surface of the photoreceptor 10, against which the abutting side of the blade 31 abuts. In other words, the counter type cleaning device is employed as the cleaning device 30 of the present embodiment.

When the blade 31 is pressed against the photoreceptor 10, which is a surface moving body, the blade 31 is held such that free length of the blade 31 becomes substantially zero relative to the blade holder 32, so that the blade 31 does not warp.

Note in the cleaning device 30 shown in FIG. 4, out of two surfaces that are adjacent to each other with one long side of the blade holder 32 therebetween, the long side being most proximate to the surface of the photoreceptor 10, one surface of the plate-shaped blade 31 (31*c* in FIG. 4) is entirely attached to a holder upstream side surface 32*b* located on the photoreceptor surface moving direction upstream side. Due to this configuration, the blade holder 32 can hold the blade 31 so that the free length of the blade 31 becomes substantially zero. As a configuration for holding the blade 31 so that the free length thereof becomes substantially zero, the configuration shown in FIG. 7 can be used in which, out of the two surfaces, one surface of the plate-shaped blade 31 is entirely attached to a holder-photoreceptor facing surface 32*c*, which is a surface of the blade holder 32 positioned on the photoreceptor surface moving direction downstream side and facing the surface of the photoreceptor 10.

The configuration shown in FIG. 4 is described in the present embodiment.

In the cleaning device 30 of the present embodiment, out of the two surfaces that are adjacent to each other with one long side (abutting side) of the blade 31 therebetween, an upstream side surface 31*a* positioned on the surface moving direction upstream side of the photoreceptor 10 functioning as the surface moving member is longer than or equal to a downstream side surface 31*b* positioned on the surface moving direction downstream side of the photoreceptor 10, in terms of the length perpendicular to the abutting side as shown in FIG. 4. One surface of the blade holder 32 (32*b* shown in FIG. 4) is bonded to the surface facing the upstream side surface 31*a* (31*c* in FIG. 4), so as to regulate warpage of the blade 31 that causes the upstream side surface 31*a* of the blade 31 to extend and that shrinks the surface facing the upstream side surface 31*a*.

In the configuration of the cleaning device 30 that prevents warpage of the blade 31, the blade 31 does not have a degree of freedom for deforming along the surface of the photoreceptor 10. For this reason, it is difficult to bring the blade 31 into uniform abutment against the longitudinal direction of the photoreceptor 10 and to apply uniform pressure. Therefore, in case of poor part accuracy or assembly accuracy, for example, in some cases the distance between the blade 31 and the photoreceptor 10 at one end in the longitudinal direction of the blade 31 is different from the distance between the blade 31 and the photoreceptor 10 at the other end. When the distance between the blade 31 and the photoreceptor 10 varies at each end, the state of abutment between the photoreceptor and the blade 31 cannot be maintained in the longitudinal direction appropriately. In an extreme case, some sections of the photoreceptor 10 cannot abut against some sections of the blade 31 in the longitudinal direction.

In order to cope with this problem, the cleaning device 30 is configured with a degree of freedom so that the blade holder 32 is displaceable with respect to the frame body 33 of the cleaning device 30.

Here, a holding method of the blade holder 32 is described.

As shown in FIGS. 4 to 6, the holding method of the blade holder 32 with respect to the frame body 33 is configured by the spindle 34 functioning as engaged means provided in the blade holder 32, and the bearing part 35 functioning as engaging means provided in the frame body 33, and has a configuration in which a gap is generated by engagement between the spindle 34 the bearing part 35.

A shaft hole of the bearing part 35 has a round shape or elongated shape having a long axis in a direction substantially parallel to the normal line N. Furthermore, the spindle 34 can be made displaceable with respect to the bearing part 35, by using an elastic body as the bearing part 35.

Next, examples of the configuration in which the spindle 34 is made displaceable with respect to the bearing part 35 are described.

First of all, Example 1 and Example 2 are described in which a round hole and long hole are employed as the shaft hole.

EXAMPLE 1

Figure 8:
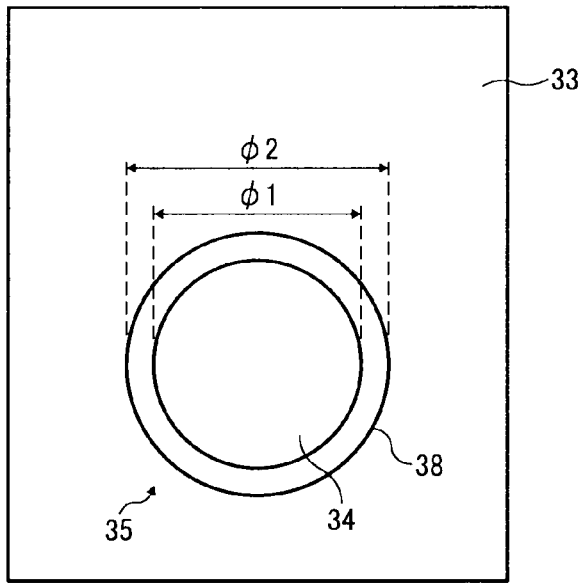
FIG. 8 is a diagram showing a configuration of the vicinity of a supporting part of a cleaning device Example 1 of the first embodiment, wherein a shaft hole of a part is formed into an unloaded hole.

First, FIG. 8 is used to explain Example 1 in which the round hole is employed and a gap is provided between the spindle 34 and the bearing part 35.

In Example 1 of FIG. 8 showing an engagement part between the frame body 33 and the spindle 34, the spindle 34 is a stainless steel round rod whose diameter Φ1 is 15±0.05 [mm]. Normally, when having a configuration in which a gap is not formed in the engagement between the spindle 34 and the bearing part 35, the shaft hole of the bearing part 35 has a round shape, and diameter ϕ2 thereof is 15.10±0.05 [mm].

On the other hand, in the case of Example 1 in which a gap is provided between the spindle 34 and the bearing part 35, diameter Φ2 of a round hole 38, which is the shaft hole, is 15.60±0.05 [mm].

Figure 7:
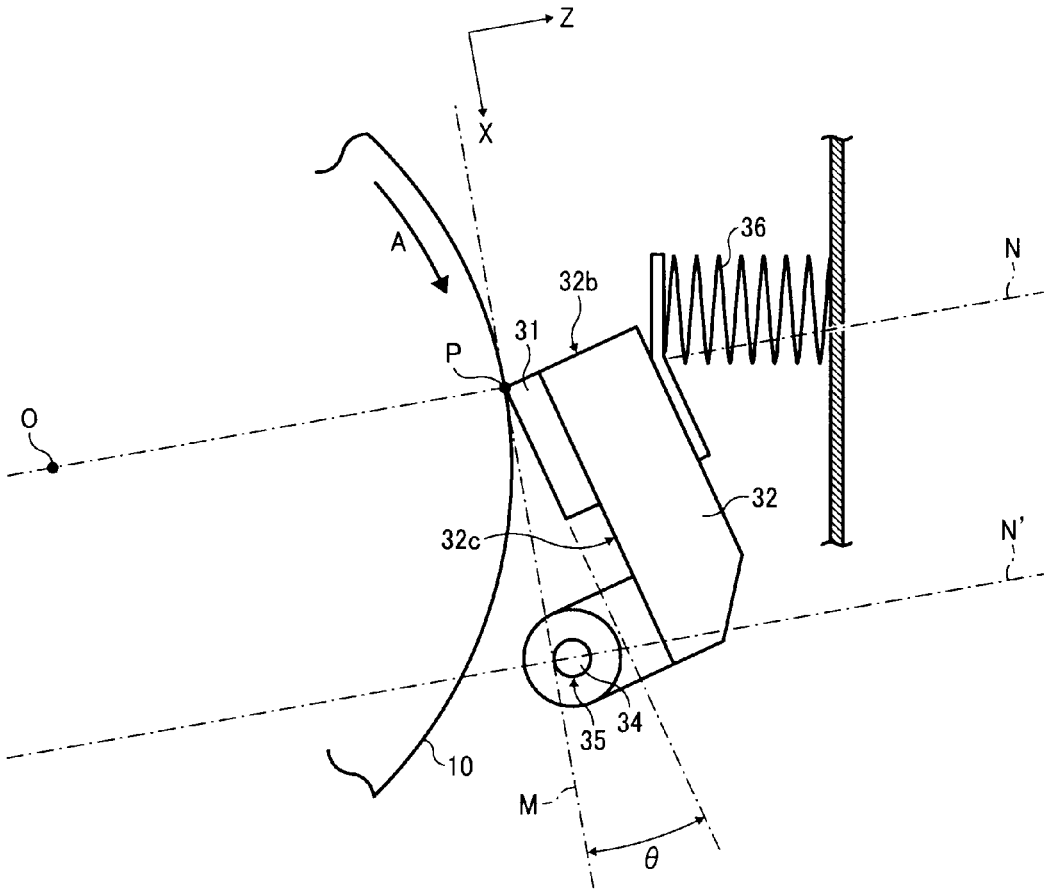
FIG. 7 is a diagram showing a configuration that is different from that of the first embodiment, wherein a blade is held such that free length of the blade becomes substantially zero.

This is because when accumulating fluctuations or tolerances of dimensional accuracy of the blade 31, blade holder 32 or bearing part 35, attachment accuracy of the blade holder 32 and blade 31, and positional accuracy of the cleaning device 30 and photoreceptor 10, the accumulation tolerance becomes ±0.5 [mm]. The diameter Φ2 of the round hole 38, which is the shaft hold of the bearing part 35, is made larger than the diameter Φ1 of the spindle 34 by this tolerance. In other words, when the shaft hole is shaped into a round hole, a gap is provided purposefully to the engagement part between the spindle 34 and the bearing part 35, as shown in FIG. 7. Therefore, the spindle 34 and the bearing part 35 can be engaged with each other with a certain degree of freedom.

For example, as in the prior art, when the spindle 34 and the bearing part 35 are engaged with each other without any degree of freedom, and when there is the abovementioned tolerance, the distance between the blade 31 and the photoreceptor 10 on one side of the bearing part 35 in the longitudinal direction of the blade 31 becomes different from the distance between the blade 31 and the photoreceptor 10 on the other side of the bearing part 35, and consequently the state of abutment between the photoreceptor 10 and the blade 31 in the longitudinal direction cannot be maintained appropriately. In short, some sections of the photoreceptor 10 cannot abut against some sections of the blade 31 in the longitudinal direction. Hence, by bringing the spindle 34 and the bearing part 35 into engagement with each other with a certain degree of freedom, as illustrated in Example 1, the spindle 34 and the bearing part 35 are engaged with each other on both sides of the bearing part 35 at a different position (position different in a radius direction of the bearing part) by the abovementioned tolerance, while the blade 31 is press-contacted with the photoreceptor 10. Because the position where the spindle 34 and the bearing part 35 are engaged with each other can be changed and the blade 31 can be displaced with respect to the photoreceptor 10 even when the abovementioned tolerance is generated, the state of abutment between the photoreceptor 10 and the blade 31 in the longitudinal direction can be maintained.

EXAMPLE 2

Figure 9:
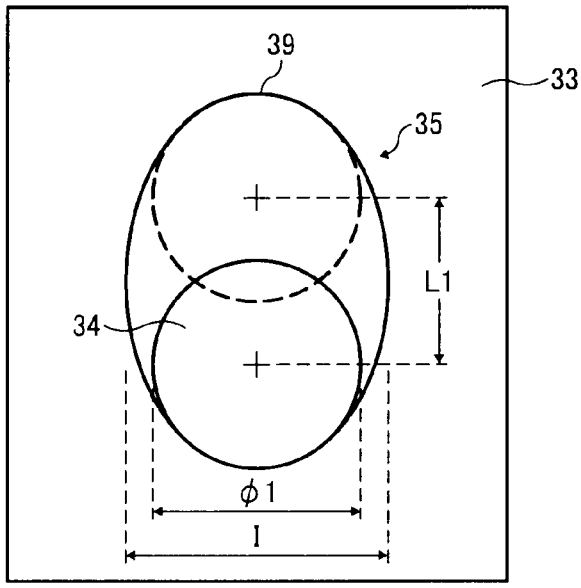
FIG. 9 is a diagram showing a configuration of the vicinity of a supporting part of a cleaning device of Example 2 of the first embodiment, wherein a shaft whole of a bearing part is formed into an elongated hole.

Next, FIG. 9 is used to explain Example 1 in which the long hole is employed and a gap is provided between the spindle 34 and the bearing part 35.

In Example 1 of FIG. 9 showing an engagement part between the frame body 33 and the spindle 34, a long hole 39 that has a long axis parallel to the normal line N shown in FIG. 1 is configured as the shaft hole of the bearing part 35.

Unlike the gap provided using the round hole illustrated in FIG. 8, provision of the long hole 39 having a long axis in the normal line direction (N) can prevent the blade holder 32 from being displaced with respect to the photoreceptor 10 in a sub-scanning direction and can only allow displacement in the normal line N direction that depends on the force of the abutting side of the blade 31 pressing the surface of the photoreceptor 10 functioning as the surface moving member. By forming the long hole 39, unnecessary displacement in the sub-scanning direction, vibration and other problems can be prevented effectively, compared to the configuration of the round hole 38.

For example, when the diameter $\phi$1 of the spindle 34 is 15±0.05 [mm], the length l of a short axis of the long hole 39 is 15.10±0.05 [mm]. Furthermore, when the accumulation tolerance is ±0.5 [mm], as described above, the long axis of the long hole 39 is set at 15.65±0.05 [mm] based on the diameter of the spindle 34 and a space L1 between the center of the spindle 34 when the spindle 34 is positioned in the uppermost part of the long axis and the center of the spindle 34 when the spindle 34 is positioned in the lowermost part, so that the space L1 becomes 0.65±0.05 [mm], which is greater than the tolerance.

Note that the spindle 34 is in engagement while contacting a rim of the long hole 39 in a direction parallel to a tangential line M of the abutting section P, when the photoreceptor 10 is driven. As a result, the spindle 34 can be prevented from vibrating when the photoreceptor 10 is driven.

Furthermore, because the spindle 34 and the bearing part 35 are engaged with each other with a certain degree of freedom in the direction of the long axis of the long hole 39, the spindle 34 and the bearing part 35 are engaged with each other on both sides of the bearing part 35 at a different position (position different in the direction of the long axis of the long hole 39) by the abovementioned tolerance, while the blade 31 is press-contacted with the photoreceptor 10.

In this manner, even when the abovementioned tolerance is generated, the position of engagement between the spindle 34 and the bearing part 35 changes, and the state of abutment between the photoreceptor 10 and the blade 31 can be maintained.

In the present embodiment, highly rigid materials are used for the spindle 34 and the blade holder 32 so that the spindle 34 and the blade holder 32 are not distorted. When the spindle 34 or blade holder 32 is distorted, the positional accuracy between the blade 31 and the photoreceptor 10 cannot be kept appropriately. Accordingly, a cleaning failure occurs, and the photoreceptor 10 or blade 31 is damaged. Note that in the present embodiment, a stainless-steel round rod is used as the spindle 34, but a metallic material having other iron as the main component, a metallic material having titanium as the main component, or other material having high rigidity can be used.

EXAMPLE 3

Moreover, a bearing member made of an elastic body may be provided as the bearing part 35.

Figure 10A:
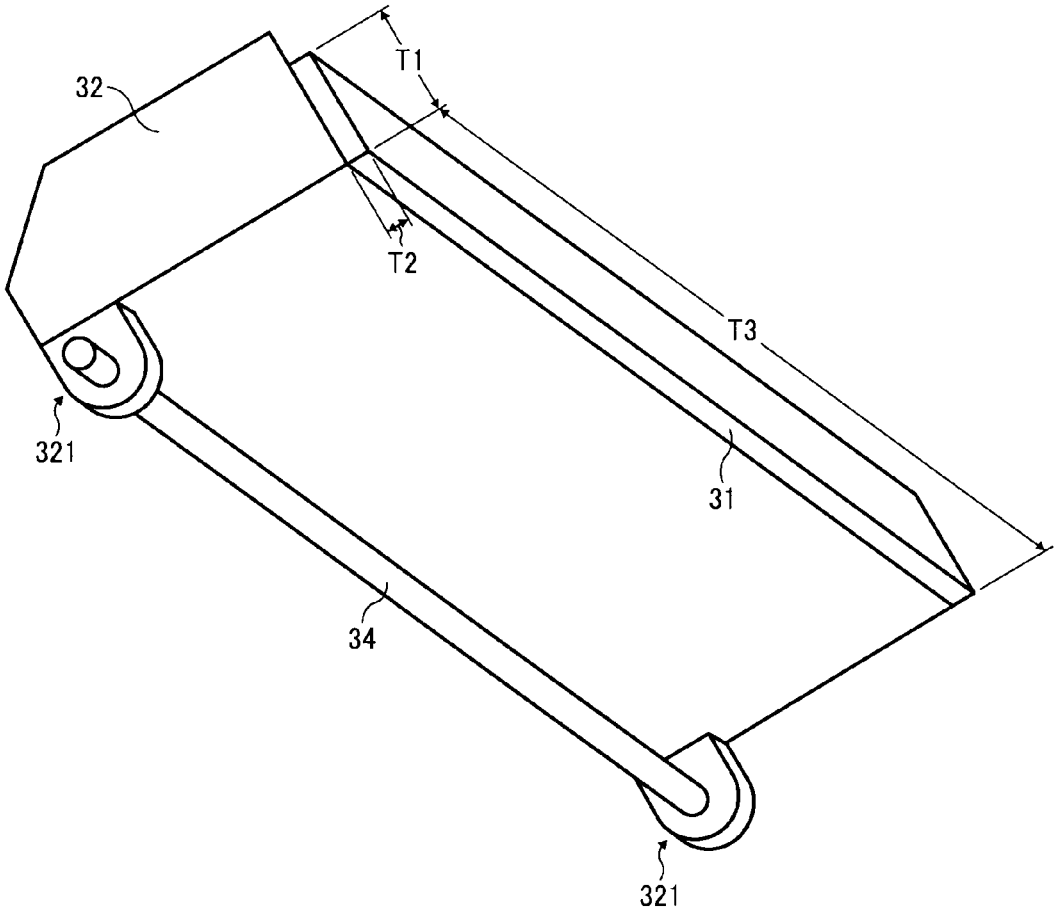
FIG. 10A is a perspective view showing a configuration of the vicinity of a supporting part of a cleaning device of Example 3 of the first embodiment, wherein a shaft hole of a bearing part is provided with an elastic bearing part.
Figure 10B:
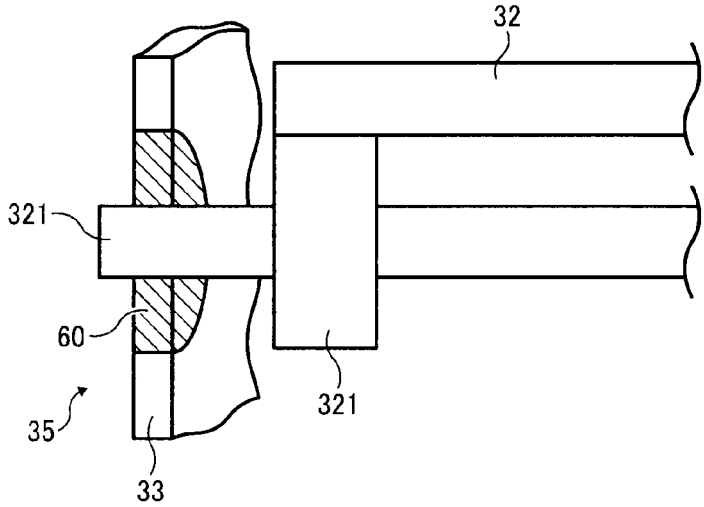
FIG. 10B is a cross-sectional diagram showing a configuration of the vicinity of the supporting part.

FIGS. 10A and 10B are used to explain Example 3 in which a bearing member made of an elastic body is provided to the bearing part and in which the spindle 34 of the blade holder 32 is engaged with the bearing part 35 with a certain degree of freedom so as to be displaceable with respect to the bearing part 35.

FIGS. 10A and 10B show a configuration of the cleaning device 30 of Example 3, which has an elastic bearing 60 as the bearing member made of an elastic body. FIG. 10A shows the exterior in which the blade holder 32 having the blade 31 fixed thereto is viewed from the photoreceptor 10 side. FIG. 10B shows a schematic configuration of the vicinity of the elastic bearing 60.

The bearing part 35 is rotatably supported by the elastic bearing 60 that is attached to the frame 33 of the cleaning device 30 via the spindle 34 attached to the blade holder 32. As shown in FIGS. 10A and 10B, the blade holder 32 has a shaft attaching part 321 to which the spindle 34 is attached.

In this manner, by providing to the bearing part 35 the elastic bearing 60 as the bearing member made of an elastic body, the spindle 34 and the bearing part 35 can be engaged with each other with a certain degree of freedom, as with Example 1 and Example 2 where a gap is formed.

As described in Example 1, a tolerance is generated in the positional relationship between the blade 31 and the photoreceptor 10, due to fluctuations in the dimensional accuracy of the blade 31, blade holder 32 or bearing part 35, the attachment accuracy of the blade holder 32 and blade 31, and the positional accuracy of the cleaning device 30 and photoreceptor 10. As in Example 3, by engaging the spindle 34 and the bearing part 35 with each other with a certain degree of freedom in relation to this tolerance, the spindle 34 and the bearing part 35 are engaged with each other on both sides of the bearing part 35 at a different position (position different in a radius direction of the bearing part) by the abovementioned tolerance, while the blade 31 is press-contacted with the photoreceptor 10. Because the position where the spindle 34 and the bearing part 35 are engaged with each other can be changed and the blade 31 can be displaced with respect to the photoreceptor 10 even when the abovementioned tolerance is generated, the state of abutment between the photoreceptor 10 and the blade 31 in the longitudinal direction can be maintained.

In Example 3, although the spindle 34 is attached to the blade holder 32 and the elastic bearing 60 made of an elastic body is provided to the frame body 33 of the cleaning device 30, the spindle may be provided to the frame 33 and the bearing member made of an elastic body may be provided to the blade holder 32.

Next will be described biasing means for bringing one long side (abutting side) of the blade 31 into press-contact with the surface of the photoreceptor 10 serving as the surface moving member.

As shown in FIGS. 4 and 6, the cleaning device 30 is provided with, in a blade longitudinal direction, a plurality of springs 36 as the biasing means for enhancing a pressing force applied by the blade 31 in the normal line direction of the abutting section P to the surface of the photoreceptor 10.

In the cleaning device 30 of the present embodiment, the springs 36 serving as the biasing means are arranged in the surface moving direction upstream of the photoreceptor 10 with respect to the gravity center G of a blade unit, which is an elastic member unit configured by the blade 31 and the blade holder 32.

Here, in a contact part between the main body of the cleaning device 30 and three blade units outside a straight line, which contributes to determining the positions of the blade units and the main body of the cleaning device 30, a straight line connecting two sections is obtained as a reference line.

By arranging the springs as described above, the blade 31 can be brought into abutment against the surface moving member by taking the long side (abutting side) of the blade 31 that contacts with the surface of the photoreceptor 10 in the abutting section P, as the reference line.

Figure 11:
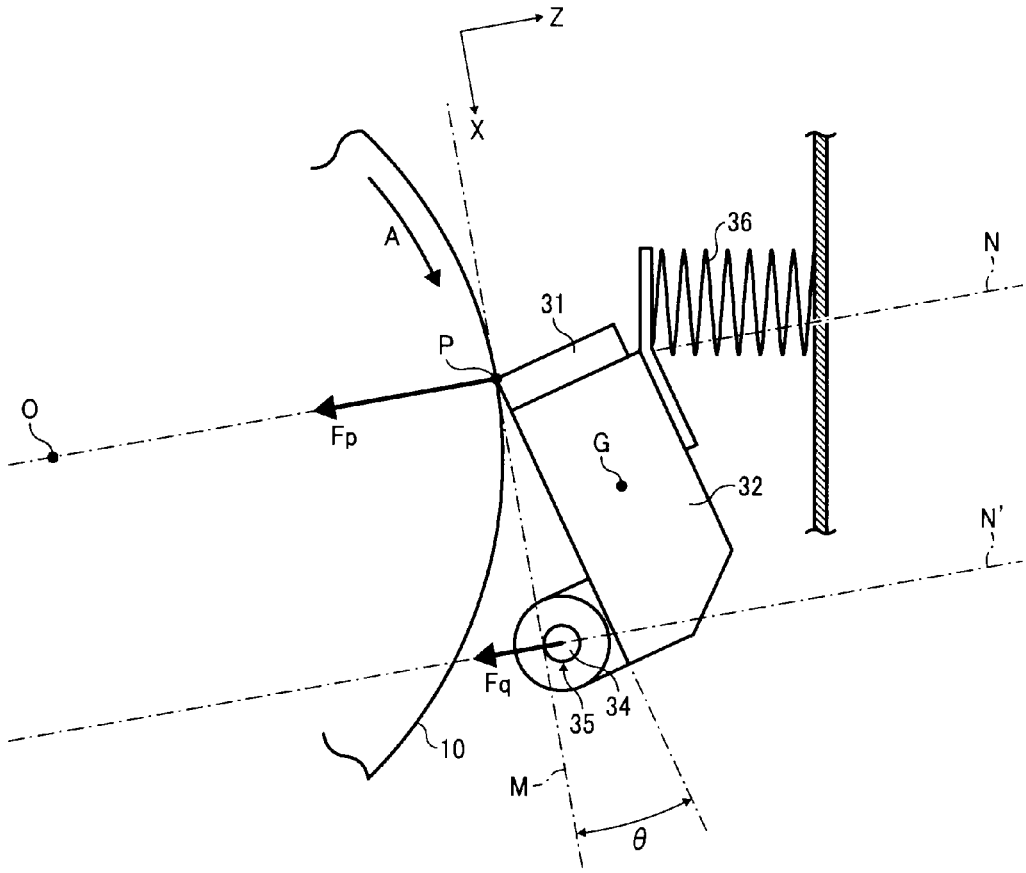
FIG. 11 is a diagram showing a positional relationship between a gravity center G and a biasing position in a blade unit of the cleaning device according to the first embodiment.

FIG. 11 is an illustrative diagram of the positional relationship between the gravity center G of the blade unit of the cleaning device 30 shown in FIG. 4 and the position biased by the springs 36.

As shown in FIG. 11, by applying pressure at a position on the surface moving direction upstream of the photoreceptor 10 from the position of the gravity center G, pressure is applied in a section that is sufficiently far from the position of the spindle 34 held by the frame body 33. Therefore, a pressing force Fp applied by the blade 31 to the surface of the photoreceptor 10 in the abutting section P becomes greater than a pressing force Fq applied by the spindle 34 to the both bearing parts 35, the spindle being provided in the blade holder 32. In other words, Fp>Fq is achieved. As a result, the position of the spindle 34 in relation to the both bearing parts 35 is determined when the long side (abutting side) of the blade 31 contacting the surface of the photoreceptor 10 in the abutting section P is in uniform abutment against the photoreceptor 10 in the longitudinal direction.

Figure 12B:
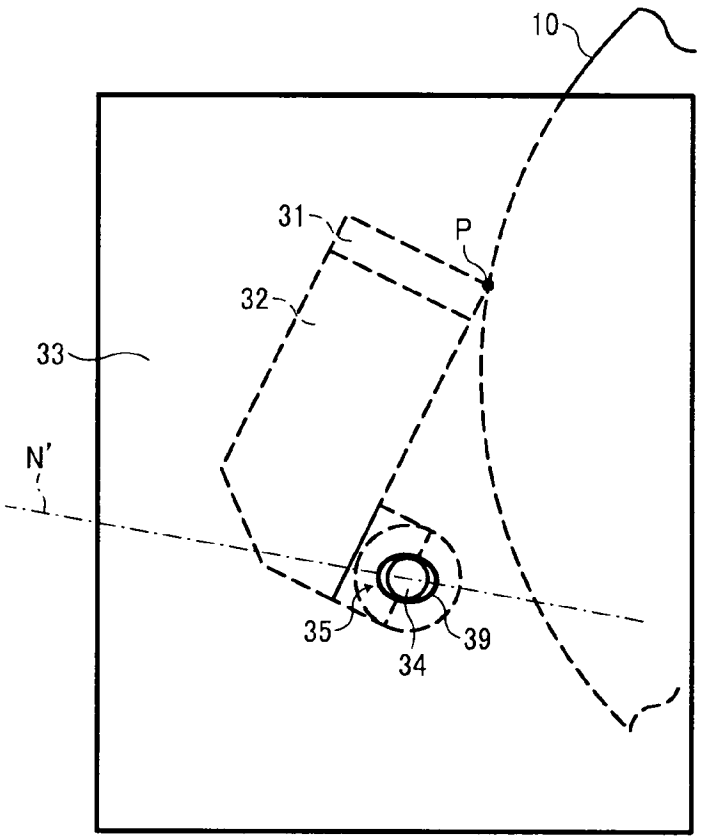
FIGS. 12A and 12B are diagrams for explaining an example of a state of engagement between the elongated hole and a spindle of the bearing part of the cleaning device.
Figure 12A:
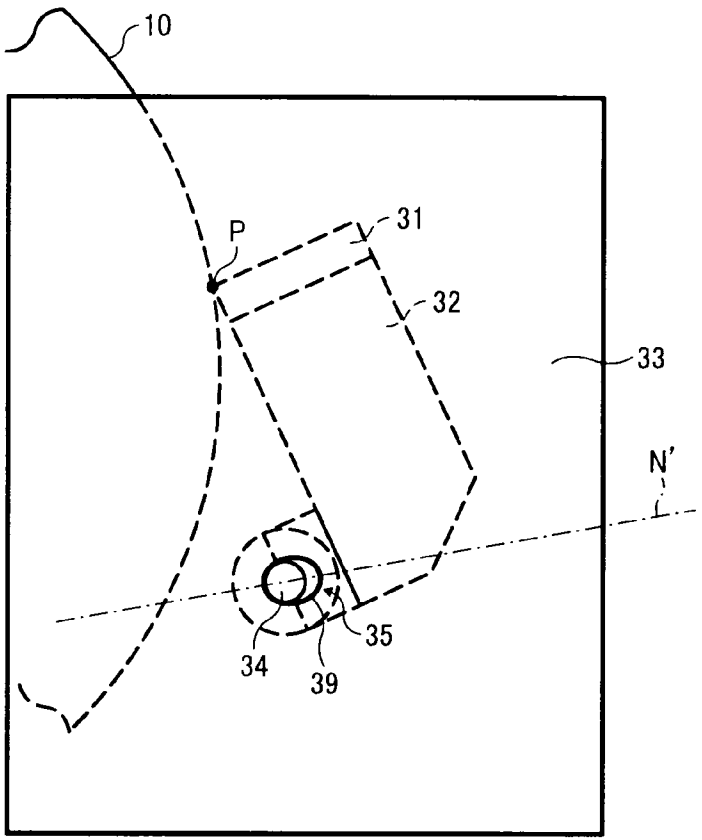

FIGS. 12A and 12B show an example of the state of contact between the blade 31 of the cleaning device 30 shown in FIG. 11 and the surface of the photoreceptor 10, as well as the state of engagement between the long hole 39 of the bearing part 35 and the spindle 34. FIG. 12A is a diagram in which the vicinity of an end part of the blade on the near side of FIG. 11 is viewed in the same direction as the direction shown in FIG. 11, and FIG. 12B a diagram in which the vicinity of an end part of the blade 31 on the far side of FIG. 11 is viewed from a direction opposite to that of the page of FIG. 11. As shown in FIGS. 12A and 12B, both ends of the abutting side of the blade 31 abut against the surface of the photoreceptor 10 in the abutting section P. On the other hand, the relationship between the spindle 34 and the both bearing parts 35 is such that one end (near side of FIG. 10) is positioned in one end of the long hole 39 as shown in FIG. 12A, and the other end (far side of FIG. 10) is positioned in the vicinity of the center of the long hole 39 as shown in FIG. 12B, and therefore the place where the spindle 34 is positioned varies in the both bearing parts 35. Note that FIGS. 12A and 12B illustrate the configuration in which the section where the bearing part 35 and the spindle 34 are engaged with each other is formed as the long hole 39 as in Example 2. However, when the bearing part 35 is the round hole 38 as described in Example 1, the position of the spindle 34 in the round hole 38 varies in the both bearing parts 35. In addition, as in Example 3, when the bearing part 35 is provided with the elastic bearing 60 that is the bearing member made of an elastic body, how the elastic bearing 60 deforms varies in the both bearing parts 35.

Figure 13:
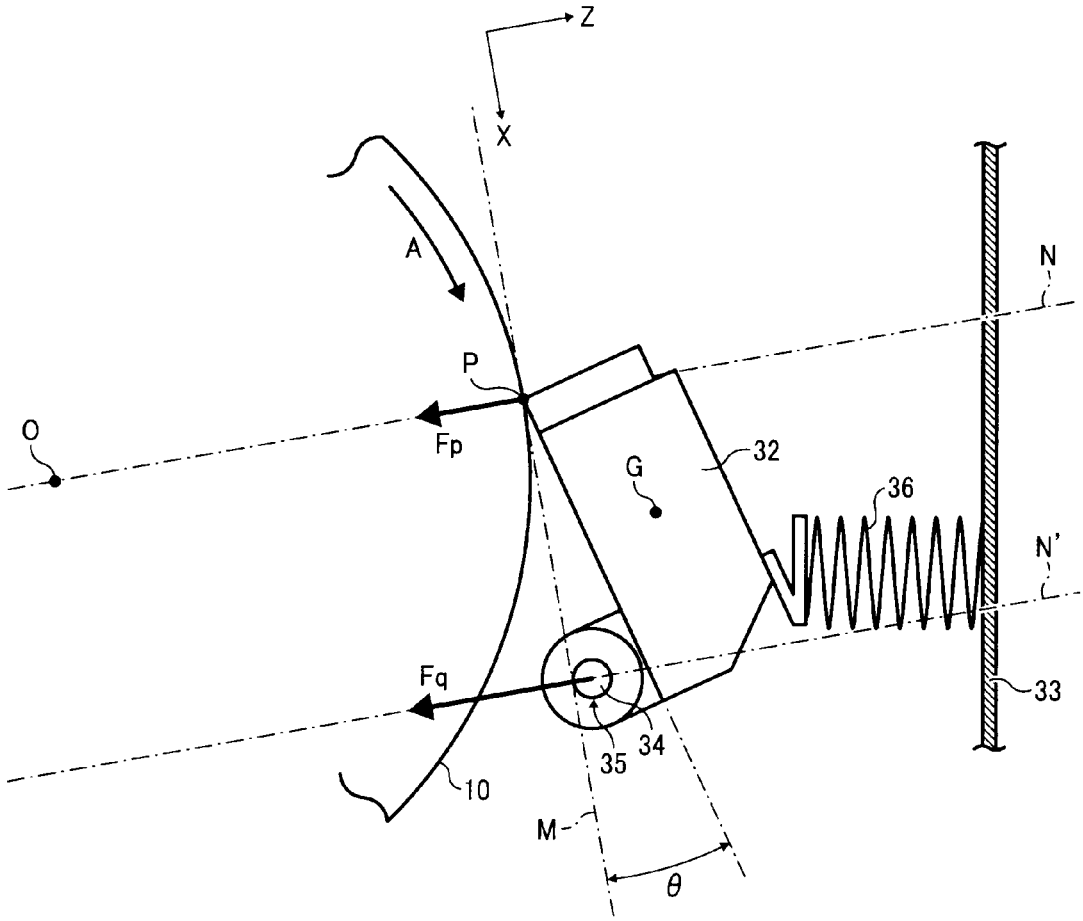
FIG. 13 is a diagram showing a configuration of the positional relationship of the gravity center G and the biasing position of the blade unit, which is different from the configuration of the cleaning device of the first embodiment.

FIG. 13 shows a configuration of the cleaning device 30 in which, unlike the cleaning device 30 of the present embodiment, the blade 31 is pressurized by the springs 36 in the surface moving direction downstream of the photoreceptor 10 away from the position of the gravity center G.

As shown in FIG. 13, when applying pressure to the blade 31 in the surface moving direction downstream of the photoreceptor 10 away from the position of the gravity center G, the relationship between the pressing force Fp applied by the blade 31 to the photoreceptor 10 at the abutting section P and the pressing force Fq applied by the spindle 34 of the blade holder 32 to the both bearing parts 35 is expressed as Fq>Fp. In this case, a straight line that connects two engagement parts between the both bearing parts 35 and the spindle 34 might be the reference line. In this case, because the state of abutment of the blade 31 is determined depending on the position of the spindle 34 in the both bearing parts 35, the presence of the abovementioned tolerance cannot allow the long side (abutting side) of the blade 31 contacting the surface of the photoreceptor 10 to evenly abut against the surface of the photoreceptor 10. In other words, the state of abutment between the blade unit and the device main body is determined by two points, i.e., two engagement parts between the both bearing parts 35 and the spindle 34, and one point, i.e., one end part of the abutting side of the blade 31. Therefore, uneven contact occurs between the abutting side of the blade 31 and the photoreceptor 10, and even load cannot be obtained in the longitudinal direction.

Figure 14B:
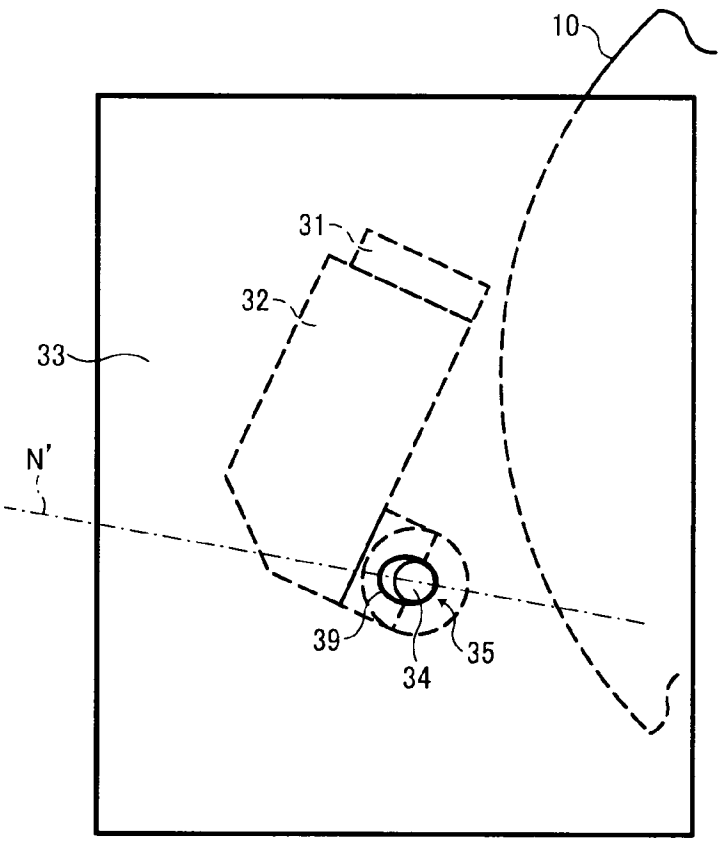
FIGS. 14A and 14B are diagrams for explaining an example of a state of engagement between the elongated hole and the spindle of the bearing part of the cleaning device shown in FIG. 13.
Figure 14A:
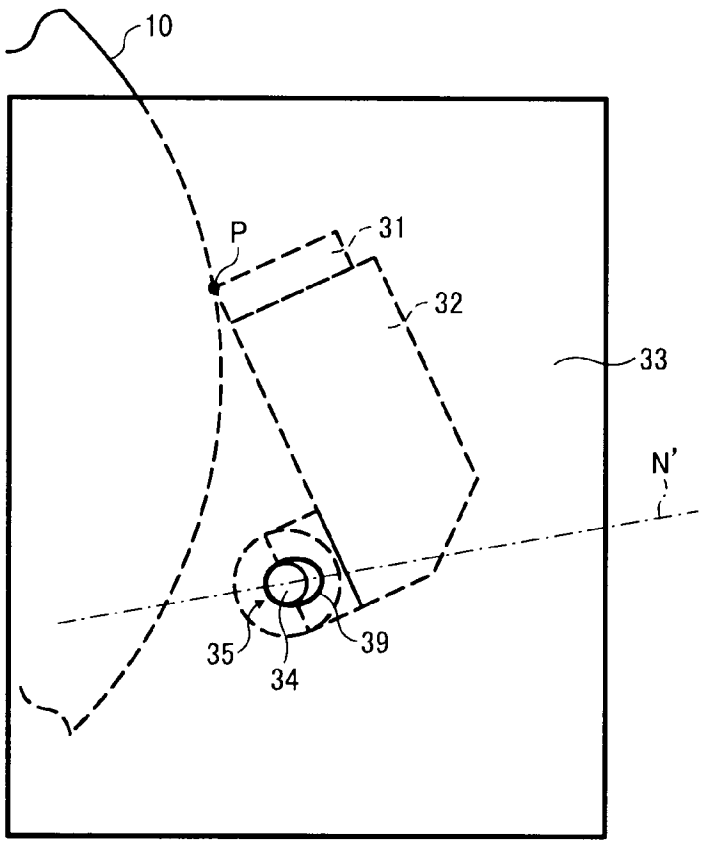

FIGS. 14A and 14B show an example of a state of contact between the blade 31 of the cleaning device 30 shown in FIG. 13 and the photoreceptor 10, as well as a state of engagement between the long hole 39 of the bearing part 35 and the spindle 34. FIG. 14A is a diagram in which the vicinity of an end part of the blade 31 on the near side of FIG. 13 is viewed in the same direction as the direction shown in FIG. 13, and FIG. 14B a diagram in which the vicinity of an end part of the blade 31 on the far side of FIG. 13 is viewed from a direction opposite to that of the page of FIG. 13. As shown in FIG. 14A, while one end of the abutting side of the blade (near side of FIG. 13) abuts against the photoreceptor 10 at the abutting section P, in some cases the other end (far side of FIG. 13B) does not abut against the photoreceptor 10, as shown in FIG. 14B. Furthermore, because the pressing force Fq applied by the spindle 34 to the both bearing parts 35 is greater than the pressing force Fp applied by the blade 31 to the photoreceptor 10, the spindle 34 and the both bearing parts 35 are engaged with each other in the same position in the direction of the long axis of the long hole 39.

In this cleaning blade having a free length of substantially zero to regulate the warpage of the blade 31, it is effective to provide a certain degree of freedom to the engagement section between the frame body 33 and the blade holder 32 in order to bring the abutting side of the blade 31 into even abutment against the photoreceptor in the longitudinal direction. However, it is necessary that the pressing force Fp applied by the blade 31 to the photoreceptor 10 in the abutting section P between the blade 31 and the photoreceptor 10 be greater than the pressing force Fq applied by the spindle 34 to the bearing parts 35, and that the biasing means be provided in the position where the state of abutment is determined, with the long side (abutting side) of the blade 31 as the reference line.

Moreover, it is desired that the biasing means be disposed in the vicinity of the normal line N in the abutting section P or on the surface moving direction upstream side of the photoreceptor 10 with respect to the normal line N, in order to achieve the abovementioned uniform abutment.

Note that the cleaning device 30 of the present embodiment has the configuration in which the blade holder 32 is provided with the spindle 34 and the frame body 33 is provided with the bearing part 35. For a configuration in which the frame body 33 supports the blade holder 32, the blade holder 32 may be provided with the bearing part, and the frame body 33 may be provided with the spindle. In this case as well, the abutting section between the frame body 33 and the blade holder 32 can be provided with a certain degree of freedom.

In the cleaning device 30 of the present embodiment, one end of each spring 36 is connected to the blade holder 32, and the other end to an adjusting screw 37 functioning as biasing force adjustment means as shown in FIG. 4. This adjusting screw 37 is engaged with a screw hole provided in the frame body 33 of the cleaning device 30. When adjusting a pressing force using the adjusting screw 37, and adjusting rod is inserted from the outside of the frame body 33 of the cleaning device 30 through a cutout hole, and the adjusting screw 37 is rotated, whereby the length of the spring is adjusted. Adjustment of the pressing force is described hereinafter. Note that it is not necessary to provide the adjusting screw 37, and therefore an end part of the spring 36 may be attached to the frame body 33 directly.

Adjustment of the pressing force applied by the blade 31 to the surface of the photoreceptor 10 is now described.

Figure 15:
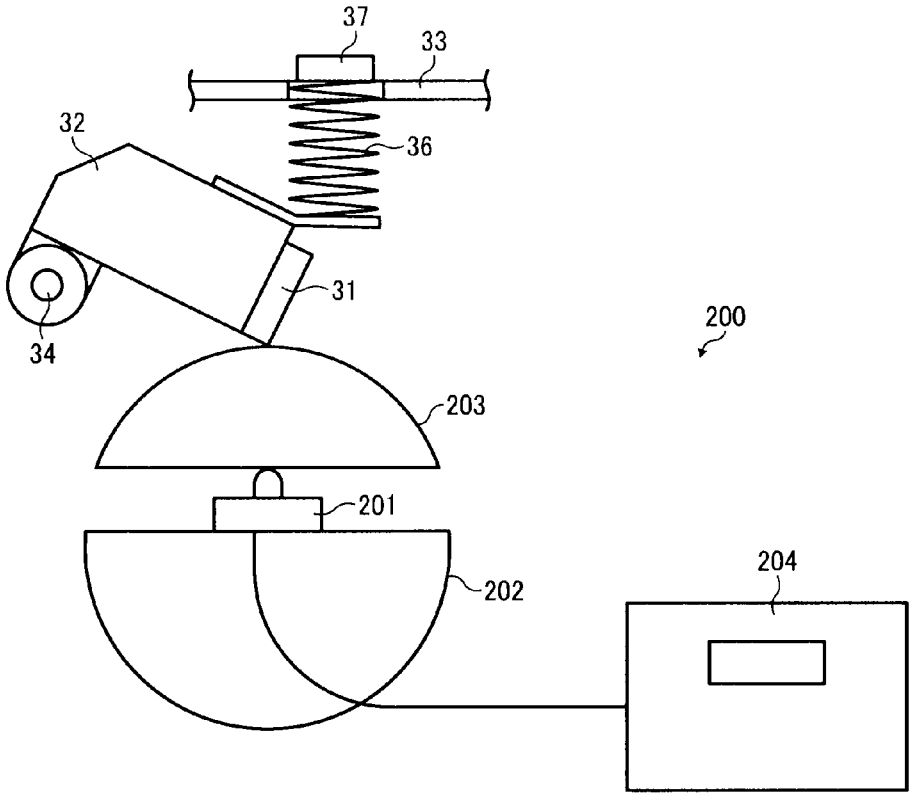
FIG. 15 is a diagram showing a configuration of a measurement device for measuring a pressing force of the blade provided in the cleaning device.

FIG. 15 shows a configuration of a measurement device 200 for measuring the pressing force of the blade 31. This measurement device 200 is actually a commercially available sensor conditioner "WGA-710B" (manufactured by Kyowa Electronic Instruments, Co., Ltd.) and a load cell "LMA-A-20N" (manufactured by Kyowa Electronic Instruments, Co., Ltd.) that can be combined. This measurement device 200 has three load cells 201, which are fixed to a total of three sections on a semi-cylindrical cell base 202, the three sections being a longitudinal direction central point of the blade 31 and two points that are away from the central point by 140 [mm] toward both ends in the longitudinal direction. A jig 203 that has a curved surface having the same curvature radius as the photoreceptor 10 is placed on each load cell 201. Three of this jig 203 are arranged along the longitudinal direction of the blade 31, and each load cell 201 is set on the center of a bottom surface of each of these jigs 203.

The blade 31 is set in the measurement device 200 such that the positional relationship between the blade 31 and the jig 203 is same as the positional relationship between the blade 31 and the photoreceptor 10.

When the pressing force applied by the blade 31 to the surface of the photoreceptor 10 is adjusted using the measurement device 200, the measurement device 200 shown in FIG. 15 is attached, in place of the photoreceptor 10, to the process cartridge 121 when the cleaning device 30 is assembled in the printer 100. More specifically, the cell bases 202 to which the three load cells are fixed and the three jigs 203 are attached to the process cartridge 121 by using a supporting part for supporting a drive shaft of the photoreceptor 10. In so doing, a virtual line connecting the abutting side of the blade 31 of the cleaning device 30 to the load cells 201 is made perpendicular to the bottom surface of each jig. Then, a load added through each jig 203 is detected by each load cell 201, and the adjusting screw 37 is adjusted to adjust the pressing force of the blade 31, while monitoring values displayed on a sensor conditioner 204 connected to the measurement device 200.

Needless to say, at the time of measurement, it is necessary to place a specified weight on each jig 203 beforehand, and the values displayed on the sensor conditioner 204 need to be equal to each other, or the values displayed on the sensor conditioner 204 need to be set at a value for canceling the load applied by each jig 203.

When the balance among the loads is adjusted so that the pressing force of the blade 31 becomes uniform throughout the longitudinal direction of the blade, in the present embodiment the adjusting screws 37 of two springs are rotated and adjusted such that the value of each load cell 201 displayed on the sensor conditioner 204 fluctuates within a range of ±10 [g].

When adjusting the pressing force of the blade 31, essentially the pressing force should be adjusted so that the pressure in abutment between the blade 31 and the surface of the photoreceptor 10 becomes a target value. However, because it is difficult to measure the abutment width (nip width) between the blade 31 and the surface of the photoreceptor 10, generally the pressing force is adjusted such that a linear pressure becomes the target value. Here, "linear pressure" means a force per unit length of a photoreceptor rotating shaft direction, which acts on the abutting part between the blade 31 and the surface of the photoreceptor 10. In a specific method for obtaining the linear pressure, the values of the load cells 201 displayed on the sensor conditioner 204 are added up, thus obtained total load is divided by a longitudinal direction length T3 of the blade 31, and the resultant value is obtained as the linear pressure [N/cm].

In the cleaning device 30 of the present embodiment, the adjustment is carried out such that the combined value (total load) of the values displayed on the sensor conditioner 204 becomes 26.0±0.29 [N], to obtain approximately the same amount of linear pressure as the linear pressure set in the conventional counter type cleaning device, that is, approximately 0.790 [N/cm]. As described above, the abutment width between the blade 31 and the surface of the photoreceptor 10 increases as the blade 31 warps significantly or as the blade itself deforms significantly.

In the cleaning device 30 of the present embodiment, the warpage of the blade 31 is restricted by the blade holder 32 as described above, and therefore the warpage of the blade 31 is smaller than the warpage of the blade of the conventional counter type cleaning device shown in FIG. 1B and is so small that the warpage is not noticeable. Therefore, in the cleaning device 30 of the present embodiment, the abutment width mainly depends only on elastic deformation (compression deformation) of the blade itself in the photoreceptor surface moving direction. Thus, in the cleaning device 30 of the present embodiment, the abutment width can be made smaller than that of the conventional counter type cleaning device shown in FIG. 1B. As a result, according to the present embodiment, abrasion of the photoreceptor 10 and the blade 31 can be prevented more effectively than the conventional counter type cleaning device 30.

Furthermore, a high contact pressure for cleaning the spherical toner is also applicable.

In addition, according to the cleaning device 30 of the present embodiment, the abutment width can be reduced as described above, and even when the blade 31 is pressed with approximately the same amount of linear pressure as that of the conventional counter type cleaning device, the abutment pressure is higher than that of the conventional counter type cleaning device. In other words, the pressing force of the blade 31 that is required to obtain approximately the same amount of abutment pressure as that of the conventional counter type cleaning device, the abutment pressure does not have to be greater than that of the conventional counter type cleaning device. The abutment width described in the present embodiment is predicted to be quite shorter than the abutment width obtained when the conventional counter type cleaning device is used. Therefore, based on this prediction, approximately the same amount of abutment pressure as that of the cleaning device can be realized with linear pressure that is significantly smaller than the linear pressure obtained in the conventional counter type cleaning device, and approximately the same level of removing performance can be exhibited. This fact is also effective in preventing the abrasion of the photoreceptor 10 and the blade 31.

Moreover, according to the cleaning device 30 of the present embodiment, the abutment pressure can be increased easily, compared to the conventional counter type cleaning device. Therefore, for the toner that has a spherical shape and small diameter that could not be removed in the conventional counter type cleaning device, sufficient removing performance can be achieved.

In recent years, low cost and high quality image of an MFP/LP (multi-function printer/laser printer) that uses the electrophotographic system, and high quality image (particularly graininess) can be achieved by reducing the particular diameter of toner. However, as described using FIGS. 1A and 1B, it is difficult for the conventional blade cleaner to clean the toner having small diameter and spherical shape, and the cost of the toner increases due to the various forms of processing carried out in the conventional blade cleaner. Therefore, a technology for cleaning the spherical toner needs to be established urgently, in order to achieve cost reduction and high quality image.

High abutment pressure (contact pressure) is generally required for cleaning the small-diameter/spherical toner using a blade. However, in the configuration of a conventional cleaning blade where the cleaning blade projects at a certain amount from the blade holder holding the cleaning blade and the cleaning blade and the blade holder are bonded to each other, high linear pressure distorts the cleaning blade and thereby significantly increases the contact width between the cleaning blade and a cleaned member, reducing the contact pressure and significantly degrading the cleaning property. For this reason, application of a high contact pressure is required.

As an example of such a configuration, there is considered a configuration of the cleaning device described in Prior Art 1 where the amount of projection of the cleaning blade from the blade holder is set at substantially zero. By setting the amount of projection at substantially zero, cleaning blade is not distorted but deformed slightly in the abutting section, even when a high force is applied to the cleaning blade. Therefore, the contact area between the cleaning blade and the cleaned member does not increase, and a high contact pressure can be applied. As a result, the cleaning property can be maintained.

However, the following disadvantages can be considered. By setting the amount of projection of the cleaning blade from the blade holder at substantially zero, the degree of freedom of a cleaning blade tip end is reduced. Thus, when the part accuracy and assembly accuracy of the cleaning device or the cleaned member are poor, the disadvantage is that the cleaning blade cannot be deformed due to the reduced degree of freedom of the cleaning blade tip end, and that the cleaning blade cannot be brought into uniform abutment against the cleaned member in the longitudinal direction.

In order to cope with such problems, the abovementioned previous application proposes a cleaning device that has a blade holder holding mechanism that absorbs and corrects a shift of the positional relationship. However, even in the cleaning device proposed by this application, which has a mechanism for absorbing and correcting the shift, in some cases the cleaning blade cannot be brought into uniform abutment against the cleaned member in the longitudinal direction.

In the cleaning device 30 of the present embodiment, because the free length of the blade 31 is substantially zero with respect to the blade holder 32, warpage of the blade 31 is restricted when the blade 31 is brought into press-contact with the photoreceptor 10. This is advantageous in terms of the cleaning property, because the excessive increase of the contact area between the blade 31 and the photoreceptor 10 is prevented and the high contact pressure can be maintained. When the part accuracy and assembly accuracy are poor, the blade 31 hardly deforms, and it is difficult to apply a uniform pressure to the longitudinal direction of the photoreceptor 10, due to a small degree of freedom in the shape of the abutting section of the blade 31. Therefore, a gap is provided between the spindle 34 provided in the blade holder 32 and the bearing part 35 provided in the device main body, such that the blade 31 follows the longitudinal direction of the photoreceptor 10. Furthermore, the engagement part between the spindle 34 and the bearing part 35 does not serve as the reference line to determine the position of abutment of the abutting side of the blade 31, but the abutting side of the blade 31 serves as the reference line to determine the position of abutment between the blade 31 and the photoreceptor 10, whereby the abutting side of the blade 31 can be brought into uniform abutment against the longitudinal direction of the photoreceptor 10. As a result, the cleaning property improves, and the abrasion resistance of the blade and surface moving member improves by reducing unnecessary pressure.

In the present embodiment, the blade 31 is a rectangular solid-shaped member that is long in the rotating shaft direction (Y direction) of the photoreceptor 10. As shown in FIGS. 4 and 5, lengths T1, T2, which extend in a direction perpendicular to the abutting sides of the two surfaces 31*a*, 31*b* that are adjacent to each other with the abutting side therebetween, are set such that the length T1 of the upstream side surface 31*a* positioned on the photoreceptor surface moving direction upstream side is longer than the length T2 of the downstream side surface 31*b* positioned on the photoreceptor surface moving direction downstream side. Note that the blade 31 is formed to have the two surfaces 31*a*, 31*b* adjacent to each other with the abutting side therebetween, and the shape of the blade 31 may have not only such a rectangular solid shape but also a any three-dimensional shape, as long as an object adhering to the surface of the photoreceptor 10 can be removed sufficiently throughout the rotating shaft direction of the photoreceptor 10. Note that each outer circumferential surface of the blade 31 is not necessarily flat and may have a curved surface.

The longer the length of the blade in a direction of compression deformation (compression direction length) when the photoreceptor 10 moves on the surface, the lower the elastic deformation amount of the blade. The compression direction length of the blade 31 is approximately equivalent to the photoreceptor surface moving direction length T2 of the downstream side surface 31*b* of the blade 31. When comparing T2 of the present embodiment with T2 of the conventional counter type cleaning device shown in FIG. 1B, T2 of the present embodiment is far shorter than that of the conventional counter type cleaning device. Therefore, when comparing the elastic deformation amount alone, the elastic deformation amount of the cleaning device 30 of the present embodiment is smaller than that of the conventional counter type cleaning device. It is clear from this fact that the abutment width in the cleaning device 30 of the present embodiment is shorter than that of the conventional counter type cleaning device.

In addition, the present embodiment uses the blade 31 having a rectangular solid shape. It is preferred that the relationship in size among the lengths T1, T2 and T3 of the sides of the rectangular solid-shaped blade 31 satisfy a relationship of T3>T1≧T2. It is more preferred that T2 be equal to or greater than 1 [mm], which is ½ of T1 or lower.

Note that the lengths of the sides of the blade 31 of the present embodiment are such that T1=12 [mm], T2=2 [mm], and T3=325 [mm], but are not limited thereto.

The material of the blade holder 32 will be described next.

As the blade holder 32 of the present embodiment, the one that is made of a metallic material having iron as the main component is used. The blade holder 32 has sufficient rigidity so as to be able to sufficiently prevent itself from being distorted even when the blade 31 receives a force from the photoreceptor 10 during the rotary drive of the photoreceptor 10. Note that the material of the blade holder 32 is not limited to the abovementioned material, and any material can be used as long as it has sufficient rigidity to sufficiently prevent the blade holder 32 from being distorted even when the blade 31 receives a force from the photoreceptor 10.

In the present embodiment, the blade 31 is pressed against the surface of the photoreceptor 10, so that, when the blade 31 is not pressed against the surface of the photoreceptor 10, the angle θ formed by a surface moving direction upstream side section of the photoreceptor 10 in the downstream side surface 31*b* of the blade 31 and a surface moving direction downstream side section of the tangential line N of the abutting section P on the surface of the photoreceptor 10 (to be referred to as "abutment angle" hereinafter) is approximately 15 [°] (see FIG. 4). Note that the abutment angle θ is appropriately set to fall within a range of 5[°] to 50 [°]. It is difficult to set the abutment angle θ at 5 [°] or lower, in terms of the arrangement layout around the photoreceptor 10, and the possibility that sufficient removing performance may not be achieved increases if the abutment angle θ is greater than 50 [°]. It is more preferred that the abutment angle θ be set within a range of 7 [°] to 40 [°].

In the present embodiment, the surface facing the upstream side surface 31*a* of the blade 31 is entirely fixed to the holder upstream side surface 32*b* of the blade holder 32, as shown in FIG. 6. The present embodiment employs, as the fixing method, a bonding method that uses an adhesive, but a method that uses a double-sided adhesive tape, a hot-melt method, or other fixing method may be employed. Because the surface 31*c* facing the upstream side surface 31*a* of the blade 31 is entirely fixed to the holder upstream side surface 32*b* of the blade holder 32, and because the blade holder 32 is sufficiently rigid as described above, in the present embodiment warpage of the blade 31 does not occur substantially, even when the blade 31 is pressed against the surface of the photoreceptor 10 and at the same time the photoreceptor 10 is rotated and driven.

Because the blade 31 does not warp substantially, the following effects can be obtained. Specifically, robustness to the environmental variations improves. More specifically, in the configuration where the cleaning blade warps when the free length of the cleaning blade is long, the force generated by the warpage of the cleaning blade is changed by temperature and humidity. For example, plastic deformation occurs when the warped cleaning blade is left along under a high-temperature and high-humidity environment, causing a phenomenon called "flattening." As a result, the abutment pressure between the surface of the photoreceptor 10 and the cleaning blade decreases, and the cleaning property also decreases, causing a cleaning failure. Therefore, in the present embodiment in which the blade 31 functioning as the cleaning blade does not warp substantially, the robustness to the environmental variations can be improved.

When the cleaning blade warps, it means that the cleaning blade has a degree of freedom enough to make warpage. If the degree of freedom of the cleaning blade is large, in the case of the counter type cleaning device, a serious problem such as blade buckling occurs easily when the frictional force between the cleaning blade and the photoreceptor increases. According to the present embodiment where the blade 31 functioning as the cleaning blade does not warp substantially, blade buckling can be prevented from occurring.

Moreover, the starting torque of the photoreceptor can be reduced. More specifically, when the cleaning blade warps, it means that the cleaning blade has a degree of freedom enough to make warpage, as described above. Because the frictional force is large when the photoreceptor starts driving, a large degree of freedom of the blade causes significant deformation instantly, thereby increasing the torque. According to the present embodiment where the blade 31 functioning as the cleaning blade does not warp substantially, the torque increase caused when the photoreceptor 10 starts driving can be reduced.

According to the present embodiment, in the position for attaching the blade 31 to the blade holder 32, the downstream side surface 31*b* of the blade 31 and the holder-photoreceptor facing surface 32*c* where the blade holder 32 faces the photoreceptor 10 are fixed without having any steps. The blade 31 does not project toward the photoreceptor 10 side. Also, the section forming the holder upstream side surface 32*b* of the blade holder 32 does not project toward the photoreceptor 10 side, as shown in FIG. 4. The position of attachment is not limited to this position, and, naturally, significant warpage of the blade 31 does not occur even when, for example, the holder photoreceptor facing surface 32*c* of the blade holder 32 projects toward the surface of the photoreceptor 10 rather than toward the downstream side surface 31*b* of the blade 31.

If the blade 31 can be prevented from warping, the downstream side surface 31*b* of the blade 31 can be caused to project toward the photoreceptor 10 side more than the holder photoreceptor facing surface 32*c*. In this case, the acceptable level for allowing the downstream side surface 31*b* of the blade 31 to project with respect to the holder photoreceptor facing surface 32*c* in the section forming the holder upstream side surface 32*b* of the blade holder 32 is determined based on the hardness of the blade 31 and the frictional coefficient of the friction between the blade 31 and the surface of the photoreceptor 10. This acceptable level can be used as a measure for determining the range where the surface moving direction length (abutment width) of the photoreceptor 10 in the abutting section P becomes 50 [μm] or lower when, for example, the blade 31 is pressed against the surface of the photoreceptor 10 to obtain a linear pressure of 0.790 [N/cm]. The distance between an end part of the section forming the holder upstream side surface 32*b* of the blade holder 32 and the boundary side of the blade 31 is estimated to be approximately ¼ of the length T2 of the downstream side surface 31*b* of the blade 31. If checked more specifically, it is approximately ½ or equal to T2.

In the cleaning device 30 of the present embodiment, the adhesive is applied to the entire adhesion surface of the blade 31, and the blade 31 is adhered to the holder upstream side surface 32*b* of the blade holder 32. However, the adhesive may be applied to a part of the adhesion surface of the blade 31 to adhere the blade 31 to the holder upstream side surface 32*b* of the blade holder 32. However, in the area where the holder upstream side surface 32*b* of the blade holder 32 overlaps with the surface 31*c* (adhesion surface) of the upstream side surface 31*a* of the blade 31, at least an end part area near the surface of the photoreceptor 10 is preferably subjected to fixing processing. In this end part area, by fixing the holder upstream side surface 32*b* of the blade holder 32 to the blade 31 securely, the blade 31 can be prevented from being unstable, even when the frictional force between the blade 31 and the surface of the photoreceptor 10 changes for some reason during the rotary drive of the photoreceptor 10. The same is true for other fixing methods.

The toner used in the printer 100 of the present invention will be described next.

The cleaning device 30 of the present embodiment can realize high removing performance, and therefore can be utilized for removing a toner that has an average circularity degree of at least 0.940, or 0.960 or more but 0.998 or less. Moreover, the effects of the present invention can be sufficiently exhibited by removing a toner having an average circularity degree of 0.96 or more and 0.998 or less.

The toner that has such average circularity degree can be obtained by performing thermal or mechanical performing spheronization processing on a dry-milled toner. When performing the thermal spheronization processing, for example, toner particles are sprayed along with a thermal current into atomizer. When performing the mechanical spheronization processing, toner particles are through into a ball mill or other mixing machine along with glass or other mixed medium having light density, and the mixture is stirred. However, in the thermal spheronization processing, toner particles are agglutinated into large-diameter toner particles. In the mechanical spheronization processing, fine powder is generated, and thus a classification step needs to be carried out again. Moreover, for a toner produced in an aqueous solvent, the shape of toner particles can be controlled by strongly stirring the toner in a step of removing the solvent.

The circularity degree of the toner is a value obtained by optically detecting the particles and dividing the circumferential length of each particle by the circumferential length of an equivalent circle having the same projected area. Specifically, the measurement is carried out using a flow type particle image analyzer "FPIA-2000" (manufactured by Sysmex Corporation). One hundred to 150 [mL] of water with no impurity solid substances is poured into a predetermined container, and 0.1 to 0.5 [mL] of surfactant is added thereto as a dispersant, and thereafter approximately 0.1 to 9.5 [g] of measurement sample is added thereto. A suspending solution dispersed with a sample is subjected to dispersion processing in a ultrasonic dispersion container for approximately 1 to 3 minutes to obtain a dispersion concentration of 3000 to 10000 [per μL], and the shape and distribution of the toner is measured. The circularity degree is defined such that circularity degree SR=(circumferential length of a circle having the same particle projected area/circumferential length of a particle projected image), and the higher the sphericity of the toner is, the closer the value is to "1."

The toner having a high circularity degree is susceptible to the effect of an electric line of force on the surface of the carrier or the developing roller 51, and is therefore developed faithfully along the electric line of force of an electrostatic latent image. Therefore, the toner can be disposed densely and evenly when realizing fine latent image dots, whereby thin-line reproducibility is enhanced.

Furthermore, the toner having a high circularity degree is susceptible to the effect of an electric line of force due to its smooth surface and appropriate flowability, and is easily transferred faithfully along the electric line of force, increasing the transfer rate. As a result, high-quality images can be obtained. Moreover, the primary transfer nip is formed by press-contacting the intermediate transfer belt 162 using the primary transfer roller 161, and the transfer electric field is formed by applying a transfer voltage of opposite polarity to the polarity of the toner images, to the primary transfer roller 161. When primarily transferring each toner image on the photoreceptor 10 onto the intermediate transfer belt 162 through these actions described above, the toner having a high circularity degree comes into uniform contact with the intermediate transfer belt 162, and the contact area of the toner becomes uniform, contributing to improving the transfer rate.

However, when the average circularity degree of the toner is less than 0.93, neither faithful development nor transfer with high transfer rate can be performed. This is because if the toner is amorphous, the toner surface cannot be charged evenly and the gravity center and the central part to be charged become out of alignment, whereby it is difficult to faithfully move the toner to the electric field.

Furthermore, when the volume average particle diameter of the toner is small, the thin-line reproducibility can be improved. Therefore, it is preferred to use toner that has a volume average particle diameter of at most 7 [μm]. However, it is preferred that the volume average particle diameter of the toner be at least 3 [μm], because the smaller the particle diameter, the lower the development characteristics.

In addition, if the volume average particle diameter of the toner is less than 3 [μm], the amount of small-diameter toner that cannot be easily developed on the surface of the carrier or developing roller 51 is increased. Consequently, sufficient friction/contact cannot be obtained between the other toner and the carrier or the developing roller, increasing the amount of reversely chargeable toner and causing abnormal images with photographic fog or the like.

In the cleaning device 30 of the present embodiment, sufficient removing performance can be exhibited with a volume average particle diameter of 2 [μm] or more, and particularly more favorable removing performance can be achieved with a volume average particle diameter of 3 [μm] or more. It is preferred that the ratio between the volume average particle diameter Dv and the number average particle diameter Dn be approximately 1.0 to 1.4.

The volume average particle diameter of the toner is measured in the manner described below.

First, 0.1 to 5 [mL] of surfactant (preferably alkyl benzene sulfonate) is added as a dispersant into 100 to 150 [mL] of electrolysis solution. Here, the electrolysis solution was obtained by preparing approximately 1% of NaCl solution using primary sodium chloride, wherein ISOTON R-II type (manufactured by Coulter Scientific Japan, Co., Ltd.) was used. Further, 2 to 20 [mg] of measurement sample was added thereto, suspended in the electrolysis solution, and subjected to dispersion processing ultrasonic dispersion container for approximately 1 to 3 minutes. By using the abovementioned measurement device, a 100-μm aperture was used as an aperture to measure the volume and number of the toner particles within the sample, and volume distribution and number distribution of the toner were calculated.

As the channels, thirteen channels were used: 2.00 to 2.52 [μm]; 2.52 to 3.17 [μm]; 3.17 to 4.00 [μm]; 4.00 to 5.04 [μm]; 5.04 to 6.35 [μm]; 6.35 to 8.00 [μm]; 8.00 to 10.08 [μm]; 10.08 to 12.70 [μm]; 12.70 to 16.00 [μm]; 16.00 to 20.20 [μm]; 20.20 to 25.40 [μm]; 25.40 to 32.00 [μm]; and 32.00 to 40.30 [μm].

To satisfy the average circularity degree described above, it is preferred that the shape factor SF-1 of the toner fall within the range of 100 to 160, and that the shape factor SF-2 fall within the range of 100 to 160.

Figure 16A:
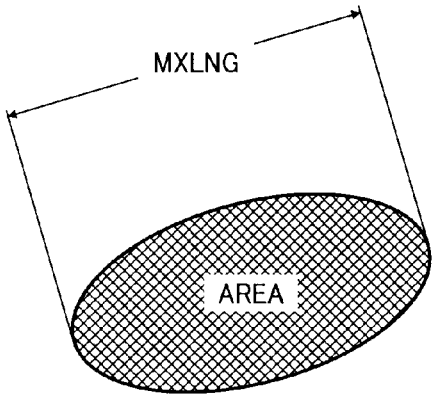
FIGS. 16A and 16B are diagrams schematically showing the shape of toner.
Figure 16B:
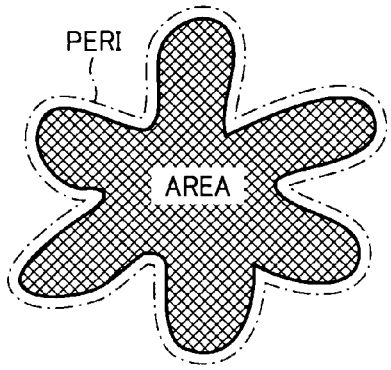

FIGS. 16A and 16B are diagrams that schematically showing the shapes of the toner. FIG. 16A is a diagram for illustrating the shape factor SF-1, and FIG. 16B a diagram for illustrating the shape factor SF-2.

The shape factor SF-1 shows the ratio of the roundness of the toner shape and is displayed in the following equation (1). The shape factor SF-1 is obtained as follows: the square of the maximum length MXLNG of the shape obtained by projecting the toner onto a two-dimensional plane surface is divided by a figure area AREA, and thus obtained value is multiplied by $100\pi/4$. When the value of the SF-1 is 100, the shape of the toner is a sphere. The greater the value of the SF-1, and the more amorphous the toner shape becomes.

$$\text{SF-1}=\{(\text{MXLNG})^2/\text{AREA}\}\times(100\pi/4) \quad (1)$$

Furthermore, the shape factor SF-2 shows the ratio of irregularity of the toner shape and is displayed in the following equation (2). The shape factor SF-2 is obtained as follows: the square of the circumferential length PERI of a figure obtained by projecting the toner onto a two-dimensional plane surface is divided by the figure area AREA, and thus obtained value is multiplied by $100\pi/4$. When the value of the SF-2 is 100, the surface of the toner has no irregularity, and the greater the value of the SF-2, the more significant the irregularity on the toner surface becomes.

$$\text{SF-2}=\{(\text{PERI})^2/\text{AREA}\}\times(100\pi/4) \quad (2)$$

When measuring the shape factors, specifically, a picture of the toner was taken using an electron scanning microscope (S-800: manufactured by Hitachi, Ltd.), and the picture was introduced to and analyzed by an image analyzer (LUSEX3: manufactured by Nireco Corporation) to calculate the shape factors.

When the shape of the toner becomes almost a sphere, point contact is made between toner particles, whereby the adhesion force between the toner particles becomes weak. As a result, the flowability increases. In addition, the adhesion force between the toner and the photoreceptor 10 becomes weak, and the transfer rate increases, whereby the residual toner on the surface of the photoreceptor 10 can be cleaned easily. When the SF-1 and SF-2 increase, the shape of the toner becomes amorphous, and toner charge amount distribution increases. Consequently, development to the latent image cannot be performed faithfully, and the image cannot be transferred faithfully to the transfer electric field, reducing the image quality. For this reason, it is preferred that the SF-1 and SF-2 should not exceed 180.

As the toner that is in a rough spherical shape as described above, it is preferred to use a toner that is obtained cross-linking and/or extending a toner composition that contains polyester prepolymer having a functional group containing nitrogen atom, polyester, colorant, and mold release agent, in an aqueous medium under the presence of resin fine particles. In a conventional method for preparing pulverized toner, the toner cannot be produced when compared to any of the values of the circularity degree, average particle diameter, and shape factors SF-1 and SF-2, or use of toners obtained by a polymerization method is advantageous in terms of the production cost and yield.

However, even in the toners obtained by the polymerization method, it is difficult to form the toner obtained by a suspension polymerization method or emulsion polymerization method into a perfect sphere based on the circularity degree and the shape factors SF-1, SF-2. Particularly, although the toner obtained by a dissolution suspension method is has a spherical shape, this toner is an amorphous toner, and therefore a satisfactory image quality cannot be obtained.

Next will be described the detail of constituent materials of the toner that are obtained by cross-linking and/or extending a toner composition that contains polyester prepolymer having a functional group containing nitrogen atom, polyester, colorant, and mold release agent, in an aqueous medium under the presence of resin fine particles, as well as a favorable method for producing the constituent materials.

(Polyester)

The polyester is obtained through a polycondensation reaction between a polyalcohol compound and a polycarboxylic acid compound.

Examples of the polyalcohol compound (PO) include dihydroxy alcohol (DIO) and trihydric or higher alcohol (TO), and the (DIO) alone or a mixture of the (DIO) and a little bit of (TO) is preferred.

As the dihydroxy alcohol (DIO), it is preferred to use alkylene glycol with 2 to 12 carbons, and a bisphenol alkylene oxide adduct, and it is particularly preferred to use a bisphenol alkylene oxide adduct and a combination of this and alkylene glycol having 2 to 12 carbons.

Examples of the trihydric or higher alcohol (TO) include tri- to octa-valent poly-aliphatic alcohol (glycerin, trimethylolethane, trimethylolprolane, pentaerythritol, sorbitol, and the like); trihydric or higher phenols (trisphenol PA, phenol novolac, cresol novolac, and the like); alkylene oxide adduct of the abovementioned trihydric or higher polyphenols.

Examples of the polycarboxylic acid (PC) include dicarboxylic acid (DIC) and trivalent or higher polycarboxylic acid (TC), and the (DIC) alone or a mixture of the (DIC) and a little bit of (TC) is preferred. The dicarboxylic acid (DIC) is alkenylene dicarboxylic acid having 4 to 20 carbons and aromatic dicarboxylic acid having 8 to 20 carbons. Examples of the trivalent or higher polycarboxylic acid (TC) include aromatic polycarboxylic acid having 9 to 20 carbons (such as trimellitic acid and pyromellic acid).

Normally, the ratio between the polyalcohol (PO) and polycarboxylic acid (PC) is preferably 2/1 to 1/1, more preferably 1.5/1 to 1/1, and even more preferably 1.3/1 to 1.02/1, based on the equivalent ratio between a hydroxyl group [OH] and a carboxyl group [COOH] ([OH]/[COOH]).

In the polycondensation reaction between the polyalcohol (PO) and polycarboxylic acid (PC), they are heated to 150 to 280 [° C.] under the presence of a known esterification catalyst such as tetra butoxy titanate and dibutyltin oxide, and then water to be generated is distilled while reducing the pressure according to need, to obtain hydroxyl polyester.

In addition to the native polyester that is obtained through the abovementioned polycondensation reaction, the polyesters described above preferably include urea-bonded polyester. The urea-bonded polyester is obtained by reacting the carboxyl or hydroxyl group of the terminal of the polyester obtained through the polycondensation reaction, and a polyisocynate compound (PIC), to obtain a polyester prepolymer (A) having an isocyanate group, and then cross-linking and/or extending a molecular chain by means of a reaction between the polyester prepolymer and amines.

Examples of the polyisocyanate compound (PIC) include the one obtained by blocking aliphatic poly isocyanate, alicyclic poly isocyanate, aromatic diisocyanate, aromatic aliphatic diisocyanate, isocyanates, and polyisocyanate by means of phenol derivative, oxime, and caprolactam; and a combination of two or more of these.

The ratio of the polyisocyanate compound (PIC) is preferably 5/1 to 1/1, more preferably 4/1 to 1.2/1, and even more preferably 2.5/1 to 1.5/1, based on the equivalent ratio between an isocyanate group [NCO] and a hydroxyl group [OH] of polyester having a hydroxyl group ([NCO]/[OH]).

The content of the constituent component of the polyisocianate compound (PIC) within the polyester prepolymer (A) having an isocyanate group is normally 0.5 to 40 [wt %], preferably 1 to 30 [wt %], and more preferably 2 to 20 [wt %].

The number of the isocyanate group contained in one molecule within the polyester prepolymer (A) having an isocyanate group is normally one or more, preferably an average of 1.5 to 3, and more preferably an average of 1.8 to 2.5.

Next, examples of the amines (B) reacted with the polyester prepolymer (A) include a bivalent amine compound (B1), trivalent or higher amine compound (B2), amino alcohol (B3), amino mercaptan (B4), amino acid (B5), and the one obtained by blocking the B1 to B5 amino groups (B6).

Examples of the bivalent amine compound (B1) include aromatic diamine, alicyclic diamine, and aliphatic diamine. Examples of trivalent or higher amine compound (B2) include diethylene triamine and triethylene tetramine. Examples of amino alcohol (B3) include ethanolamine and hydroxyethyl aniline. Examples of amino mercaptan (B4) include amino ethyl mercaptan and amino propyl mercaptan. The B1 and a mixture of B1 and a little bit of B2 are preferred out of these amines (B).

The ratio of the amines (B) is normally 1/2 to 2/1, preferably 1.5/1 to 1/1.5, and more preferably 1.2/1 to 1/1.2, based on the equivalent ratio between the isocyanate group [NCO] of the polyester prepolymer (A) having an isocyanate group and the amino group [NHx] of the amines (B) ([NCO]/[NHx]).

The urea-bonded polyester is manufactured by a one-shot method or the like. Polyester having a hydroxyl group is obtained by heating the polyalcohol (PO) and polycarboxylic acid (PC) to 150 to 280 [° C.] under the presence of a known esterification catalyst such as tetra butoxy titanate and dibutyltin oxide, and then water to be generated is distilled while reducing the pressure according to need.

Next, the polyisocyanate (PIC) is reacted therewith at 40 to 140 [° C.], to obtain polyester prepolymer (A) having an isocyanate group. Further, the amines (B) are reacted with (A) at 0 to 140 [° C.] to obtain the urea-bonded polyester.

When reacting the (PIC), and when reacting the (A) and (B), a solvent can be used according to need. Examples of an available solvent include an aromatic solvent, ketones, esters, or other solvent that is inactive with the isocyanate (PIC).

Moreover, when cross-linking and/or extending the polyester prepolymer (A) and amines (B), a reaction terminator can be used according to need, to adjust the molecular weight of the obtained urea-bonded polyester. Examples of the reaction terminator include monoamine (e.g., diethylamine, dibutylamine, butylamine, lauryl amine), and a ketimine compound that blocks these reaction terminator.

The weight-average molecular weight of the urea-bonded polyester is normally at least 10,000, preferably 20,000 to 10,000,000, and more preferably 30,000 to 1000,000. The number average molecular weight of the urea-bonded polyester and the like is not particularly limited when the native polyester, and thus may be a number average molecular weight with which the abovementioned weight-average molecular weight can be obtained. When using the urea-bonded polyester alone, the number average molecular weight thereof is normally 2000 to 15,000, preferably 2000 to 10,000, and more preferably 2000 to 8000.

The weight ratio between the native polyester and the urea-bonded polyester is normally 20/80 to 95/5, preferably 70/30 to 95/5, and more preferably 75/25 to 95/5, and particularly preferably 80/20 to 93/7. The glass-transition point (Tg) of a binder resin containing the native polyester and urea-bonded polyester is normally 45 to 65 [° C.], and preferably 45 to 60 [° C.]

(Colorant)

As the colorant, the following things can be used: carbon black; nigrosine dye; naphthol yellow S; cadmium yellow; yellow iron oxide; chrome yellow; minium; red lead; cadmium red; resol fast scarlet G; benzidine orange; oil orange; cobalt blue; cerulean blue; alkali blue lake; fast sky blue; indigo; ultramarine blue; iron blue; manganese purple; dioxane violet; chrome green; viridian; emerald green; pigment green B; phthalocyanine green; and a mixture thereof. The content of the colorant is normally 1 to 15 [wt %] or preferably 3 to 10 [wt %] with respect to the toner.

A master batch combined with a resin can also be used as the colorant. Examples of the binder resin that is produced or kneaded along with the master batch include a styrene, such as polystyrene, poly-p-chlorostyrene, or polyvinyltoluene, and a polymer of a substation product of the styrene, copolymer of the styrene and vinyl compound, polymethylmethacrylate, polyvinyl acetate, polyethylene, polypropylene, polyester, epoxy resin, chlorinated paraffin, paraffin wax, and the like. The colorant can be used alone or mixed with other material.

(Charge Control Agent)

A known charging control agent can be used as the charge control agent, and examples thereof include a nigrosine dye, triphenylmethane, chrome-containing metal complex dye, single substance or compound of phosphorus, single substance or compound of tungsten, fluorochemical surfactant, salicylic acid metallic salt, and metallic salt of salicylic derivative, and the like. Specifically, bontron 03 of a nigrosine dye, E-84 of salicylic metallic complex, E-89 of phenol condensate (all manufactured by Orient Chemical Industries, Co., Ltd.), TP-302, TP-415 of quaternary ammonium salt molybdenum complex (all manufactured by Hodogaya Chemical, Co., Ltd.), copy charge PSY VP2038 of quaternary ammonium salt, copy blue PR, LRA-901 of triphenylmethane derivative, LR-147 which is boron complex (manufactured by Japan Carlit, Co., Ltd.), copper phthalocyanine, perylene, quinacridone, azo-based pigment, other sulfone acids, carboxyl group, and a polymer compound having a functional group such as quaternary ammonium salt. Out of these compounds, especially a substance that controls the toner to a negative electrode.

The usage of the charge control agent is determined based on the type of the binder resin, the presence/absence of an additive that is used if necessary, and a method for producing the toner, including a dispersion method, but is not primarily limited thereto. It is preferred that the usage of the charge control agent be within the range of 0.1 to 10 parts weight in relation to 100 parts weight of binder resin, or more preferably within the range of 0.2 to 5 parts weight.

(Mold Release Agent)

Wax having a low melting point of 50 to 120 [° C.] effectively works as the mold release agent while dispersing with the binder resin. Examples of the components of the wax include, as candles and waxes, carnauba wax, cotton wax, and other vegetable waxes, beeswax, lanolin, and other animal waxes, ozocerite, Cercine, or other mineral waxes, paraffin, microcrystallin, petrolatum, and other petroleum waxes.

In addition to these natural waxes, examples include Fischer-Tropsch wax, polyethylene wax, and other synthetic hydrocarbon waxes, ester, ketone, ether, and other synthetic waxes.

(External Additive)

Inorganic fine particles are favorably used as an external additive for assisting the flowability, developabilty, and chargeability of the toner particles.

The primary particle diameter of the inorganic fine particles is preferably $5\times10^{-3}$ to 2 [μm] or particularly $5\times10^{3}$ to 0.5 [μm].

Furthermore, the specific surface area based on the BET method is preferably 20 to 500 [$m^2/g$].

The use ratio of the inorganic fine particles is preferably 0.01 to 5 [wt %] of the toner, or particularly 0.01 to 2.0 [wt %].

Specific examples of the inorganic fine particles include silica, alumina, oxidized titanium, barium titanate, zinc oxide, calcium carbonate, silicon carbide, and silicon nitride. Above all, it is preferred to use hydrophobic silica fine particles and hydrophobic oxidized titanium together as a fluidity imparting agent.

(Toner Manufacturing Method)

Next, the method for manufacturing the toner is described in detail. A favorable method is described hereinafter, but the method is not limited thereto.

The colorant, negative polyester, polyester prepolymer having an isocianate group, and mold release agent are dispersed in an organic solvent to make a toner material solution. It is preferred that the organic solvent be volatile when the boiling point thereof is less than 100 [° C.], to realize simple removal after the formation of toner base particles. Specifically, it is possible to use one, two or more types of aromatic solvents such as toluene and xylene, and halogenated hydrocarbon such as methylene chloride, 1,2-dichloroethane, chloroform, and carbon tetrachloride. The usage of the organic solvent is normally 0 to 300 parts weight, preferably 0 to 100 parts weight, and more preferably 25 to 70 parts weight, in relation to 100 parts weight of polyester prepolymer.

The toner material solution is emulsified in the aqueous medium under the presence of a surfactant and resin fine particles. The aqueous medium may be water alone or contain an organic solvent, such as methanol or other alcohol, dimethylformamide, tetrahydrofuran, cellosolves, and lower ketone. The usage of the aqueous edium in relation to 100 parts weight of the toner material solution is normally 50 to 2000 parts weight, and preferably 100 to 1000 parts weight. If it is less than 50 parts weight, the dispersion state of the toner material solution becomes poor, and toner particles with a predetermined particle diameter cannot be obtained. It is not economical if the usage exceeds 20,000 parts weight.

In order to improve the dispersion within the aqueous medium, a dispersant, such as a surfactant or resin fine particles, is added properly. Examples of the surfactant include anionic surfactant, such as alkyl benzene sulfonate, alkylamine salt, amino alcohol fatty acid derivative, polyamine fatty acid derivative, quaternary ammonium salt cationic surfactant, such as alkly trimethyl ammonium salt. Moreover, by using a surfactant having a fluoro alkyl group, the effect thereof can be achieved with a small amount.

An existence substance can be used as the resin fine particles. Tricalcium phosphate, calcium carbonate, oxidized titanium, colloidal silica, hydroxyapatite, or other inorganic compound dispersant can be used. As a dispersant that can be used by combining the resin fine particles and the inorganic compound dispersant, dispersion droplets may be stabilized by using a micromolecular protective colloid. For example, the followings can be used: acids, such as acrylic acid, methacrylic acid, α-cyanoacrylic acid, α-cyanomethacrylic acid, itaconic acid, crotonic acid, fumaric acid, maleic acid, and maleic acid anhydride; and (meth) acrylic monomer containing a hydroxyl group, such as acrylic acid-β-hydroxyethyl, methacrylic acid-β-hydroxyethyl, acrylic acid-β-hydroxypropyl, methacrylic acid-β-hydroxypropyl, and acrylic acid-γ-hydroxypropyl.

The method of dispersion is not particularly limited, but low-speed shearing system, high-speed shearing system, friction type, high-pressure jet type, ultrasonic type, or other type of known disperser can be used. Above all, high-speed shearing type is preferred in order to make the particle diameter of a dispersion element be 2 to 20 [μm]. When a high-speed shearing disperser is used, the number of revolutions is not particularly limited but is normally 1000 to 30,000 [rpm] and preferably 5000 to 20,000 [rpm]. The dispersion time is not particularly limited but normally 0.1 to 5 minutes for a batch method. The temperature during dispersion is normally 0 to 150 [° C.] (when pressurized) and preferably 40 to 98 [° C.].

At the same time as preparation of an emulsified liquid, the amines (B) are added to react with the polyester prepolymer (A) having an isocyanate group. This reaction involves cross-linking and/or extension of the molecular chain. The reaction time is selected based on the reactive character between the isocyanate group structure of the polyester prepolymer (A) and the amines (B), but normally 10 minutes to 40 hours, and preferably 2 to 24 hours. The reaction temperature is normally 0 to 150 [° C.] and preferably 40 to 98 [° C.]. In addition, a known catalyst can be used according to need. Examples thereof include dibutyltin laurate and dioctyltin laurate.

Upon completion of the reaction, the organic solvent is removed from the emulsifying dispersion element (reactant), and then cleaning and drying are performed to obtain toner base particles. In order to remove the organic solvent, the temperature of the entire system is increased while stirring a laminar flow, and after a constant temperature area is stirred strongly, desolvation is performed to obtain substantially spherical toner base particles. Here, for example, the fusiform shape can be controlled from the complete spherical shape. Furthermore, the smooth morphology of the surface can also be controlled to obtain, for example, the shape of a pickled plum. Moreover, when calcium phosphate salt or other acid or a substance soluble to alkali is used as a dispersion stabilizer, the calcium phosphate salt is dissolved by the acid of the hydrochloric acid, and thereafter the obtained product is washed, whereby the calcium phosphate salt is removed from the toner base particles. The calcium phosphate salt can be removed by another operation by decomposing it using enzyme.

Before and after any of the steps of the cleaning step and the desolvation step, a step of leaving the emulsifying dispersant at a constant temperature for a constant amount of time and maturing the generated toner particles. As a result, toner particles with a desired particle diameter can be prepared. The temperature during the maturing step is preferably 25 to 50 [° C.], and the time is preferably 10 minutes to 23 hours.

The charge control agent is thrown into the toner base particles obtained in the manner described above, and thereafter the inorganic fine particles such as silica fine particles or oxidized titanium fine particles are externally added thereto, to obtain a toner.

A known method using a blender or the like is used to throw in the charge control agent and to externally add the inorganic fine particles.

As a result, a toner with a small particle diameter and sharp particle diameter distribution can be obtained easily.

The toner of the present embodiment is mixed with a magnetic carrier to obtain a two-component developer, but the toner can be used as a one-component magnetic toner that does not use a carrier, or a nonmagnetic toner.

As the magnetic carrier of the two-component developer, a conventionally known material such as ferrite powder, magnetite powder, or magnetic resin carrier each having a particle diameter of 20 to 200 [μm] can be used. Furthermore, examples of a covering material include amino resins, such as urea formaldehyde resin, melamine resin, benzoguanamine resin, urea resin, polyamide resin, and epoxy resin can be used. In addition, polyvinyl and polyvinylidene resin, such as acrylic resin, polymethyl methacrylate resin, polyacrylonitrile resin, polyvinyl acetate resin, polyvinyl alcohol resin, polyvinyl butyral resin, polycarbonate resin, polyethylene resin, and silicone resin can be used. Furthermore, conductive powder or the like may be included in the covering resin, according to need. As the conductive powder, metallic powder, carbon black, oxidized titanium, iodine oxide, zinc oxide or the like can be used.

Such conductive powder preferably has an average particle diameter of 1 [μm] or lower. When the average particle diameter exceeds 1 [μm], it becomes difficult to control the electric resistance.

In the present embodiment, spherical ferrite particles having an average particle diameter of approximately 50 [μm] were adopted as a core material, and an aminosilane coupling agent and silicone resin as coat material components were disposed in toluene. This dispersant and the core material were thrown into a coating device that is provided with a rotary base plate disc and stirring blades and carried out coating while forming a swirling flow, and then the dispersant was applied onto the core material. Thus obtained product was burnt in an electric furnace at 250 [° C.] for 2 hours to prepare a carrier particle coated with a silicone resin coating of an average thickness of 0.5 [μm]. Seven parts weight of toner shown in the following examples is evenly mixed into 100 parts weight of this carrier using a tabular mixer in which the container thereof is rolled around to perform stirring, and the mixture is charged evenly to obtain an initial developer.

Examples of the toner are described hereinafter.

Note that the toner of each example is prepared as follows, but the present invention is not limited thereto.

Note that "part" indicates parts weight.

[Toner 1]

(Synthesis of Resin Fine Particle Emulsion)

In a reaction container provided with a stirring rod and a thermometer, 683 parts of water, 11 parts of sodium salt of methacrylic acid ethylene oxide adduct sulfate ester (eleminol RS-30, manufactured by Sanyo Chemical Industries, Ltd.), 83 parts of styrene, 83 parts of methacrylic acid, 110 parts of butyl acrylate, and 1 part of ammonium persulfate were put in and stirred at a speed of 3800 rotations/minutes for 30 minutes, to obtain a white emulsion. This emulsion was heated to a temperature of 75 [° C.] inside the system and reacted for 4 hours. Moreover, 30 parts of 1% ammonium persulfate was added thereto, which was matured at 75 [° C.] for 6 hours to obtain a water-based dispersant fine particle dispersant 1 of vinyl resin (copolymer of sodium salt of styrene-methacrylate-butyl acrylate-methacrylic acid ethylene oxide adduct sulfate ester). The volume average particle diameter of the fine particle dispersant 1 measured by a laser diffraction/dispersion particle size distribution measurement device (LA-920: manufactured by Horiba, Ltd.) was 110 [nm]. Some of the fine particle dispersant 1 was dried and isolated from the resin part. The shape of the resin fine particles was a spherical shape. The Tg of the resin part is 58 [° C.], and the weight-average molecular weight was 130,000.

(Adjustment of Water Phase)

Water in an amount of 990 parts, 83 parts of [fine particle dispersant 1], 37 parts of 48.3%-solution of dodecyl diphenyl ether disulfonic acid sodium (eleminol MON-7, manufactured by Sanyo Chemical Industries, Ltd.), and 90 parts of acetic ether were mixed and stirred to obtain a lacteous fluid. This fluid is taken as a water phase 1.

(Synthesis of Low-molecular Polyester)

In a reaction container attached with a cooling pipe, stirrer, and nitrogen introducing pipe, 724 parts of bisphenol A ethylene oxide 2 mol adduct, and 276 parts of terephthalic acid were introduced, subjected to polycondensation under an ordinary pressure of 230 [° C.] for hours, and reacted under a low pressure of 10 to 15 [mmHg] for 5 hours to obtain a low-molecular polyester 1. The low-molecular polyester 1 had a number average molecular weight of 2300, a weight average molecular weight of 6700, a peak molecular weight of 3800, a Tg of 43 [° C.], and an acid number of 4.

(Synthesis Intermediate Polyester)

In a reaction container attached with a cooling pipe, stirrer, and nitrogen introducing pipe, 682 parts of bisphenol A ethylene oxide 2 mol adduct, 81 parts of bisphenol A propylene oxide 2 mol adduct, 283 parts of terephthalic acide, 22 parts of trimellic anhydride, and 2 parts dibutyltin oxide were introduced, reacted under an ordinary pressure of 230 [° C.] for 7 hours, and further reacted under a low pressure of 10 to 15 [mmHg] for 5 hours to obtain an intermediate polyester 1. The intermediate polyester 1 had a number average molecular weight of 2200, a weight average molecular weight of 9700, a peak molecular weight of 3000, a Tg of 54 [° C.], an acid number of 0.5, and a hydroxyl group number of 52. Next, in a reaction container attached with a cooling pipe, stirrer, and nitrogen introducing pipe, 410 parts of intermediate polyester, 89 parts of isophorone diisocyanate, and 500 parts of ethyl acetate were introduced, and reacted at 100 [° C.] for 5 hours to obtain a prepolymer 1. The prepolymer 1 had a free isocyanate weight % of 1.53 [%].

(Synthesis Ketimine)

In a reaction container provided with a stirring rod and thermometer, 170 parts of isophorone diamine and 75 parts of methyl ethyl ketone were introduced and reacted at [° C.] for 4 hours to obtain a ketimine compound 1. The amine number of the ketimine compound 1 was 417.

(Synthesis Master Batch)

Water in an amount of 1200 parts, 540 parts of carbon black (Printex 35, manufactured by Evonik Industries) (DBP oil absorption=42 [ml]/100 [mg], pH=9.5), and 1200 parts of polyester resin were added and mixed together using a Henschel mixer (manufactured by Mitsui Mining Co., Ltd.). Thus obtained mixture was kneaded at 130 [° C.] for 1 hour by using two rolls, pressure-extended and cooled, and then pulverized using a pulverizer, to obtain a master batch 1.

(Preparation of Oil Phase)

In a container provided with a stirring rod and thermometer, 378 parts of low-molecular polyester 1, 100 parts of carnauba wax, and 947 parts of acetic ether were introduced. The temperature was raised to 80 [° C.] while stirring, and the container was held at 80 [° C.] for 5 hours and cooled at 30 [° C.] for 1 hour.

Next, 500 parts of master batch 1 and 500 parts of acetic ether were introduced into the container and mixed for 1 hour to obtain a raw material solution 1. The raw material solution 1 in an amount of 1324 parts was shifted to the container, which was filled with 80 vol % of 0.5 mm zirconia beads at a solution sending speed of 1 [kg/hr] and disk circumferential speed of 6 [m/sec] by using a beads mill (Ultravisco mill: manufactured by Aimex Corporation), and the carbon black and wax were dispersed under the condition of three paths. Subsequently, 1324 parts of 65% acetic ether solution of the low-molecular polyester was added thereto, and subjected to two path using a bead mill under the abovementioned condition, to obtain a pigment/wax dispersant 1. The solid content concentration of the pigment/wax dispersant 1 was 50 [%].

(Emulsification—Solvent Removal)

The pigment/wax dispersant 1 in an amount of 749 parts, 115 parts of prepolymer 1, and 2.9 parts of ketimine compound 1 were introduced to the container, and mixed together at 5000 [rpm] for 2 minutes using a TK homomixer (manufactured by Primix Corporation). The water phase 1 was added to the container in an amount of 1200 parts, and mixed at a revolution speed of 13,000 [rpm] for 25 minutes using the TK homomixer, to obtain an emulsion slurry 1.

The emulsion slurry 1 was thrown into the container provided with a stirrer and thermometer, subjected to solvent removal at 30 [° C.] for 7 hours, and thereafter matured at 45 [° C.] for 7 hours to obtain a dispersion slurry 1.

(Cleaning—Drying)

After 100 parts of dispersion slurry 1 was filtered under reduced pressure:

a) Ion-exchange water was added to a filter cake in an amount of 100 parts, mixed by the TK homomixer (at a revolution speed of 12,000 [rpm] for 10 minutes), and filtered.

b) Hydrochloric acid 1% was added to the filter cake such that the pH thereof is controlled to 3.5 to 4.5, and thus obtained product was mixed by the TK homomixer (at a revolution speed of 12,000 [rpm] for 15 minutes) and filtered.

c) The operation of adding 300 parts of ion-exchange water to the filter cake of b), mixing it using the TK homomixer (at a revolution speed of 12,000 [rpm] for 10 minutes), and filtering it was carried out twice, to obtain a filter cake 1.

d) The filter cake 1 was dried using a circulation type drier at 40 [° C.] for 40 hours, and sifted with a mesh having an opening of 75 μm, to obtain a toner base particle 1. Thereafter, 1.5 parts of hydrophobic silica and 0.5 parts of hydrophobic oxidized titanium were added to 1100 parts of toner base particle 1, which is then mixed using the Henschel mixer and sifted with a mesh having an opening of 35 μm, to obtain a toner 1. The property of the obtained toner 1 is shown in FIG. 17.

[Toner 2]

A toner 2 was obtained in the similar manner to the case of the toner 1 under different conditions as follows. The property of the toner 2 is shown in FIG. 17.

(Synthesis of Resin Fine Particle Emulsion)

In a reaction container provided with a stirring rod and a thermometer, 683 parts of water, 11 parts of sodium salt of methacrylic acid ethylene oxide adduct sulfate ester (eleminol RS-30, manufactured by Sanyo Chemical Industries, Ltd.), 83 parts of styrene, 83 parts of methacrylic acid, 110 parts of butyl acrylate, and 1 part of ammonium persulfate were put in and stirred at a speed of 3800 rotations/minutes for 30 minutes, to obtain a white emulsion. This emulsion was heated to a temperature of 75 [° C.] inside the system and reacted for 1 hour. Moreover, 30 parts of 1% ammonium persulfate was added thereto, which was matured at 75 [° C.] for 6 hours to obtain a water-based fine particle dispersant 2 of vinyl resin (copolymer of sodium salt of styrene-methacrylate-butyl acrylate-methacrylic acid ethylene oxide adduct sulfate ester). The volume average particle diameter of the fine particle dispersant 2 measured by a granularity distribution measurement device (LA-920: manufactured by Sysmex Corporation) was 40 [nm]. Some of the fine particle dispersant 2 was dried and isolated from the resin part. The shape of the resin fine particles was a spherical shape. The Tg of the resin part is 56 [° C.], and the weight-average molecular weight was 120,000.

[Toner 3]

A toner 3 was obtained in the similar manner to the case of the toner 1 under different conditions as follows. The property of the toner 3 is shown in FIG. 17.

[Emulsification—Solvent Removal]

The pigment/wax dispersant 1 in an amount of 749 parts, 115 parts of prepolymer 1, and 2.9 parts of ketimine compound 1 were introduced to the container, and mixed together at 5000 [rpm] for 2 minutes using a TK homomixer (manufactured by Primix Corporation). The water phase 1 was added to the container in an amount of 1200 parts, and mixed at a revolution speed of 13,000 [rpm] for 10 minutes using the TK homomixer, to obtain an emulsion slurry 2.

The emulsion slurry 2 was thrown into the container provided with a stirrer and thermometer, subjected to solvent removal at 30 [° C.] for 6 hours, and thereafter matured at 45 [° C.] for 5 hours to obtain a dispersion slurry 2.

[Toner 4]

A toner 4 was obtained in the similar manner to the case of the toner 1 under different conditions as follows. The property of the toner 4 is shown in FIG. 17.

(Emulsification—Solvent Removal)

The pigment/wax dispersant 1 in an amount of 749 parts, 115 parts of prepolymer 1, and 2.9 parts of ketimine compound 1 were introduced to the container, and mixed together at 5000 [rpm] for 2 minutes using a TK homomixer (manufactured by Primix Corporation). The water phase 1 was added to the container in an amount of 1200 parts, and mixed at a revolution speed of 13,000 [rpm] for 40 minutes using the TK homomixer, to obtain an emulsion slurry 3.

The emulsion slurry 3 was thrown into the container provided with a stirrer and thermometer, subjected to solvent removal at 30 [° C.] for 8 hours, and thereafter matured at 45 [° C.] for 5 hours to obtain a dispersion slurry 3.

[Toner 5]

A toner 5 was obtained in the similar manner to the case of the toner 1 under different conditions as follows. The property of the toner 5 is shown in FIG. 17.

(Preparation of Oil Phase)

In a container provided with a stirring rod and thermometer, 378 parts of low-molecular polyester 1, 130 parts of carnauba wax (ratio by weight was 5:5), and 947 parts of acetic ether were introduced. The temperature was raised to 80 [° C.] while stirring, and the container was held at 80 [° C.] for 4 hours and cooled at 30 [° C.] for 1 hour. Subsequently, 500 parts of master batch 1 and 500 parts of acetic ether were introduced into the container and mixed for 2 hours to obtain a raw material solution 2.

The raw material solution 2 in an amount of 1324 parts was shifted to the container, which was filled with 80 vol % of 0.5 mm zirconia beads at a solution sending speed of 1 [kg/hr] and disk circumferential speed of 6 [m/sec] by using a beads mill (Ultravisco mill: manufactured by Aimex Corporation), and the carbon black and wax were dispersed under the condition of ten paths. Subsequently, 1324 parts of 65% acetic ether solution of the low-molecular polyester 1 was added thereto, and subjected to five paths using a bead mill under the abovementioned condition, to obtain a pigment/wax dispersant 2. The solid content concentration of the pigment/wax dispersant 2 was 50 [%].

[Toner 6]

A toner 6 was obtained in the similar manner to the case of the toner 1 under different conditions as follows. The property of the toner 6 is shown in FIG. 17.

(Preparation of Oil Phase)

In a container provided with a stirring rod and thermometer, 378 parts of low-molecular polyester 1, 100 parts of carnauba wax (ratio by weight was 3:7), and 947 parts of acetic ether were introduced. The temperature was raised to 80 [° C.] while stirring, and the container was held at 80 [° C.] for 4 hours and cooled at 30 [° C.] for 1 hour. Subsequently, 500 parts of master batch 1 and 500 parts of acetic ether were introduced into the container and mixed for 0.8 hours to obtain a raw material solution 3.

The raw material solution 3 in an amount of 1324 parts was shifted to the container, which was filled with 80 vol % of 0.5 mm zirconia beads at a solution sending speed of 1 [kg/hr] and disk circumferential speed of 6 [m/sec] by using a beads mill (Ultravisco mill: manufactured by Aimex Corporation), and the carbon black and wax were dispersed under the condition of five paths. Subsequently, 1324 parts of 65% acetic ether solution of the low-molecular polyester 1 was added thereto, and subjected to three paths using a bead mill under the abovementioned condition, to obtain a pigment/wax dispersant 3. The solid content concentration of the pigment/wax dispersant 3 was 50 [%].

[Toner 7]

A toner 7 was obtained in the similar manner to the case of the toner 1 under different conditions as follows. The property of the toner 7 is shown in FIG. 17.

(Synthesis of Low-molecular Polyester)

In a reaction container attached with a cooling pipe, stirrer, and nitrogen introducing pipe, 229 parts of bisphenol A ethylene oxide 2 mol adduct, 529 parts of bisphenol A propylene oxide 3 mol adduct, 208 parts of terephthalic acide, 46 parts of adipic acid, and 2 parts dibutyltin oxide were introduced, reacted under an ordinary pressure of 230 [° C.] for 7 hours, and further reacted under a low pressure of 10 to 15 [mmHg] for 5 hours. Thereafter, 44 parts of trimellic anhydride was added and reacted at 180 [° C.] under an ordinary pressure for 3 hours to obtain a low-molecular polyester 2. The low-molecular polyester 2 had a number average molecular weight of 2300, a weight average molecular weight of 6700, a peak molecular weight of 3100, a Tg of 43 [° C.], and an acid number of 25.

(Preparation of Oil Phase)

In a container provided with a stirring rod and thermometer, 378 parts of low-molecular polyester 2, 100 parts of carnauba wax, and 947 parts of acetic ether were introduced. The temperature was raised to 80 [° C.] while stirring, and the container was held at 80 [° C.] for 5 hours and cooled at 30 [° C.] for 1 hour. Subsequently, 500 parts of master batch 1 and 500 parts of acetic ether were introduced into the container and mixed for 1 hours to obtain a raw material solution 4.

The raw material solution 4 in an amount of 1324 parts was shifted to the container, which was filled with 80 vol % of 0.5 mm zirconia beads at a solution sending speed of 1 [kg/hr] and disk circumferential speed of 6 [m/sec] by using a beads mill (Ultravisco mill: manufactured by Aimex Corporation), and the carbon black and wax were dispersed under the condition of three paths. Subsequently, 1324 parts of 65% acetic ether solution of the low-molecular polyester 2 was added thereto, and subjected to three paths using a bead mill under the abovementioned condition, to obtain a pigment/wax dispersant 4. The solid content concentration of the pigment/wax dispersant 4 was 50 [%].

(Emulsion—Solvent Removal)

The pigment/wax dispersant 4 in an amount of 749 parts, 115 parts of prepolymer 1, and 2.9 parts of ketimine compound 1 were introduced to the container, and mixed together at 5000 [rpm] for 2 minutes using a TK homomixer (manufactured by Primix Corporation). The water phase 1 was added to the container in an amount of 1200 parts, and mixed at a revolution speed of 13,000 [rpm] for 40 minutes using the TK homomixer, to obtain an emulsion slurry 4.

The emulsion slurry 4 was thrown into the container provided with a stirrer and thermometer, subjected to solvent removal at 30 [° C.] for 8 hours, and thereafter matured at 45 [° C.] for 5 hours to obtain a dispersion slurry 4.

(Toner 8)

A toner 8 was obtained in the similar manner to the case of the toner 1 under different conditions as follows. The property of the toner 8 is shown in FIG. 17.

(Preparation of Oil Phase)

In a container provided with a stirring rod and thermometer, 378 parts of low-molecular polyester 1, 380 parts of carnauba wax, and 947 parts of acetic ether were introduced. The temperature was raised to 80 [° C.] while stirring, and the container was held at 80 [° C.] for 4 hours and cooled at 30 [° C.] for 1 hour. Subsequently, 500 parts of master batch 1 and 500 parts of acetic ether were introduced into the container and mixed for 2 hours to obtain a raw material solution 5.

The raw material solution 5 in an amount of 1324 parts was shifted to the container, which was filled with 80 vol % of 0.5 mm zirconia beads at a solution sending speed of 1 [kg/hr] and disk circumferential speed of 6 [m/sec] by using a beads mill (Ultravisco mill: manufactured by Aimex Corporation), and the carbon black and wax were dispersed under the condition of seven paths. Subsequently, 1324 parts of 65% acetic ether solution of the low-molecular polyester 1 was added thereto, and subjected to four paths using a bead mill under the abovementioned condition, to obtain a pigment/wax dispersant 5. The solid content concentration of the pigment/wax dispersant 5 was 50 [%].

Note that the embodiment above has described the examples of the cleaning device 30 for the photoreceptor 10, but the present invention can be used not only as the printer 100 of the present embodiment but also as a cleaning device for cleaning a surface moving member in all types of image forming apparatuses. Therefore, the present invention can be applied to, for example, an image forming apparatus that has one photoreceptor and a plurality (four, for example) of developing devices, wherein the developing devices are sequentially rotated to create a toner image of each color on the photoreceptor, and these toner images are eventually transferred to a transfer sheet. The present invention can also be applied to a monochrome image forming apparatus. In addition, the present invention can be used not only as a printer but also as a copier, a facsimile, a combined machine having a plurality of functions, or other cleaning devices. Note that the image forming apparatus may be of an electrophotographic type or of an inkjet type. In other words, the image forming apparatus can be applied as a cleaning device for cleaning a surface moving member, as long as the image forming apparatus has a surface moving member that has an object to be removed from the surface thereof. Moreover, even when the object to be removed is a toner, paper powder, metallic powder or other type of powder, or a liquid such as developer, the present invention can be applied.

The present invention can be applied to not only the cleaning device for cleaning a photoreceptor, but also a cleaning device for removing an object, such as transferred residual toner adhered to the surface of a surface moving member other than a photoreceptor, i.e., the surface of the intermediate transfer belt 162. Moreover, the present invention can be applied to a cleaning device for removing toner, paper powder or other objects adhering to the surface of, not only an image carrier such as a photoreceptor or intermediate transfer belt, but also a recording material conveying member that carries and conveys a recording medium to a surface. Note that the present invention can be applied to a cleaning device that has a recording body conveying unit integrally supporting the recording material conveying member and the cleaning device.

In addition, the present invention can be applied to a cleaning device for cleaning any types of surface moving members that have an object to be removed from the surfaces thereof. Needless to say, the surface moving member may be in the form of a drum or a belt where the surface thereof moves. However, in the case of a cleaning device for cleaning a belt-shaped surface moving member, generally the cleaning device is disposed to hold the belt between a supporting roller supporting the belt and a blade, but a backup member, such as a flat member, may be disposed on a belt inner circumferential surface, and then the cleaning device may be disposed to hold the belt between the backup member and the blade. Further, in the case of the photoreceptor 10 of the present embodiment that needs to be cleaned, the photoreceptor may be an organic photoreceptor or amorphous silicon photoreceptor that has a cross-linking structure on the surface thereof and is provided with a protective layer made of binder resin. Therefore, the present invention can be applied as a cleaning device to all kinds of photoreceptors. When the target to be cleaned is the intermediate transfer belt 162, this intermediate transfer belt may be a polyimide intermediate transfer belt, an intermediate transfer belt made of a polyethylene material, or an intermediate transfer belt made of fluorine or rubber, in consideration of heat resistance and retractility. Therefore, the present invention can be applied as a cleaning device to all kinds of intermediate transfer belts.

Note that the configuration of the cleaning device 30 for cleaning a photoreceptor that is described in the embodiment above can be used directly in various application examples described hereto, and the cleaning device of the present embodiment can be changed appropriately in accordance with the application examples.

As described above, the cleaning device 30 of the present embodiment has the blade 31, which is a long plate-shaped elastic member, the blade holder 32, which is a holding member for holding the blade 31, the spindle 34, which is the engaged means provided in the blade holder 32, and the bearing part 35, which is the engaging means engaged with the spindle 34 and supported by the device main body. Further, in the cleaning device 30, the blade 31 is pressed against the surface of the photoreceptor 10 such that one side of the blade 31 that extends in the longitudinal direction (abutting side) extends perpendicular to the surface moving direction of the photoreceptor 10 serving as the surface moving member, whereby an object adhering to the surface of the photoreceptor 10 is removed. The bearing part 35 is disposed in the frame body 33 of the device main body, on the surface moving direction downstream side of the photoreceptor 10 from the normal line of the surface of the photoreceptor 10 against which the blade 31 abuts. As the warpage regulating means for regulating a warpage of the blade 31 that is generated by pressing the blade 31 against the surface of the photoreceptor 10, the holder upstream side surface 32*b* of the blade holder 32 is provided. The blade holder 32 holds the blade 31 by means of the holder upstream side surface 32*b*. As a result, the abutment width of the blade 31 with respect to the photoreceptor surface can be reduced, while maintaining the abutment pressure that is substantially equal to that of the conventional counter type cleaning device that does not regulate the warpage of the blade 31. Therefore, friction between the photoreceptor 10 and the blade 31 can be prevented, and the blade 31 is prevented from being unstable. At the same time, the surface of the photoreceptor 10 can be cleaned favorably, even when small-diameter and spherical toner is used.

When regulating the warpage of the blade 31, the cleaning device described in the previous application cannot maintain the state of abutment between the blade 31 and the surface of the photoreceptor 10 in the longitudinal direction of the blade 31, due to a tolerance caused by assembling the members or time-dependent decentering of the photoreceptor 10, and also some sections on the surface of the photoreceptor 10 cannot be cleaned favorably. In the present embodiment, however, the spindle 34 and the bearing part 35 are engaged with each other with a certain degree of freedom, and the blade holder 32 is made displaceable with respect to the device main body. Thus, the tolerance can be corrected to temporarily maintain the state of abutment between the blade 31 and the photoreceptor 10 in the longitudinal direction. As a result, the above-described sections on the surface of the photoreceptor 10 can be cleaned. Further, a predetermined press-contact pressure for biasing from the blade 31 to the surface of the photoreceptor 10 can be biased uniformly in the longitudinal direction. However, even when the blade holder 32 is made displaceable with respect to the device main body, once the abutting position of the blade 31 is determined based on the reference line served by the engagement part between the spindle 34 and the bearing part 35, the uniform biasing in the longitudinal direction cannot be realized. In contrast, according to the cleaning device 30 of the present embodiment, the position of the blade holder 32 in relation to the cleaning device 30 main body is determined such that the abutting side of the blade 31 serves as the reference line. Therefore, instead of determining the abutting position of the abutting side of the blade 31 based on the reference line between the spindle 34 and the bearing part 35, the abutting side is used as the reference line to determine the abutting position, so that the abutting side of the blade 31 can be brought into uniform abutment against the photoreceptor 10 in the longitudinal direction. As a result, the cleaning property improves, and unnecessary pressure can be reduced, enhancing abrasion resistance against the blade or surface moving member.

In this manner, the blade 31 having a regulated warpage can be brought into uniform abutment against the photoreceptor 10 in the longitudinal direction. Hence, while keeping the high contact pressure, excellent abrasion resistance can be kept without applying an unnecessary load, and the small-diameter and spherical toner can be cleaned.

In the cleaning device 30 according to the present embodiment, the pressing force Fp, which is applied by the abutting side of the blade 31 extending in the longitudinal direction and abutting against the surface of the photoreceptor 10, is greater than the pressing force Fq applied by the spindle 34 of the blade holder 32 to press the bearing part 35. Therefore, the position of the blade holder 32 in relation to the cleaning device 30 main body can be determined such that the abutting side of the blade 31 serves as the reference line, and the abutting side of the blade 31 can be brought into uniform abutment against the photoreceptor 10 in the longitudinal direction.

The cleaning device 30 according to the present embodiment further has the springs 36 that function as the biasing means for biasing the blade holder 32 such that the one side of the blade 31 in the longitudinal direction that abuts against the photoreceptor 10 presses the surface of the photoreceptor 10. The springs 36 bias the blade holder 32 on the surface moving direction upstream side of the photoreceptor 10 from the position of the gravity center G of the elastic member unit that integrally supports the blade 31 and the blade holder 32 and is displaced with respect to the device main body. As a result, the pressing force Fp of the abutting side pressing the surface of the photoreceptor 10 becomes greater than the pressing force Fq of the spindle 34 of the blade holder 32 pressing the bearing part 35, and the position of the blade holder 32 in relation to the cleaning device 30 main body is determined such that the abutting side of the blade 31 serves as the reference line. Consequently, the abutting side of the blade 31 can be brought into uniform abutment against the photoreceptor 10 in the longitudinal direction.

Furthermore, in the cleaning device 30 of Example 1, the engaged means is the spindle 34, and the engaging means is the bearing part 35 that has the circularly opened round hole 38, wherein the spindle 34 and the bearing part 35 are engaged with each other with a certain degree of freedom in the radial direction of the bearing part 35. In other words, the round hole 38 of the bearing part 35 is formed into an unloaded hole with a certain size enough to absorb fluctuations in the member accuracy or assembly accuracy from the diameter of the spindle 34 or misalignment of the spindle that is caused when securing a uniform press-contact force on the photoreceptor 10. Therefore, even when the photoreceptor 10 is shifted anywhere in the tangential line M direction and the normal line N direction, the cleaning device 30 can handle the problems.

In the cleaning device 30 of Example 2, the engaged mean is the spindle 34 and the engaging means is the bearing part 35 that has a long hole 39 having a long axis stretched in a direction substantially parallel to the normal line N, wherein the spindle 34 and the bearing part 35 are engaged with each other with a certain degree of freedom in the direction of the long axis of the long hole 39 of the bearing part 35. In other words, the shaft hole of the bearing part 35 is formed as the long hole 39 in which the direction of the long axis is parallel to the direction of the normal line N, and is formed into a long hole that has a certain length enough to absorb fluctuations in the member accuracy or assembly accuracy from the diameter of the spindle 34 or misalignment of the spindle 34 that is caused when securing a uniform press-contact force on the photoreceptor 10, as the misalignment amount in a direction parallel to the direction of the normal line N. As a result, even when the abutting section P is shifted anywhere in the tangential line M direction and the normal line N direction, the cleaning device 30 can handle the problems. Furthermore, because the spindle 34 is constantly located on the rim (wall) of the long hole 39 with respect to the direction of the tangential line M, the spindle 34 can be prevented from moving (vibrating) by the drive of the photoreceptor 10.

In the cleaning device 30 of Example 3, the engaged means is the spindle 34 and the engaging means is the elastic bearing 60 that is the bearing part made of an elastic body, wherein the spindle 34 and the bearing part are engaged with each other with a certain degree of freedom in the radial direction of the shaft hole of the bearing part 35. In other words, the elastic bearing 60 of the bearing part 35 is configured as an elastic member that can be elastically deformed to a certain amount enough to be able to absorb enough to absorb fluctuations in the member accuracy or assembly accuracy from the diameter of the spindle 34 or misalignment of the spindle that is caused when securing a uniform press-contact force on the photoreceptor 10. Therefore, even when the photoreceptor 10 is shifted anywhere in the tangential line M direction and the normal line N direction, the cleaning device 30 can handle the problems.

The printer 100 of the present embodiment is configured to be attachable to and detachable from the main body of an image forming apparatus, such as the printer 100 that transfers an image formed on the photoreceptor 10 eventually to a recording material. The printer 100 uses at least the process cartridge 121 that integrally supports the photoreceptor 10 and the cleaning device 30 of the present embodiment that is the cleaning means for removing an unwanted object adhering to the photoreceptor 10. Therefore, the positional accuracy of the blade 31 and the photoreceptor 10 can be favorably kept when assembling them to the apparatus main body, and the cleaning device 30 integrated with the photoreceptor 10 can be replaced. Therefore, the user can easily replace it or maintain it while keeping the positional accuracy.

In addition, in the printer 100 of the present embodiment in the image forming apparatus that transfers an image formed on the photoreceptor 10 serving as the surface moving member eventually to a recording material, the cleaning device 30 of the present embodiment is used as the cleaning means for removing an unwanted object adhering to the photoreceptor 10. Hence, while the abutment pressure of the blade 31 onto the photoreceptor 10 keeps the high contact pressure, excellent abrasion resistance can be kept without applying an unnecessary load, and the small-diameter and spherical toner can be cleaned. As a result, the photoreceptor 10 can be cleaned favorably, and a high-quality image can be formed.

The printer 100 that functions as the image forming apparatus for transferring an image formed on the photoreceptor 10 serving as the surface moving member eventually to a transfer sheet has at least the process cartridge that integrally supports the photoreceptor and the cleaning means for removing an unwanted object adhering to the photoreceptor, and is attachable to and detachable from the apparatus main body. The process cartridge 121 of the present embodiment is used as this process cartridge. By this means, the cleaning device 30 can be replaced integrally with the photoreceptor 10, and the user can therefore easily replace it while keeping the positional accuracy, achieving easier maintenance. Moreover, the photoreceptor 10 can be cleaned favorably and a high quality image can be formed.

According to the present embodiment, the toner configuring an image satisfies at least one of the following conditions: the volume average particle diameter is at least 3 [μm] but no more than 7 [μm], and the average circularity degree is at least 0.940 but no more than 0.998, and the shape factors SF-1 and SF-2 are at least 100 but no more than 160. Even when the toner of this shape is sued, the effects described above can be obtained using the cleaning device 30 of the present invention, whereby the cleaning property can be maintained favorably. Furthermore, a high quality image can be realized by using the toner of the abovementioned shape.

According to the present embodiment, the toner configuring an image is obtained by dissolving and/or dispersing polyester prepolymer having a functional group containing a nitrogen atom, polyester, and a toner composition containing the colorant and mold release agent, in an organic solvent to create an organic solvent composition, dispersing the organic solvent composition in an aqueous medium having the resin fine particles therein, and cross-linking and/or extending thus obtained product. In a conventional method for preparing pulverized toner, the toner cannot be produced when compared to any of the values of the circularity degree, average particle diameter, and shape factors SF-1 and SF-2, or use of the toner obtained by a polymerization method is advantageous in terms of the production cost and yield.

Furthermore, in the configuration to which the present invention, a cleaning device that is the same as the cleaning device 30 of the present embodiment may be used as the cleaning means for removing an unwanted object adhering to the recording material conveying member serving as the surface moving member of the image forming apparatus that forms an image on a recording material carried on the surface of the recording material conveying member. Accordingly, the cleaning property improves, and the abrasion resistance of the blade or surface moving member can be improved by reducing unwanted pressure. Furthermore, the blade can be brought into uniform abutment against the recording material conveying member in a direction perpendicular to the surface moving direction (longitudinal direction). Hence, excellent abrasion resistance can be kept without applying an unnecessary load, and the small-diameter and spherical toner can be cleaned. Because the recording material conveying member can be cleaned favorably, adhesion of an unwanted toner such as a stain on the back of the transfer sheet conveyed by the recording material conveying member can be prevented, and formation of a high quality image can be achieved.

In addition, by using a recording material conveying unit, which is configured to be attachable to and detachable from the image forming apparatus main body that has the cleaning device having the same configuration as the cleaning device 30 of the present embodiment as the cleaning means for cleaning the recording material conveying member, and which integrally supports the recording material conveying member and the cleaning device for removing an unwanted object adhering to the recording material conveying member, the cleaning device integrated with the recording material conveying member can be replaced. As a result, the user can easily replace it or maintain it while keeping the positional accuracy.

The image forming apparatus that forms an image on a recording material carried on the surface of the recording material conveying member serving as the surface moving member may be provided with at least the recording material conveying unit that is attachable to and detachable from the device main body and integrally supports the recording material conveying member and the cleaning means for removing an unwanted object adhering to the recording material conveying member, and the recording material conveying unit may be provided with the cleaning device that has the same configuration as the cleaning device 30 of the present invention. Accordingly, the cleaning device integrated with the recording material conveying member can be replaced. Thus, the user can easily replace it or maintain it while keeping the positional accuracy. Further, because the recording material conveying member can be cleaned favorably, adhesion of an unwanted toner such as a stain on the back of the transfer sheet conveyed by the recording material conveying member can be prevented, and formation of a high quality image can be achieved.

As the cleaning means that has the intermediate transfer unit that supports integrally the intermediate transfer belt 162 and the cleaning means for removing an unwanted object adhering to the intermediate transfer belt 162 and is configured attachable to and detachable from the printer 100 main body, the intermediate transfer belt 162 transferring an image formed on the photoreceptor 10 serving as another image carrier onto a transfer sheet serving as a recording medium having the image transferred thereto, a cleaning device having the same configuration as the cleaning device 30 of the present embodiment may be used. As a result, the cleaning property improves, and the abrasion resistance of the blade and intermediate transfer belt 162 improves by reducing unnecessary pressure. Furthermore, the blade can be brought into uniform abutment in a direction perpendicular to the surface moving direction of the intermediate transfer belt 162 (longitudinal direction). Hence, while keeping the high contact pressure, excellent abrasion resistance can be kept without applying an unnecessary load, and the small-diameter and spherical toner can be cleaned. Because the intermediate transfer belt 162 can be cleaned favorably, re-adhesion of the toner to the photoreceptor 10 and the impact of the transfer residual toner on the next image can be prevented, and formation of a high quality image can be realized.

The cleaning device integrated with the intermediate transfer belt 162 can also be replaced by using the intermediate transfer unit that is configured attachable to and detachable from the image forming apparatus main body having the cleaning device provided with the same configuration as the cleaning device 30 of the present embodiment as the cleaning means of the intermediate transfer belt 162, and is configured to integrally support the intermediate transfer belt 162 and the cleaning means for removing an unwanted object adhering to the intermediate transfer belt 162. Therefore, the user can easily replace it or maintain it while keeping the positional accuracy.

In addition, the printer 100 that transfers a toner image formed on the photoreceptor 10 to the intermediate transfer belt 162 and transfers the image from the intermediate transfer belt 162 to a transfer sheet to form an image on the transfer sheet may be provided with at least the intermediate transfer unit that integrally supports at least the intermediate transfer belt 162 and the cleaning means for removing an unwanted object adhering to the intermediate transfer belt 162 and is configured attachable to and detachable from the printer 100 main body, and the intermediate transfer unit may have a cleaning device that has the same configuration as the cleaning device 30 of the present embodiment as the cleaning means. Therefore, the cleaning device integrated with the intermediate transfer belt 62 can be replaced, and the user can easily replace it or maintain it while keeping the positional accuracy. Because the intermediate transfer belt 162 can be cleaned favorably, re-adhesion of the toner to the photoreceptor 10 and the impact of the transfer residual toner on the next image can be prevented, and formation of a high quality image can be realized. In addition, adhesion of an unwanted toner such as a stain on the back of the transfer sheet can be prevented, and formation of a high quality image can be achieved.

The present embodiment has the following characteristics:

(1) In the cleaning device of the present embodiment, the engaging means and the engaged means are engaged with each other with a certain degree of freedom, and the holding member is made replaceable with respect to the device main body. Therefore, because the holding member is displaced with respect to the device main body, a change in the positional relationship between the members that is caused by the manufacturing tolerances or environmental variations can be corrected, and the state of abutment between the surface moving member and the plate-shaped elastic member can be maintained.

(2) The position of the holding member in relation to the device main body is determined to contain two sections contact parts out of three contact parts between the device main body and the holding member outside a straight line in which one side of the plate-shaped elastic member extending in the longitudinal direction and abutting against the surface of the surface moving member. Therefore, the straight light connecting the engagement part between the engaging means and the engaged means does not function as the reference line to determine the abutting position of plate-shaped elastic member, but the one side of the plate-shaped elastic member extending in the longitudinal direction and abutting against the surface of the surface moving member functions as the reference line to determine the abutting position. As a result, the one side of the plate-shaped elastic member can be securely brought into uniform abutment in the longitudinal direction of the photoreceptor.

(3) In addition, the pressing force, which is applied to the surface of the surface moving member by the one side of the plate-shaped elastic member extending in the longitudinal direction and abutting against the surface of the surface moving member, is greater than the pressing force applied by the engaged means of the holding member to press the engaging means, the pressing force being generated by the biasing means biasing the plate-shaped elastic member and the holding member toward the surface moving body side. Therefore, the one side of the plate-shaped elastic member extending in the longitudinal direction and abutting against the surface of the surface moving member comes into contact with the surface moving member more preferentially than the two engagement parts of the engaging means and the engaged means, and the one side of the plate-shaped elastic member functions as the reference line so that the abutting position can be determined. As a result, the one side of the plate-shaped elastic member can come into uniform abutment more securely in the longitudinal direction of the photoreceptor.

(4) Furthermore, the biasing means biases the holding member on the surface moving direction upstream side of the surface moving member from the gravity center position of the elastic member unit. Consequently, the pressing force applied to the surface of the surface moving member by one side of the plate-shaped elastic member extending in the longitudinal direction and abutting against the surface moving member becomes greater than the pressing force applied by the engaged means of the holding member to press the engaging means. Therefore, the one side of the plate-shaped elastic member extending in the longitudinal direction and abutting against the surface of the surface moving member comes into contact with the surface moving member more preferentially than the two engagement parts of the engaging means and the engaged means, and the one side of the plate-shaped elastic member functions as the reference line so that the abutting position can be determined. As a result, the one side of the plate-shaped elastic member can come into uniform abutment more securely in the longitudinal direction of the photoreceptor.

(5) According to the cleaning device of the present embodiment, the occurrence of unstable abutment in the longitudinal direction of the plate-shaped elastic member can be securely prevented, and the state of abutment between the plate-shaped elastic member and the surface of the surface moving member is maintained over time, so that the entire surface of the surface moving member can be cleaned favorably.

As described above, the present embodiment has the excellent effect of obtaining high removing performance while preventing the friction between the surface moving member to be cleaned and the plate-shaped elastic member, and securely maintaining the state of abutment between the surface moving member and the plate-shaped elastic member over time.

Second Embodiment

An image forming apparatus according to a second embodiment of the present invention will be described next.

The image forming apparatus of this embodiment is a color laser printer capable of forming color images, but may be other type of image forming apparatus. Such an image forming apparatus is capable of carrying out image formation processing based on an image signal corresponding to image information received from the outside, and carrying out image formation on a sheet-like recording medium, which is a recording material, such as regular paper used in general copying, an OHP sheet, a card, a postcard or other heavy paper, as well as on an envelope.

Figure 18:
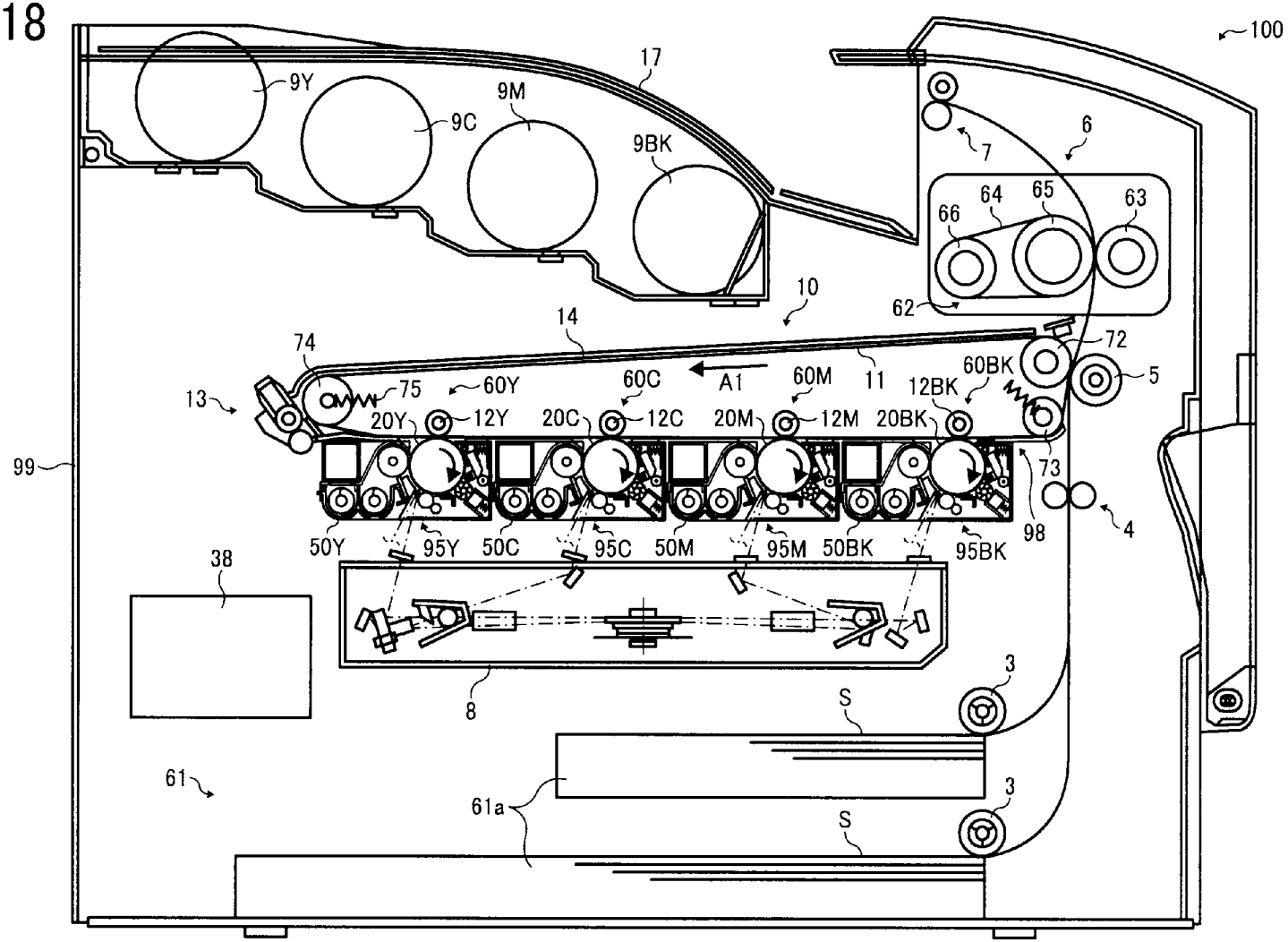
FIG. 18 is a diagram showing a schematic configuration of an image forming apparatus according to a second embodiment.

As shown in FIG. 18, this image forming apparatus 100 adopts a tandem structure in which are arranged photosensitive drums 20Y, 20C, 20M and 20Bk functioning as image carriers capable of forming images corresponding to colors separated into yellow, magenta, cyan and black. The photosensitive drums 20Y, 20C, 20M and 20Bk are located on the outer circumferential side of a transfer belt 11, that is, on the created image side, the transfer belt 11 being a recording material conveying member serving as an intermediate transfer body that is an endless belt disposed in substantially the central part within a main body 99 of the image forming apparatus 100. As in the photosensitive drums 20Y, 20C, 20M and 20Bk, the notations of Y, C, M and Bk at the ends of reference numerals means that yellow, cyan, magenta and black images are formed.

The transfer belt 11 function as a surface moving member capable of moving in the direction of an arrow A1, that is, the counterclockwise direction, while facing each of the photosensitive drums 20Y, 20C, 20M and 20Bk. A visible image or a toner image formed on each of the photosensitive drums 20Y, 20C, 20M and 20Bk is transferred in an overlapping manner to the transfer belt 11 moving in the direction of the arrow A1, and thereafter transferred to a transfer sheet S of a recording medium at once. The lower side of the transfer belt 11 faces each of the photosensitive drums 20Y, 20C, 20M and 20Bk, and this section forms a primary transfer part 98 which transfers the toner image on each of the photosensitive drum 20Y, 20C, 20M and 20Bk to the transfer belt 11.

While the transfer belt 11 moves in the A1 direction, overlap transfer to the transfer belt 11 is carried out from the A1 direction upstream side toward the downstream side at different times by means of voltages applied by primary transfer rollers 12Y, 12C, 12M and 12Bk disposed facing the photosensitive drums 20Y, 20C, 20M and 20Bk with the transfer belt 11 therebetween, so that the toner images formed on the photosensitive drums 20Y, 20C, 20M and 20Bk are transferred to the same position on the transfer belt 11 in an overlapping manner.

The photosensitive drums 20Y, 20C, 20M and 20Bk are arranged in this order from the upstream side of the A1 direction. The photosensitive drums 20Y, 20C, 20M and 20Bk are provided to image stations 60Y, 60C, 60M and 60Bk, respectively, which are image forming parts for forming yellow, cyan, magenta and black images.

This image forming apparatus 100 has the four image stations 60Y, 60C, 60M and 60Bk, a transfer belt unit 10 that is disposed to face the upper side of the photosensitive drums 20Y, 20C, 20M and 20Bk and has the transfer belt 11, a secondary transfer roller 5, which is a transfer member that is disposed to face the transfer belt and driven by the transfer belt 11, and an optical scanning device 8, which is an exposure device serving as a writing unit serving as latent image formation means disposed to face the lower side of the image stations 60Y, 60C, 60M and 60Bk.

This image forming apparatus 100 also has a sheet feeding device 61, which is a sheet feeding part functioning as a sheet feeding unit which has stacked thereon transfer sheets S that are conveyed toward between the transfer belt 11 and the photosensitive drums 20Y, 20C, 20M and 20Bk, a resist roller pair 4 for delivering each recording sheet S conveyed from the sheet feeding device 61 toward a secondary transfer nip between the transfer belt 11 and the secondary transfer roller 5 at a predetermined time corresponding to toner image formation timing of the image stations 60Y, 60C, 60M and 60Bk, and a sensor (not shown) for detecting that a leading end of the transfer sheet S reaches the resist roller pair 4.

This image forming apparatus 100 further has a fixing device 6 functioning as a belt fixing type fixing unit for fixing the same toner image onto the transfer sheet S having the toner image transferred thereto, a discharge roller 7 for discharging the transfer sheet S having the toner image fixed thereon to the outside of the main body 99, toner bottles 9Y, 9C, 9M and 9Bk serving as detachable members that are disposed on the upper side of the transfer belt unit 10, filled with yellow, cyan, magenta and black toners, and attached to or detached from the main body 99, a paper tray 17 serving as a paper storage for stacking the transfer sheets S that are discharged to the outside of the main body 99 by the discharge roller 7 disposed on the uppers side of the main body 99, and a waste toner tank 38 for storing unwanted objects such as waste toner.

This image forming apparatus 100 also has a toner supply mechanism (not shown) that supplies the toners contained in the toner bottles 9Y, 9C, 9M and 9Bk to developing devices 50Y, 50C, 50M, 50Bk provided to the image stations 60Y, 60C, 60M and 60Bk, and control means (not shown) for controlling the entire operation of the image forming apparatus 100.

The transfer belt unit 10 has, in addition to the transfer belt 11, the primary transfer rollers 12Y, 12C, 12M and 12Bk, a driving roller 72 serving as a driving member wrapped with the transfer belt 11, a transfer entrance roller 73, a cleaning counter roller 74, and a spring 75 functioning as biasing means for biasing the cleaning counter roller 74 in a direction of increasing the tensional force of the transfer belt 11.

The transfer belt unit 10 has an intermediate transfer belt case 14 that is supported detachably by the main body 99, holds the driving roller 72, transfer entrance roller 73, cleaning counter roller 74 and spring 75, and forms a casing of the transfer belt unit 10, and a cleaning device 13 serving as an intermediate transfer belt cleaning device that is integrated with the intermediate transfer belt 14, disposed to face the transfer belt 11, and cleans the transfer belt 11.

The cleaning counter roller 74 functions as a tension roller serving as a pressure member that applies a predetermined tensional force appropriate to perform transfer, to the transfer belt 11 by means of an action of the spring 75.

The cleaning device 13 has a cleaning brush and cleaning blade disposed to face and abut against the transfer belt 11, the detail of which is not illustrated, wherein the cleaning brush and the cleaning blade scrape and remove residual toner or other foreign matters on the transfer belt 11 to clean the transfer belt 11. Unwanted objects such as waste toner generated as a result of this cleaning are stored in the waste toner tank 38 through a waste toner path that is not shown.

The cleaning device 13 may be disposed not only in the illustrated position but also in a position anywhere on the downstream side from the driving roller 72 in the A1 direction and on the upstream side from the image station 60Y. The cleaning device 13 can be provided with the same configuration as that of a cleaning device 40Y described hereinafter, in which case the transfer belt 11 is the surface moving member functioning as an image carrier. Moreover, the same advantages as those of a process cartridge 95Y described hereinafter can be obtained by configuring a process cartridge using the cleaning device and the transfer belt 11, that is by configuring the transfer belt unit 10 into the process cartridge.

The transfer belt unit 10 is configured to be attachable to and detachable from the main body 99 and configures the casing of the image forming apparatus 100, which is not shown. By opening a cover located on the near side of the page of the drawing and sliding the transfer belt unit 10 from the far side of the page of the drawing toward the near side of the page, the transfer belt unit 10 can be removed from the main body 99. The opposite work from this detaching work is performed to attach the transfer belt unit 10 to the main body 99.

The sheet feeding device 61, disposed in a lower part of the main body 99, has a two stages of sheet feeding cassettes 61*a* capable of stacking a number of transfer sheets S thereon, and a sheet feeding roller 3 that abuts against the upper surface of the uppermost transfer sheet S of the transfer sheets S stacked on each sheet feeding cassette 61*a*, wherein the uppermost transfer sheet S of the transfer sheets S stacked on the sheet feeding cassettes 61*a* is fed toward the resist roller pair 4 by rotating and driving the sheet feeding roller 3 in the counterclockwise direction. The constituents of the image forming apparatus 100 other than the sheet feeding device 61 configure the image forming part.

The fixing device 6 has a belt unit 62 and a pressure roller 63 brought into press-contact with the belt unit 62. The belt unit 62 has an endless fixing belt 64, a fixing roller 65 that endlessly moves while tightly stretching the fixing belt 64, and a heat roller 66 that wraps the fixing belt 64 along with the fixing roller 65 and has a heat source (not shown) therein.

The fixing device 6 inserts a transfer sheet carrying a toner image thereon to a fixing part serving as a press-contact part between the belt unit 62 and the pressure roller 63, and thereby fixes the carried toner image onto the surface of the transfer sheet by means of the heat and pressure.

The yellow, cyan, magenta and black toners contained in the toner bottles 9Y, 9C, 9M and 9Bk respectively are replenished, by the toner supply mechanism, into the developing devices 50Y, 50C, 50M and 50Bk respectively provided in the image stations 60Y, 60C, 60M and 60Bk, in a predetermined replenishment amount. The toner bottles 9Y, 9C, 9M and 9Bk are disposables that can be replaced by attaching it to or detaching it from the main body 99 when emptied.

Hereinafter, the image stations 60Y, 60C, 60M and 60Bk are described. Because the image stations 60Y, 60C, 60M and 60Bk in the image forming apparatus 100 have substantially the same configuration, the notations of Y, C, M and Bk at the ends of reference numerals are omitted.

Figure 19:
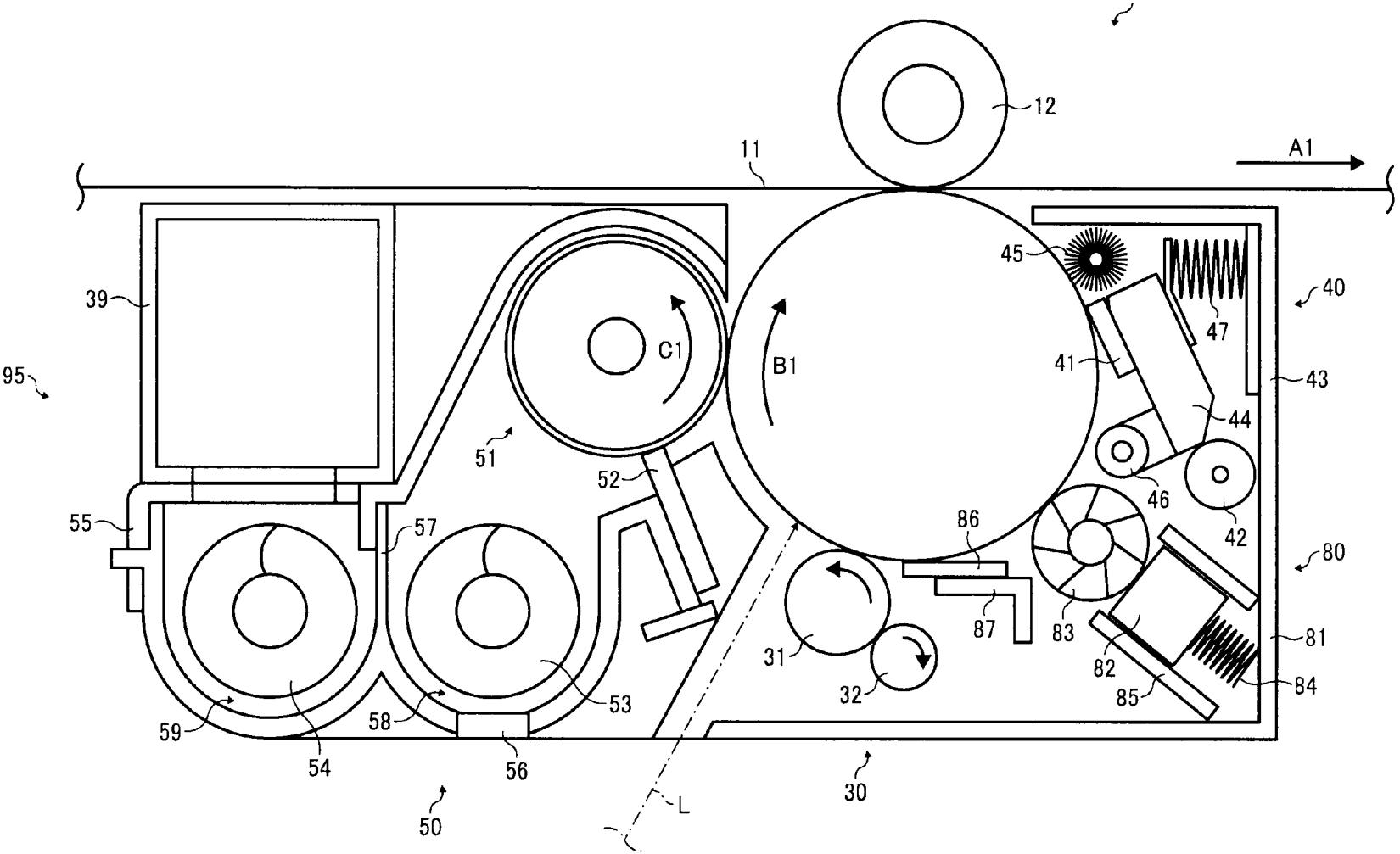
FIG. 19 is a diagram showing a schematic configuration of a process cartridge having one of a plurality of image carriers provided in the image forming apparatus, and a schematic configuration of a cleaning device disposed around the process cartridge.

As shown in FIG. 19, the image station 60 has, around the photosensitive drum 20 along a rotational direction B1, i.e., clockwise direction, the primary transfer roller 12, the cleaning device 40 functioning as the cleaning means, a lubricative substance supply device 80 that is a lubricant application device functioning as lubricative substance supply means, a charging device 30 that is a charging unit functioning as charging means, and the developing device 50 that is a developing unit functioning as developing means The photosensitive drum 20, cleaning device 40, lubricative substance supply device 80, charging device 30, and developing device 50 are integrated and configure the process cartridge 95. The process cartridge 95 is independently and freely drawn out of or pushed into the main body 99 along a guiderail (not shown) fixed to the main body 99, and is installed to be attachable to and detachable from the main body 99.

When the process cartridge 95 is pushed into the main body 99, the process cartridge 95 is loaded and positioned in a predetermined position appropriate for performing image formation. Because the process cartridge can be handled as a detachable/replaceable product by a serviceman or a user, the maintenance property can be improved significantly.

The process cartridge 95 is a unit that is configured by integrating at least the photosensitive drum 20 and the cleaning device 40 out of the components of the photosensitive drum 20, cleaning device 40, lubricative substance supply device 80, charging device 30, and developing device 50, and installed detachably with respect to the main body 99. In the process cartridge 95, its constituents of the photosensitive drum 20, cleaning device 40, lubricative substance supply device 80, charging device 30, and developing device 50 can be replaced with new ones independently, while the process cartridge 95 is removed from the main body 99. This fact also contributes to improvement of the maintenance property. The waste toner tank 38 can also be provided to the process cartridge 95, in which case the maintenance property further improves when it can be independently detached/replaced with respect to the process cartridge 95.

The charging device 30 has a charging roller 31 that abuts against the surface of the photosensitive drum 20 and is driven to rotate, and a cleaning roller 32 functioning as a charging roller cleaner that abuts against the charging roller 31 and is driven to rotate. The charging roller 31 is connected to voltage application means (not shown) for applying alternate-current biases to direct current in an overlapping manner, and in a charging area facing the photosensitive drum 20, the electricity is removed from the surface of the photosensitive drum 20, and at the same time the surface is charged to a predetermined polarity.

The cleaning roller 32 is driven to rotate by the charging roller 31 and thereby cleans the charging roller 31.

In this manner, the present embodiment adopts a charging system using the contact rollers, by the charging system may use adjacent rollers or a scrotron system.

The primary transfer roller 12 is applied with a predetermined voltage suitable for performing primary transfer, by bias application means and bias control means having a power source (not shown). I the primary transfer roller 12, an outer circumferential surface of the transfer belt 11 is brought into weak press-contact with the photosensitive drum 20. A swing mechanism (not shown) swings he primary transfer rollers 12Y, 12C and 12M integrally so as to connect them to or separate them from the photosensitive drums 20Y, 20C and 20M, and swings them to separate them from the photosensitive drums 20Y, 20C and 20M, when a non-color image is formed, that is, when a monochrome image is formed. Consequently, the transfer belt 11 separates from the photosensitive drums 20Y, 20C and 20M.

As shown in FIG. 19, the optical scanning device 8 shown in FIG. 18 irradiates an area between the charging area and developing area on the photosensitive drum 20 with a laser beam that is optically modulated in accordance with image information, exposes the surface of the photosensitive drum 20 charged by the charging roller 31 to light, and forms an electrostatic latent image that is made visible as a toner image of each color by means of the developing device 50.

The cleaning device 40 has a cleaning case 43 that has an opening at a section facing the photosensitive drum 20, a brush roller 45 functioning as a rotating brush that abuts against the photosensitive drum 20 to scrape transfer residual toner, carrier, paper powder, or other unwanted objects on the photosensitive drum 20, to clean the photosensitive drum 20, and a cleaning blade 41 functioning as a cleaning member that is a blade for abutting the photosensitive drum 20 at a position on the downstream side of the brush roller 45 in the rotational direction B1 of the photosensitive drum 20, and scrapes off the unwanted objects on the photosensitive drum 20 to clean the photosensitive drum 20.

The cleaning device 40 also has a discharge screw 42, which configures a part of the waste toner path (not shown) that is supported rotatably by the cleaning case 43 and conveys waste toner or other unwanted objects scraped off and removed by the brush roller 45 and cleaning blade 41 toward the waste toner tank 38.

The cleaning device 40 also has a blade holder 44 functioning as a supporting member for supporting the cleaning blade 41, a supporting part 46 that supports the blade holder 44 displaceably on the cleaning case 43 on the cleaning device 40 main body side, and biasing means 47 for biasing the cleaning blade 41 toward the photosensitive drum 20 via the blade holder 44 such that the cleaning blade 41 comes into press-contact with the photosensitive drum 20.

The rest of the configuration of the cleaning device 40 will be described hereinafter.

The lubricative substance supply device 80 has a case 81 that is opened on the side facing the surface of the photosensitive drum 20, a lubricative substance 82 that is a solid lubricant stored in the case 81 and formed into a bar, and a lubricant supporting member 85 that supports the lubricative substance 82 with respect to the case 81.

The lubricative substance supply device 80 further has a brush roller 83 that is a fur brush functioning as an application member for applying and supplying the lubricative substance 82 to the photosensitive drum 20 by coming into contact with both the lubricative substance 82 and the photosensitive drum 20, and a spring 84 that is a pressure spring functioning as an elastic member for pressing the lubricative substance 82 against the brush roller 83.

The lubricative substance supply device 80 also has an application blade 86 abutting against a leading end part of the photosensitive drum 20 on the downstream side of the abutting position of the brush roller 83 in the B1 direction and the upstream side of the charging area, and an application blade holder 87 supporting the application blade 86 with respect to the case 81.

The lubricative substance supply device 80 rotates the brush roller 83 to scrapes and scoop the lubricative substance 82, carries and conveys the scraped powder-like lubricative substance 82 to the abutting position between the lubricative substance supply device 80 and the photosensitive drum 20, and applies and supplies it to the photosensitive drum 20. The lubricative substance 82 supplied to the photosensitive drum 20 is applied to an even thickness on the surface of the photosensitive drum 20 by the application blade 86.

Even when the lubricative substance 82 is scraped and reduced by the brush roller 83 over time, even a small amount of lubricative substance 82 is constantly scooped up by the brush roller 83 because the spring 84 presses the lubricative substance 82 against the brush roller 83 using a predetermined pressure. Therefore, the lubricative substance 82 is in contact with the brush roller 83 until completely consumed.

A film formed on the surface of the photosensitive drum 20 by the lubricative substance 82 functions to prevent the deterioration of the surface of the photosensitive drum 20 caused by proximate electric discharge, and the lubricative substance supply device 80 functions as electric discharge deterioration means. Deterioration here means abrasion of the photosensitive drum 20 due to the electric discharge, acceleration of the abrasion, and activation of the surface of the photosensitive drum 20.

In addition, the film prevents the abrasion or other deterioration caused by the friction between the photosensitive drum 20 and the cleaning blade 41, and the lubricative substance supply device 80 also functions as friction deterioration prevention means.

In this manner, the lubricative substance supply device 80 applies the lubricative substance 82 to the surface of the photosensitive drum 20 to solve all of the deterioration problems.

In order to utilize these functions favorably, examples of the lubricative substance 82 include higher fatty acid salts, such as lead oleate, zinc oleate, copper oleate, zinc stearate, cobalt stearate, iron stearate, copper stearate, zinc palmitate, copper palmitate, and zinc linolenate, and fluorine resin, such as polytetrafluoroethylene, polychlorotrifluoroethylene, polyvinylidene fluoride, polytrifluorochlorethylene, dichlorodifluoroethylene, tetrafluoroethylene-ethylene copolymer, and tetrafluoroethylene-oxafluoropropylene copolymer. However, especially metallic stearate or zinc stearate that can effectively reduce the frictional coefficient of the photosensitive drum 20 are particularly preferred.

The developing device 50 has a developing case 55 that has an opening at a section facing the photosensitive drum 20, a developing roller 51 functioning as a developer carrier that is disposed to proximately face the photosensitive drum 20 so as to approach the photosensitive drum 20 from the opening, and a developing blade 52 that is a doctor functioning as a regulating member for regulating the height of the developer on the developing roller 51 to a fixed height.

The developing device 50 further has a first conveying screw 53 and second conveying screw 54 functioning as a developer supply member, which are disposed to face each other at a lower part of the developing case 55 and rotated and driven in directions opposite from each other to stir the developer or convey the developer to the developing roller 51, a partition wall 57 provided between the first conveying screw 53 and the second conveying screw 54, and a first storage chamber 58 and second storage chamber 59 that are partitioned by the partition wall 57 and store therein the first conveying screw 53 and the second conveying screw 54 respectively.

The developing device 50 also has a toner hopper 39 supplied with the toners of the toner bottle 9Y, 9C, 9M and 9Bk by the toner supply mechanism and temporarily accumulating these toners therein, a toner concentration detection sensor 56 that is a T sensor functioning as toner concentration detection means that is provided to a bottom part of the first storage chamber 58 and measures the toner concentration within the developer, bias application means (not shown) for applying a direct-current developing bias, developing drive means (not shown) for driving the developing roller 51, and conveyance drive means (not shown) for rotating and driving the first conveying screw 53 and the second conveying screw 54 in directions opposite from each other.

Although not shown, the developing roller has a magnetic roller functioning as magnetic field generation means disposed within the developing roller 51, and a non-magnetic developing sleeve that encapsulates the magnetic roller and is driven in a C1 direction, i.e., the counterclockwise direction in the drawing, by the developing drive means.

The magnetic roller has a plastic roller fixed to the developing case 55, and a magnetic block configured by a plurality of magnets for forming a plurality of magnetic poles embedded in the plastic roller.

The developing sleeve is rotatably supported by the developing case 55 and the magnetic roller. An appropriately large developing bias is applied between the developing sleeve and the photosensitive drum 20 by the bias application means. A developing gap, a gap between the developing sleeve and the photosensitive drum 20 in a developing area, is set at 0.3±0.05 mm.

The developing blade 52 is made of an SUS material. A doctor gap, a gap between the developing sleeve and the developing blade 52, is set at 0.5±0.04 mm.

The developer is a two-component developer having the toner and carrier. The developer will be described hereinafter in detail. Here, only the carrier is described and the toner will be described in detail later.

The carrier has a core material and a resin covering layer formed on the surface of the core material. The resin covering layer contains a conducting particle that is provided with a conductive covering layer consisting of a tin dioxide layer on a base particle surface and an indium oxide layer having the tin dioxide of the tin oxide layer.

The conducting particle is formed such that the oil absorption amount thereof becomes 10 to 300 ml/100 g.

The oil absorption amount of the conducting particle is measured based on "21 oil absorption amount" in the JIS-K5101 "pigment test method."

As the base particle of the conducting particle, at least one of aluminum oxide, titanium dioxide, zinc oxide, silica dioxide, barium sulfide, and zirconium oxide. The powder specific resistance of the conducting powder is 200 Ω·cm or lower.

In addition to the conducting particle, a non-conducting particle is contained in the resin covering layer.

The volume specific resistance of the carrier is set within the range of 10 to 16 Log(Ω·cm).

In the carrier, the tin dioxide layer and the indium oxide layer containing tin dioxide are sequentially formed in the surface of the base particle, and therefore a conductive layer is fixed to the particle surface uniformly and strongly.

When the oil absorption amount of the conducting particle contained in the resin covering layer is less than 10 ml/100 g, the compatibility between the conducting particle and the covering resin decreases, degrading the adhesiveness and dispersibility. As a result, it might not be able to adjust the resistance of the carrier for a long period of time. When the oil absorption amount exceeds 300 ml/100 g, the adhesiveness between the conducting particle and the binding resin increases excessively. As a result, the surface of the conducting powder is covered, and the resistance cannot be adjusted sufficiently. However, in the present embodiment, the conducting particle contained in the resin covering layer is formed such that the oil absorption amount thereof becomes 10 to 300 ml/100 g, such thing can be prevented.

The resistance of the carrier configured as described above can be adjusted stably over time, without containing carbon black or the like as the resistance adjuster, and the toner charge amount can be stabilized over time while preventing the adhesion of the carrier.

The weight average particle diameter of the carrier is preferably within the range of 20 to 65 μm, and is 35 μm in the present embodiment. The weight average particle diameter of the carrier is preferably within the range of 20 to 65 μm, because, when it is smaller than 20 μm, the magnetic force acting on each carrier decreases, causing the carrier adhesion, and when it is larger than 65 μm, the toner cannot adhere to the latent image faithfully, and consequently the graininess of the output image decreases.

The toner concentration within the developer is controlled within the range of 4 to 12 wt % based on the detection performed by the toner concentration detection sensor 56. When the toner concentration decreases as the toner is consumed during development and the toner concentration detection sensor 56 detects that the toner concentration falls below 4%, a predetermined amount of toner is replenished from the toner hopper 39 to the second storage chamber 59.

The first conveying screw 53 and the second conveying screw 54 are disposed so as to extend in a direction perpendicular to the page of FIG. 2, which is a width direction of the developing roller 51, i.e, a longitudinal direction of the developing roller 51.

The first conveying screw 53 is rotated and driven by the conveyance drive means, and thereby supplies the developer contained in the first storage chamber 58 to the developing roller 51 while conveying it from the far side of the page of FIG. 3 toward the near side of the same. In this regard, the first conveying screw 53 functions as a developer supply screw. The developer that is conveyed by the first conveying screw 53 to the vicinity of an end part of the first storage chamber 58 enters the second storage chamber 59 via an opening (not shown) formed in the partition wall 57.

In the second storage chamber 59, the second conveying screw 54 is rotated and driven by the conveyance drive means, and thereby conveys the developer sent from the first storage chamber 58, in a direction opposite to that of the first conveying screw 53. At this moment, when the toner is replenished from the toner hopper 39, the second conveying screw 54 conveys the replenished toner while stirring and mixing it within the developer. The developer that is conveyed by the second conveying screw 54 to the vicinity of an end part of the second storage chamber 59 returns to the first storage chamber 58 via another opening (not shown) provided in the partition wall 57.

The toner that is supplied in this manner is stirred and mixed with the developer while conveyed by the first conveying screw 53 and the second conveying screw 54, subjected to friction charging, and supplied and carried by the developing roller 51.

The developing roller 51 on which the amount and thickness of the carried developer are regulated by the developing blade 52 conveys the developer to the developing area between the developing roller 51 and the photosensitive drum 20 by rotating and using the developing bias applied by the bias application means, the amount of the developer being adjusted by the developing blade 52. The toner of the corresponding color within the developer is electrostatically shifted to an electrostatic latent image formed on the surface of the photosensitive drum 20, and the electrostatic latent image is made visible as the toner image of the corresponding color.

The developer having the toner consumed during development is returned to the developing device 50 as the developing roller 51 rotates.

In the present embodiment, the bias application means applies a direct-current developing bias, but the developing bias may be an alternate-current developing bias, or a developing bias obtained by overlapping a direct current and alternate current.

As described above, in the developing device 50, the developer that is stirred and conveyed by the first conveying screw 53 and the second conveying screw 54 is scooped by the magnetic force of the magnetic roller, carried by the developing sleeve, and conveyed to the developing area facing the photosensitive drum 20. The toner is then supplied to the latent image on the photosensitive drum 20 and developed or made visible. The developer having the toner consumed after the development is released from the surface of the developing sleeve into the first storage chamber 58, stirred with the developers of the first storage chamber 58 and second storage chamber 59 by the first conveying screw 53 and second conveying screw 54, and scooped up again by the developing sleeve surface. This cycle is repeated.

In each image station 60 with the configuration described above, the surface of the photosensitive drum 20 is charged by the charging roller 31 while rotating in the B1 direction that is started once a print command is issued. The photosensitive drum 20 is then subjected to exposure scanning of a laser beam L that is optically modulated in response to input color image data and emitted by the optical scanning device 8, and then forms an electrostatic latent image of each color. The electrostatic latent image is developed by the developing device 50 by means of the toner of each color, whereby a toner image of each color is obtained. The primary transfer roller 12 applies a transfer voltage of opposite polarity to the polarity of the toner image, whereby a transfer magnetic field is formed. The primary transfer roller 12 also weakly press-contacts the transfer belt 11 to form a primary transfer nip. The toner image of each color is primarily transferred efficiently to the transfer belt 11 moving in the A1 direction, by the action of the weak press-contact force between these transfer electric fields. On the transfer belt 11, unwanted objects including the toner remaining after the transfer is favorably removed by the cleaning device 40, and the subsequent electricity removal and charging are performed by the charging roller 31.

In each photosensitive drum 20, a toner image of each color is similarly formed, and the formed toner image of each color is primarily transferred sequentially by the primary transfer rollers 12C, 12M, and 12Bk to the same position on the transfer belt 11 moving in the A1 direction. The toner images of the respective colors that are stacked on the transfer belt 11 are moved to the secondary transfer nip facing the secondary transfer roller 5 as the transfer belt 11 rotates in the A1 direction. A transfer voltage of opposite polarity to the polarity of each toner image is applied by the secondary transfer roller 5, and the toner images are secondarily transferred to the transfer sheet S by the transfer electric field formed by the transfer voltage.

The transfer sheet S that is conveyed to the space between the transfer belt 11 and the secondary transfer roller 5 is delivered and fed from the sheet feeding device 61 by the sheet feeding roller 3, and sent by the resist roller pair 4 based on a signal detected by the sensor, at a timing when the leading end part of the toner image on the transfer belt 11 faces the secondary transfer roller 5.

The transfer sheet S is transferred when the toner images of all colors are stacked thereon. Once the toner images are carried on the transfer sheet S, the transfer sheet S enters the fixing device 6, and the toner images are fixed thereto by the action of heat and pressure when the transfer sheet S passes through the fixing part between the pressure roller 63 and the belt unit 62, whereby a color image is formed on the transfer sheet S. The transfer sheet S that has passed through the fixing device 6 passes through the discharge roller 7 and is placed on the discharge tray 17 located in the upper part of the main body 99. On the other hand, the transfer belt 11 after the secondary transfer is cleaned by the cleaning brush and the cleaning blade of the cleaning device 13 by scraping the toner, and is prepared for the next image formation.

During this image formation step, because the yellow, cyan, magenta and black toners are consumed in the developing devices 50Y, 50C, 50M and 50Bk, the toner supply mechanism supplies a predetermined replenishment amount of yellow, cyan, magenta and black toners from the toner bottles 9Y, 9C, 9M and 9Bk to the developing devices 50Y, 50C, 50M and 50Bk respectively, as described above.

The cleaning device 40 will now be described hereinafter with reference to FIG. 20 and subsequent drawings.

Figure 20:
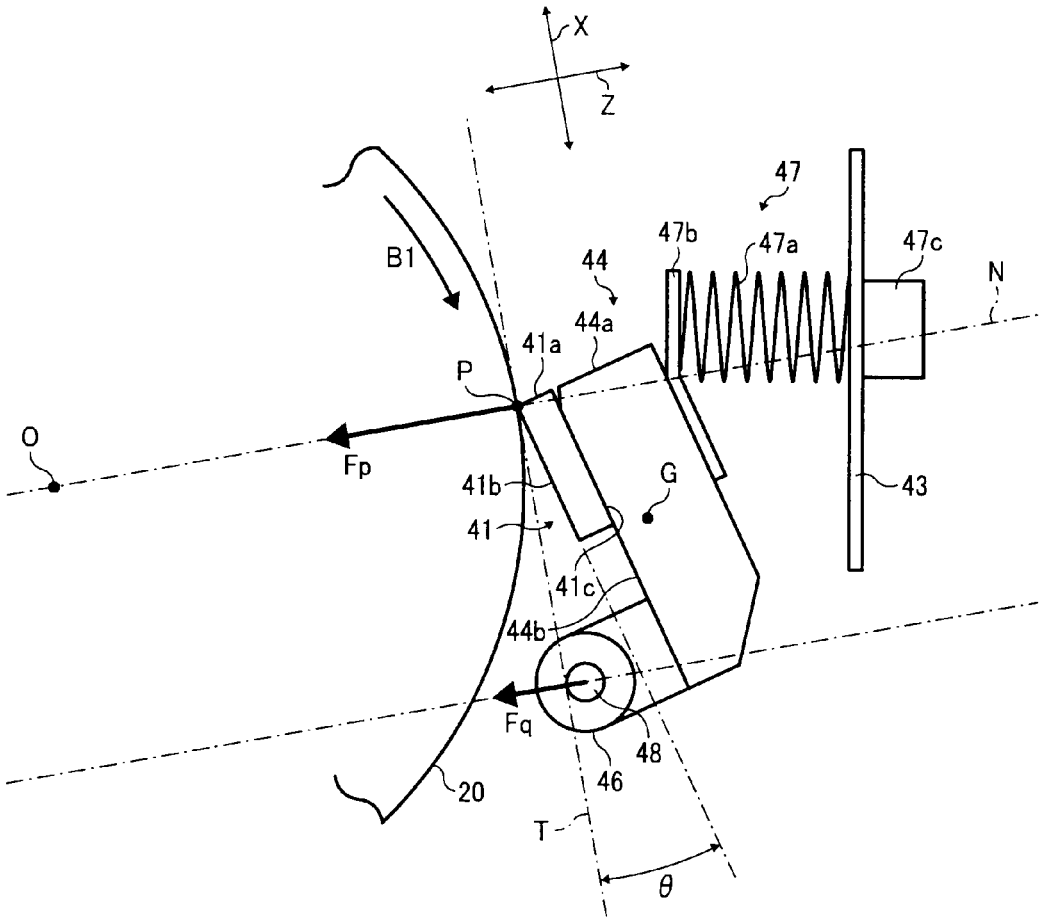
FIG. 20 is a diagram showing a schematic configuration of the inside of substantial parts of the cleaning device.
Figure 21:
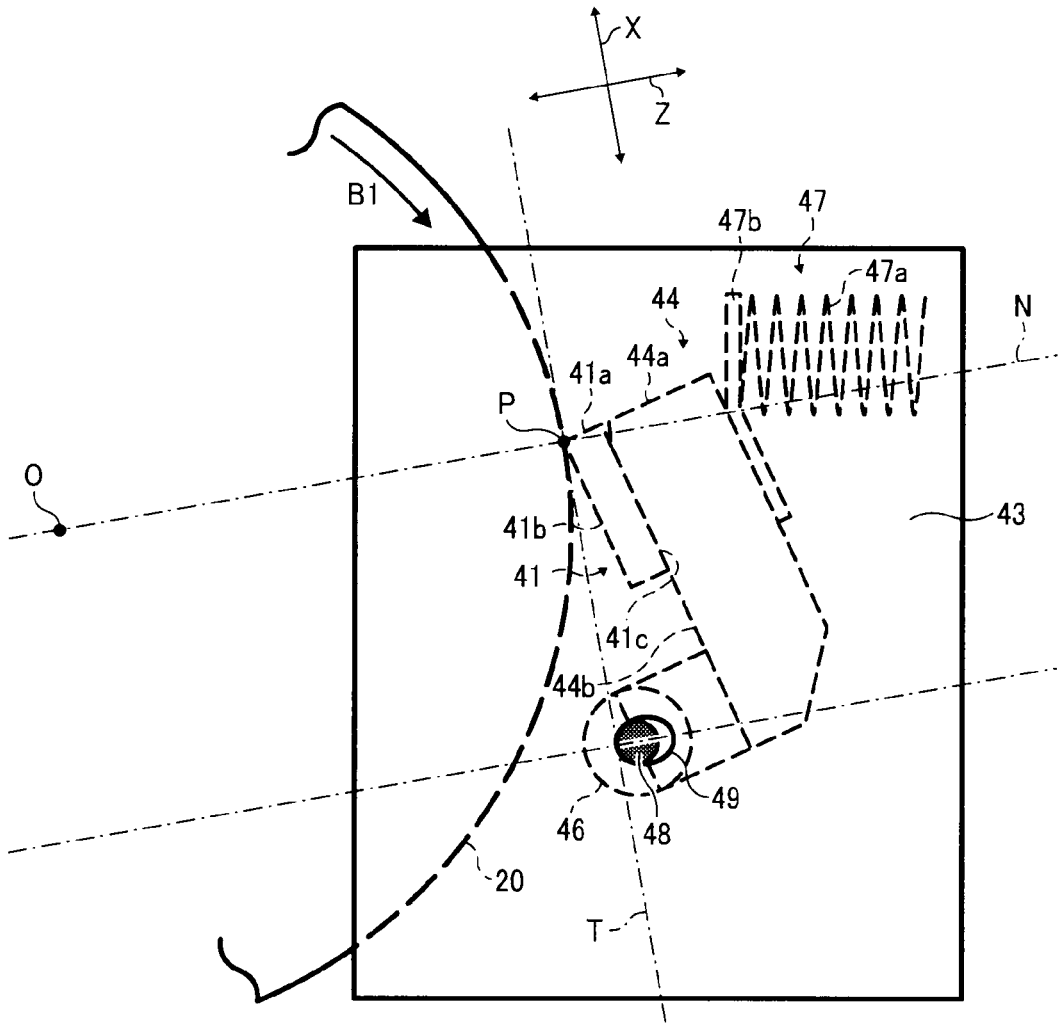
FIG. 21 is a diagram showing the exterior of the substantial parts of the cleaning device.
Figure 22:
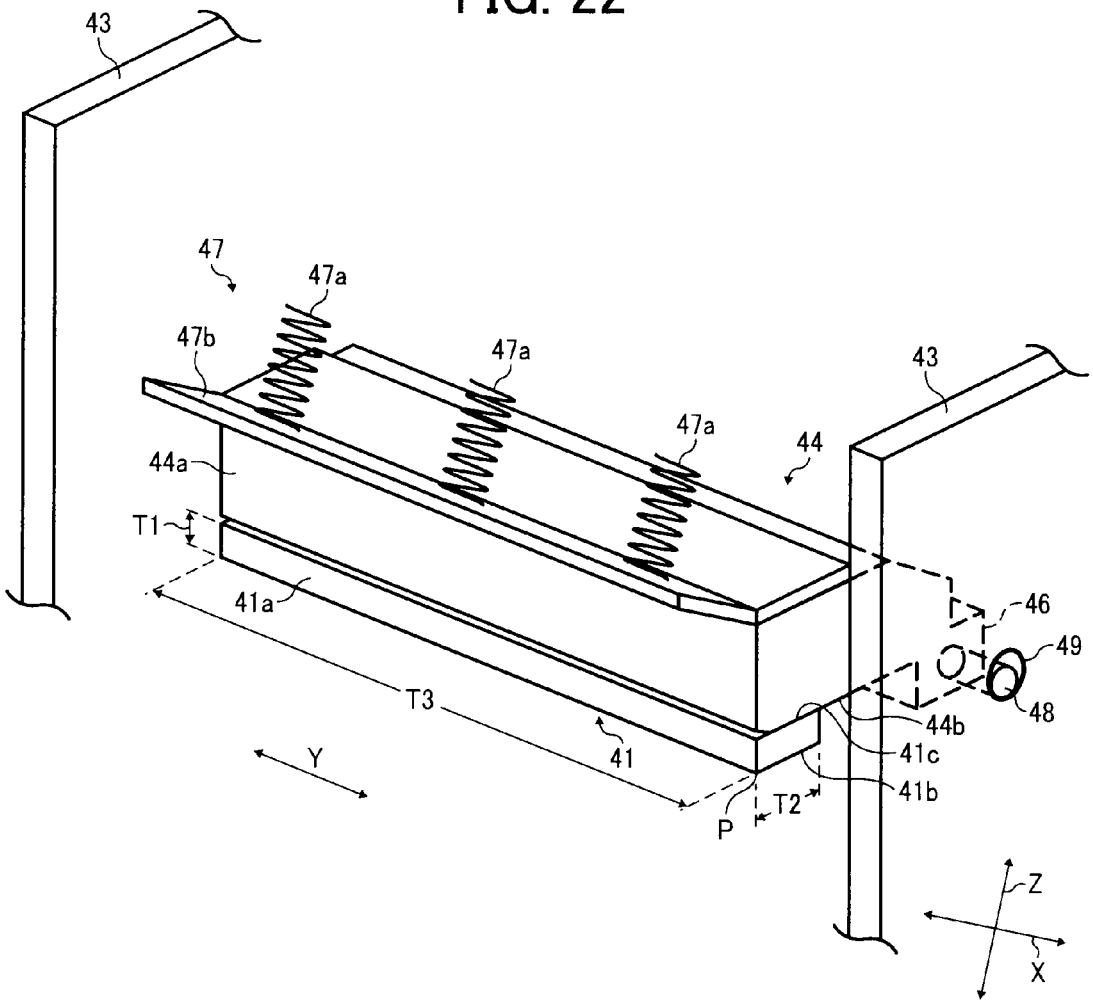
FIG. 22 is a perspective view showing a schematic configuration of the substantial parts of the cleaning device.

As shown in FIGS. 20 to 22, the cleaning blade 41 is a long plate-shaped member that extends in the rotational direction of the photosensitive drum 20, which is a direction perpendicular to the pages of FIGS. 20 and 21, i.e., a Y direction perpendicular to the B1 direction. As shown in FIG. 22, the cleaning blade 41 is in the form of a rectangular solid in which the lengths of the sides are indicated as T1, T2 and T3 when no load is applied thereto. In the cleaning blade 41, one side P thereof, which extends in the Y direction or the longitudinal direction and configured by an angle positioned in an end part on the leading end side facing the photosensitive drum 20 is obtained as an abutting side facing the photosensitive drum 20. The cleaning blade 41 also comes into press-contact with the surface of the photosensitive drum 20 to remove the unwanted objects on the surface of the photosensitive drum 20. Note that the cleaning blade 41 removes the lubricative substance 82, which is applied to the photosensitive drum 20, from the surface of the photosensitive drum 20 along with the unwanted objects, and at the same time spreads the lubricative substance 82 over the surface of the photosensitive drum 20 to form a lubricant film.

The cleaning blade 41 has two surfaces 41*a*, 41*b* facing the photosensitive drum 20 with the side P therebetween. Therefore, the side P forms a ridge line of the surfaces 41*a*, 41*b*. Out of the surfaces 41*a*, 41*b*, the surface 41*a* is the upstream side surface in the B1 direction, and the surface 41*b* the downstream side surface. The surfaces 41*a*, 41*b* take the side P as the long side having the length T3, and the short sides have the lengths T1, T2 respectively.

In the present embodiment, T1=2 mm, T2=7 mm, and T3=325, but the lengths T1, T2 and T3 are not limited thereto. However, it is preferred that T3>T2≧T3 be satisfied, and it is more preferred that T1≧1 mm or more and T1≦T2/2 be satisfied.

The cleaning blade 41 is an elastic member and is made of polyurethane rubber that is more excellent in abrasion property and abrasion resistance against the photosensitive drum 20, compare to other elastic materials.

The blade holder 44 has two surface 44*a*, 44*b* facing the photosensitive drum 20 along the B1 direction. Out of the surfaces 44*a*, 44*b*, the surface 44*a* is the upstream side surface in the B1 direction, and the surface 44*b* the downstream side surface. The blade holder 44 holds a surface 41*c* on the other side of the surface 41*b* of the cleaning blade 41, by means of the surface 44*b*.

The blade holder 44 is formed by a metallic material having iron as the main component, and has high rigidity that is required for sufficiently preventing the distortion of the cleaning blade 41 even when receiving a force from the photosensitive drum 20 from the press-contact state between the cleaning blade 41 and the photosensitive drum 20 during the rotary drive of the photosensitive drum 20. The blade holder 44 functions as an elastic holding member when holding the cleaning blade 41.

The supporting part 46 is integrally molded with the blade holder 44, and has a shaft 48 functioning as an engagement part projected in the Y direction. The shaft 48 is rotatably supported by a bearing 49 functioning as an engaged part provided in the cleaning case 43. The position where the shaft 48 is supported by the bearing 49, that is, the position where the cleaning blade 41 is supported by the supporting part 46, is located on the downstream side in the B1 direction in relation to the normal line N of the side P perpendicular to the tangential line T of the photosensitive drum 20. Therefore, the cleaning blade 41 abuts against the photosensitive drum 20 in the form of a counter type cleaning device.

In FIGS. 20 to 22, a X direction is a direction parallel to the tangential line T, and a Z direction a direction parallel to the normal line N. The X direction, Y direction and the Z direction are perpendicular to each other. In FIGS. 22 and 21, reference numeral O represents the rotation central position of the photosensitive drum 20, and reference numeral G the gravity center when the cleaning blade 41, blade holder 44 and supporting part 46 are integrated.

The biasing means 47 has three springs 47*a*, each of which functions as a biasing member which is disposed in the Y direction and whose one end is fixed to the cleaning case 43, a plate 47*b* functioning as a biasing part, one surface of which is fixed to the other end of each spring 47*a* and the other surface to the blade holder 44, and biasing force adjusting means 47*c*, one end of which is connected to each spring 47*a* and which adjusts the biasing force generated by the biasing means 47.

The biasing means 47 biases the cleaning blade 41 via the blade holder 44 at a position where the pressing force Fp applied by the one side P to the photosensitive drum 20 along the Z direction becomes greater than the pressing force Fq applied by the supporting part 46, i.e., the shaft 48, to the cleaning case 43 on the cleaning device 40 main body side long the Z direction in the bearing 49 serving as the member on the cleaning device 40 main body side. This position is on the upstream side in the B1 direction from a straight line (not shown) passing through the gravity center G and parallel to the normal line N. The biasing means 47 biases with a uniform force in the Y direction by means of the three springs 47*a* arranged in the Y direction.

The aspect in which the cleaning blade 41 is supported by the blade holder 44 is described.

Supposed that the free length of an end part of the side P of the cleaning blade 41 is long or zero. As described above, when the free length is zero, even if a high pressure is used to bring the cleaning blade 41 into abutment against the photosensitive drum 20, the cleaning blade 41 distorts, and the contact area between the cleaning blade 41 and the photosensitive drum 20 increases. As a result, the abutment pressure of the cleaning blade 41 against the photosensitive drum 20 might decrease. When the free length is zero, the followability of the cleaning blade 41 to the decentering and rotating photosensitive drum 20 is reduced, and the cleaning blade 41 cannot evenly abut against the photosensitive drum 20 in the Y direction. As a result, it might become difficult to ensure a uniform cleaning performance in the Y direction and the B1 direction.

Figure 23:
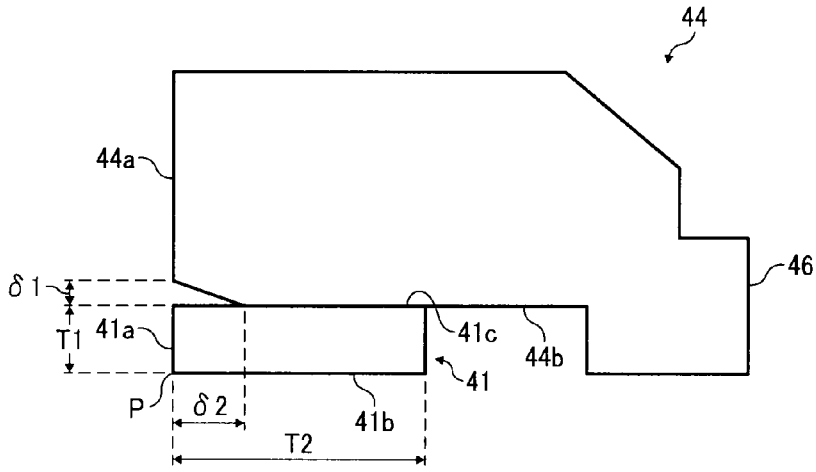
FIG. 23 is a conceptual diagram showing a support aspect obtained by a supporting member of a cleaning member provided in the cleaning device.
Figure 24B:
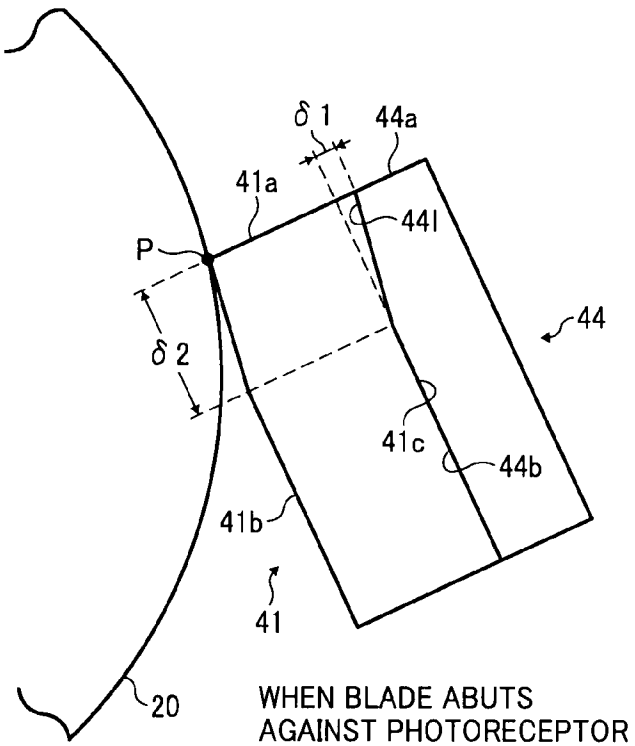
FIGS. 24A and 24B are diagrams schematically showing a change of shape that is generated when the cleaning member abuts or does not abut against a surface moving member.
Figure 24A:
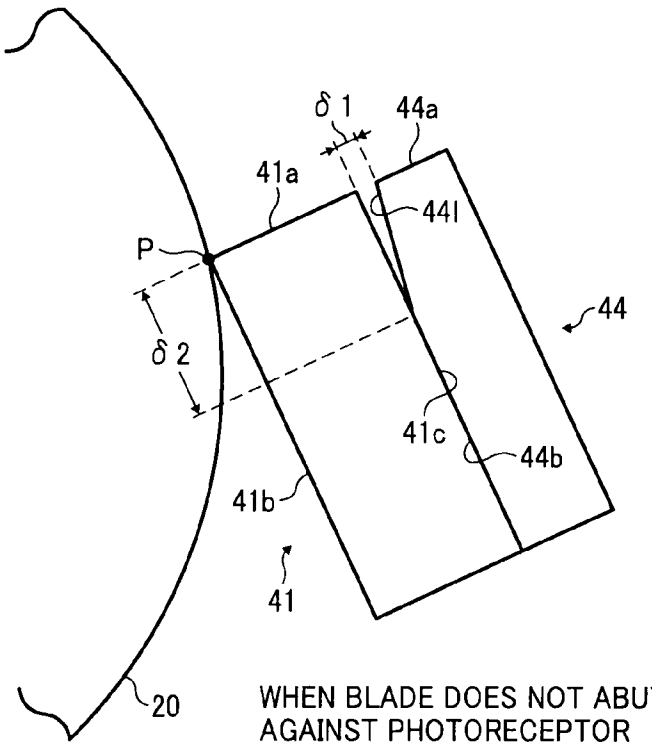

Therefore, as shown in FIGS. 23, 24A and 24B, the blade holder 44 supports a base end to regulate warpage of the cleaning blade 41 when the cleaning blade 41 abuts against the photosensitive drum 20, so that the free length of the end part of the side P becomes substantially zero, and further supports substantially the entire cleaning blade 41, except for a small section on the end part of the side P. The end part is separated from the blade holder 44 when the cleaning blade 41 does not abut against the photosensitive drum 20 as shown in FIG. 24A, but warps slightly in substantially the Z direction and abuts against the blade holder 44 from the base end part side to the side P when the cleaning blade 41 abuts against the photosensitive drum 20 as shown in FIG. 24B. A section other than the section having substantially zero free length does not warp. The surface 41*a* is substantially flush with the surface 44*a*. Note that in FIGS. 23, 24A and 24B, the section where the free length of the blade 41 is substantially zero is stretched and made longer than the actual size.

Consequently, a large warpage of the cleaning blade 41 is regulated, and the blade holder 44 abuts against a slightly warped section of the end part of the side P of the cleaning blade 41 to exhibit a backup function, and the cleaning blade 41 functions as the member having a free length of substantially zero. As a result, the biasing force applied by the biasing means 47 acts on the side P so as not to reduce the contact pressure. Even when the toner adhering to the photosensitive drum 20 is reduced in its diameter or spheronized as described hereinafter, good cleaning performance and the followability to the photoreceptor drum 20 can be exhibited. The abutment pressure Fp of the side P can be made uniform, and the adhesiveness to the photosensitive drum 20 can be improved. Further, the cleaning blade 41 uniformly abuts against the photosensitive drum 20 in the Y direction, and as a result uniform cleaning performance can be secured in the Y direction and the B1 direction.

Next described height δ1 in a direction along the length T1, and length δ2 in a direction along the length T2, in the section of the end part of the side P of the cleaning blade 41 where the free length is substantially zero, when the cleaning blade 41 is not in abutment against the photosensitive drum 20.

The height δ1 and length δ2 in this gap are set accordingly based on the hardness, Young's modulus and thickness of the cleaning blade 41 to be used, the biasing force applied by the biasing means 47, and the frictional force acting between the photosensitive drum 20 and the cleaning blade 41, and are set within the range capable of maintaining a high press-contact force, which is the main effect of the cleaning blade 41 that, unlike a conventional cleaning blade with a long free length, does not cause a large warpage during pressurization.

For example, when attaching the cleaning blade 41 to the blade holder 44, the height in the Z direction fluctuates by approximately 0.05 mm in the Y direction, because the lengths of the cleaning blade 41 and the blade holder 44 are long in the Y direction. In order to absorb such fluctuation using the warpage of the end part of the side P of the cleaning blade 41, it is necessary to generate a warpage of approximately 0.1 mm. The larger the warpage, the easier to absorb the fluctuation. However, when the warpage is large, the contact area between the cleaning blade 41 and the photosensitive drum 20 increases and consequently the contact pressure decreases. For this reason, it is necessary to generate a minimum necessary warpage.

Therefore, when, for example, the cleaning blade 41 has a JISA hardness of 65 to 80 degrees and has a thickness of 2 mm as described above, the range where δ1=0.1 to 1.0 mm and δ2=0.5 to 2.0 mm increases the margin of abutment between the cleaning blade 41 and the photosensitive drum 20, as a result, robust cleaning performance can be obtained.

Figure 25:
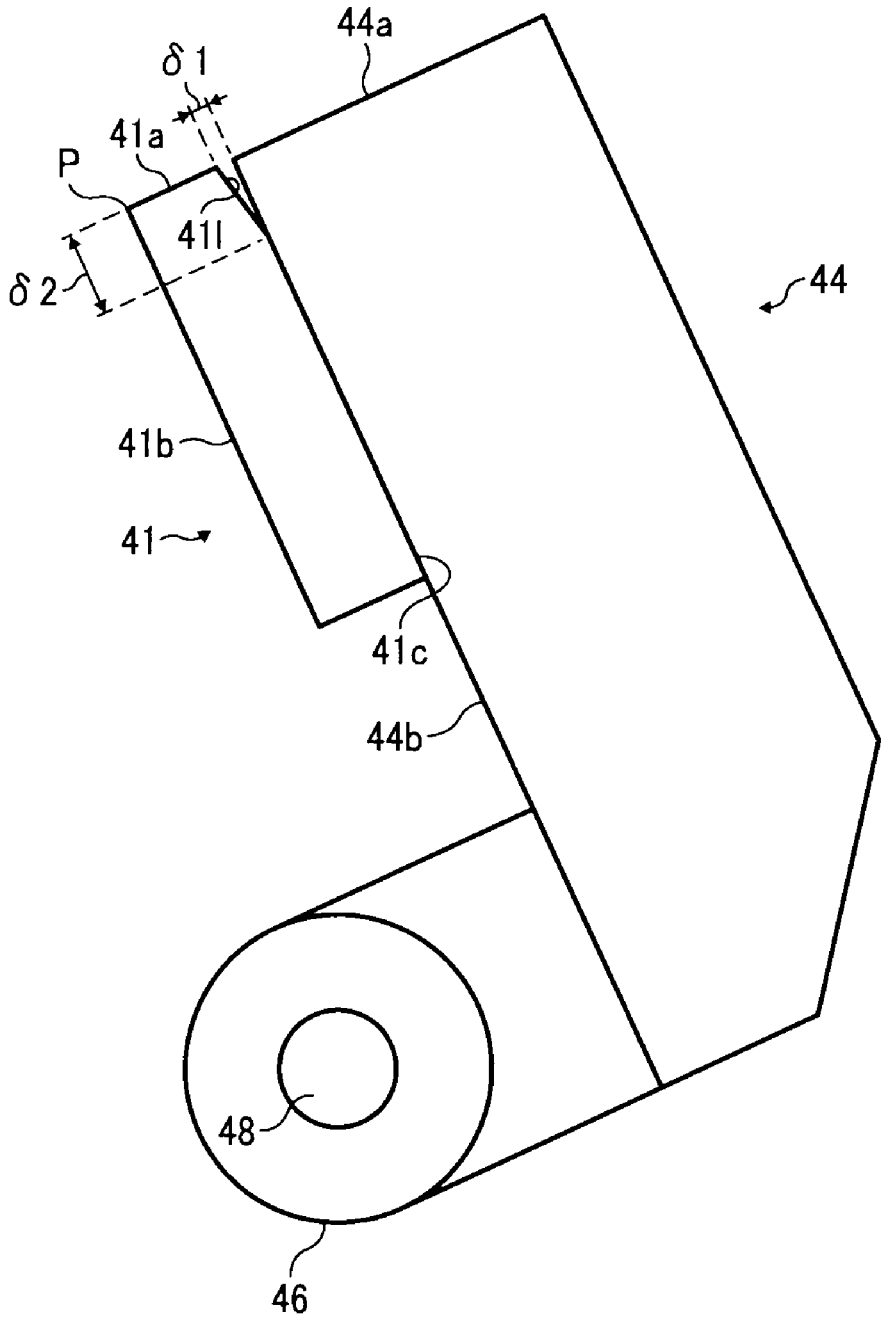
FIG. 25 is a schematic diagram showing another support aspect obtained by the supporting member of the cleaning member provided in the cleaning device.

In the present embodiment, when the cleaning blade 41 is not in abutment against the photosensitive drum 20, the shape of the space between the separated cleaning blade 41 and blade holder 44 at the end part of the side P of the cleaning blade 41 is in the form of a wedge where the surface 41*a* and 44*a* are opened, by forming an angle part on the surface 44*a* side of the blade holder 44 into a chamfered step part 441, as shown in FIG. 24A. When the cleaning blade 41 is in abutment against the photosensitive drum 20, the entire end part of the side P of the cleaning blade 41 abuts against the blade holder 44, from the base end part of the cleaning blade 41 to the side P, as shown in FIG. 24B. Such wedge-shaped space may be formed by forming the angle part on the surface 41*a* side of the cleaning blade 41 into the chamfered step part 411, as shown in FIG. 25. In this case as well, as shown in FIG. 24B, the entire end part of the side P of the cleaning blade 41 abuts against the blade holder 44, from the base end part of the cleaning blade 41 to the side P.

Figure 26B:
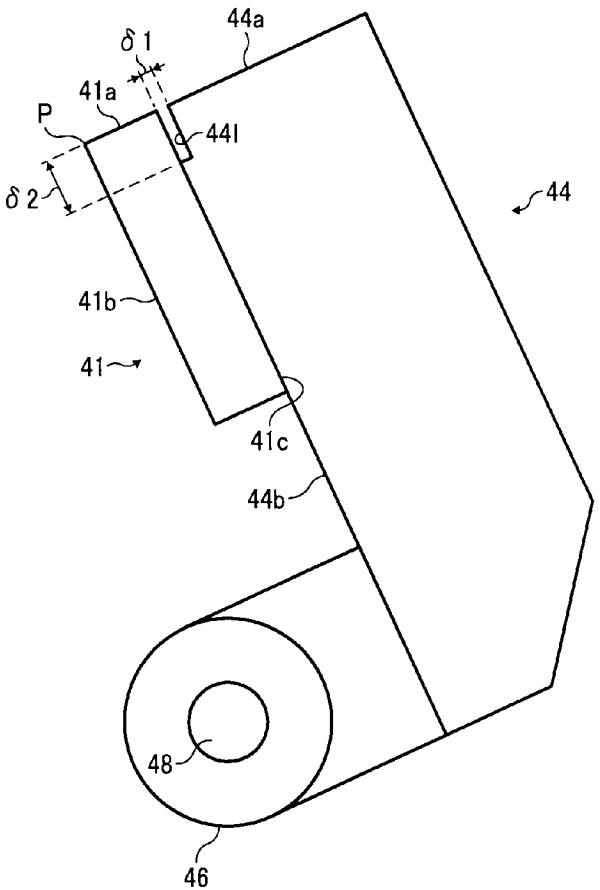
FIGS. 26A and 26B are schematic diagrams showing yet another support aspect obtained by the supporting member of the cleaning member provided in the cleaning device.
Figure 26A:
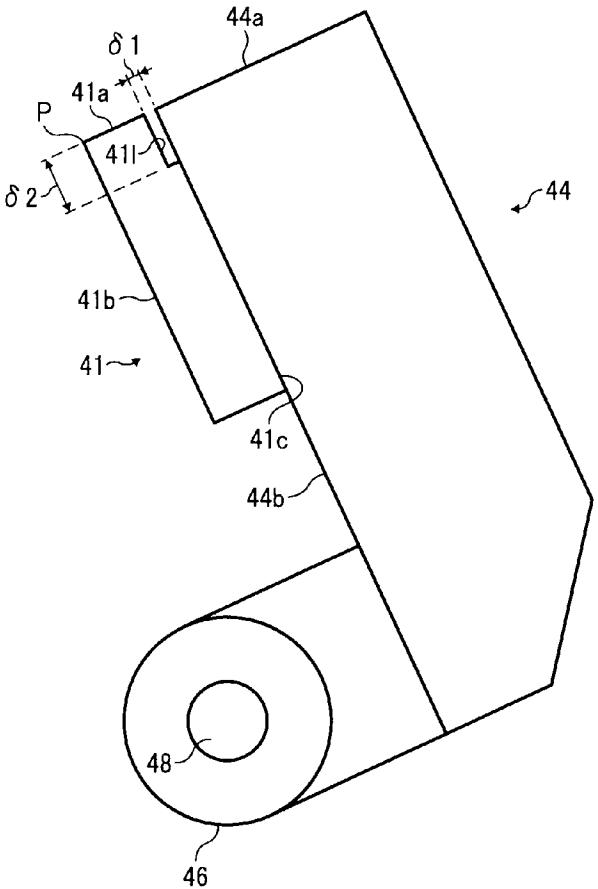

The shape of the space may not be limited to the wedge, and thus may be in a rectangular shape, as shown in FIGS. 26A and 26B. FIG. 26A shows an example of forming the rectangular space by providing the square step part 441 to the blade holder 44. FIG. 26B shows an example of forming the rectangular space by providing the square step part 411 to the cleaning blade 41. Although not shown, the rectangular space may be provided to both the step part 411 and the step part 441. In a case where the space is formed into a rectangle, when the cleaning blade 41 abuts against the photosensitive drum 20, the cleaning blade 41 and the blade holder 44 are separated in a small section on the base end part side of the cleaning blade 41 in the space, but substantially the entire end part of the side P of the cleaning blade 41 abuts against the blade holder 44, from the base end part to the side P.

Figure 27:
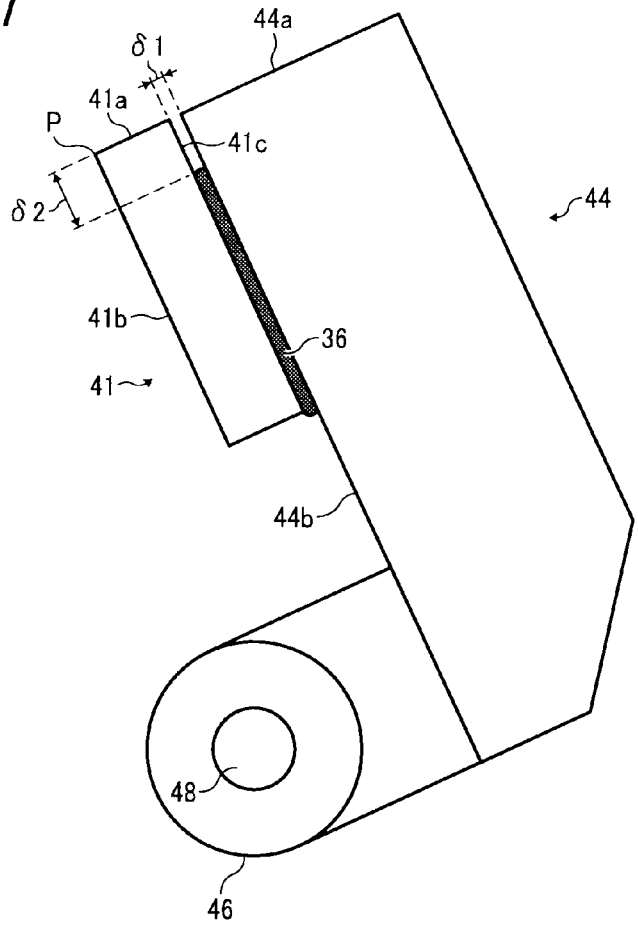
FIG. 27 is a schematic diagram showing still another support aspect obtained by the supporting member of the cleaning member provided in the cleaning device.

As shown in FIG. 27, this separated state may be formed by an adhesive layer 36 functioning as an integrated layer for integrating the cleaning blade 41 and the blade holder 44. Because the conventional hot-melt method is used in which an adhesive is used to integrate the cleaning blade 41 and the blade holder 44, adhesive non-application areas are formed on the surfaces 41*a*, 44*b* and the separated state is formed by utilizing the thickness of the adhesive. Note that the cleaning blade 41 and the blade holder 44 may be integrated by an adhesive that is not used in the hot-melt method. The adhesive layer 36 may be formed using a double-sided adhesive tape.

In the configuration examples shown in FIGS. 24A, 24B, 25, 26A and 26B, the cleaning blade 41 and the blade holder 44 are integrated by applying an adhesive to a part of or the entire adhesive surface of the cleaning blade 41 and causing the cleaning blade 41 and the blade holder 44 to adhere to each other. Whether to use the hot-melt method to perform adhesion using the adhesive is appropriately selected. In the configuration examples shown in FIGS. 24A, 24B, 25, 26A and 26B as well, the cleaning blade 41 and the blade holder 44 are integrated using the double-sided adhesive tape.

However, in any of the configuration examples, fixation processing is preferably carried out on at least the boundary between the abovementioned space between the cleaning blade 41 and the blade holder 44 and the section that needs to adhere them, when the cleaning blade 41 is not in abutment against the photosensitive drum 20. By performing the fixation on the boundary, the fluctuation on the cleaning blade 41 can be stably prevented even when the frictional force between the cleaning blade 41 and the photosensitive drum 20 changes for some reason during the rotary drive of the photosensitive drum 20, whereby the cleaning property can be secured. The cleaning blade 41 and the blade holder 44 may be integrated by a method other than the above-described method.

Incidentally, when the abovementioned gap is provided between the cleaning blade 41 and the blade holder 44 when the cleaning blade 41 is not in abutment against the photosensitive drum 20, as described above, the backup function of the cleaning blade 41 is exhibited, the biasing force applied by the biasing means 47 acts on the side P so as not to reduce the contact pressure, favorable cleaning performance is exhibited, a certain degree of followability to the photosensitive drum 20 is exhibited, and uniform cleaning property in the Y direction and the B1 direction is secured. However, for example, when the part accuracy or assembly accuracy is poor, the distance between the cleaning blade 41 and the photosensitive drum 20 varies at one end and the other end in the Y direction, whereby an appropriate abutment state cannot be maintained between the cleaning blade 41 and the photosensitive drum 20 in the Y direction. As a result, in an extreme case, in some sections the cleaning blade 41 and the photosensitive drum 20 do not abut against the other in the Y direction.

Therefore, in the cleaning device 40, not only the abovementioned space but also the support of the bearing 49 supporting the shaft 48 is provided with a certain degree of freedom, so that the cleaning blade 41 and the blade holder 44 can be displaced with respect to the cleaning case 43. Moreover, as described above, the biasing means 47 biases the cleaning blade 41 so that the pressing force Fp becomes greater than the pressing force Fq.

Next is described a configuration in which a certain degree of freedom is provided to the support of the bearing 49 supporting the shaft 48, that is, to the engagement between the shaft 48 and the bearing 49, so as to make the cleaning blade 41 and the blade holder 44 displaceable with respect to the cleaning case 43.

Figure 28:
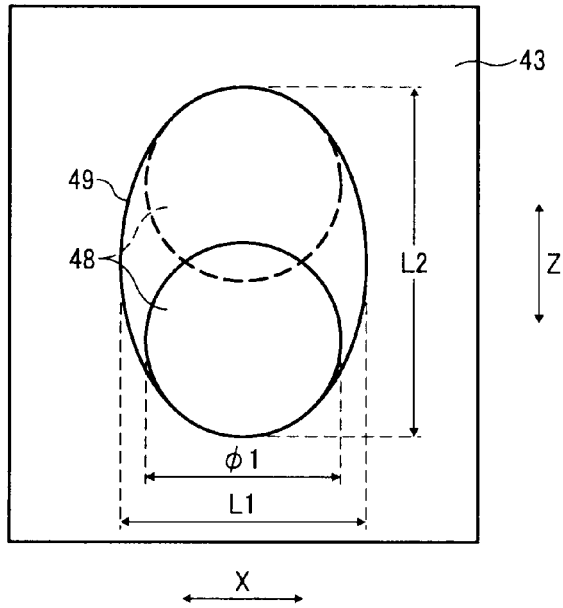
FIG. 28 is a schematic diagram showing a support aspect obtained by a supporting part of the supporting member provided in the cleaning device.

As shown in FIGS. 21, 22 and 28, the main purpose of this configuration is to eliminate or inhibit the unevenness of the distance between the cleaning blade 41 and the photosensitive drum 20 in the Y direction. Therefore, the bearing 49 supports the shaft 48 so that the certain degree of freedom is provided to at least the Z direction, with the certain degree of freedom in the Z direction that is, with a fluctuation caused in the Z direction.

Examples of the shape of a shaft hole of the bearing supporting the shaft 48 include a long hole having a long axis in a direction substantially parallel to the Z direction, and a round hole, but the long hole is adopted in the present embodiment.

The shaft 48 is a stainless round rod having a high rigidity. The diameter Φ1 of the round rod shown in FIG. 28 is 15±0.05 [mm]. Normally, in order not to cause a fluctuation in the engagement between the shaft 48 and the bearing 49, the shaft hole of the bearing 49 is formed into a round and the diameter Φ2 thereof is 15.10±0.05 [mm]. In the present embodiment, however, because the shape of the shaft hole of the bearing 49 is a long hole, the length L1 of the short axis thereof is 15.10±0.05 [mm], and the length L2 of the long axis is 15.65±0.05 [mm]. The length L2 is made greater than the length L1 by 0.5 [mm], because when accumulating fluctuations or tolerances of dimensional accuracy of the cleaning blade 41, blade holder 44, shaft 48 or bearing 49, attachment accuracy of the cleaning blade 41 and blade holder 44, and positional accuracy of the photosensitive drum 20 and cleaning device 40, the accumulation tolerance becomes ±0.5 [mm]. Further, the length L2 is set to 15.65±0.05 [mm] so that the space between the center of the shaft 48 when the shaft 48 is in the uppermost area on the long axis and center of the shaft 48 when the shaft 48 is in the lowermost area on the long axis becomes 0.65±0.05 [mm], which is greater than the tolerance, when the accumulation tolerance is ±0.5 [mm].

Figure 29B:
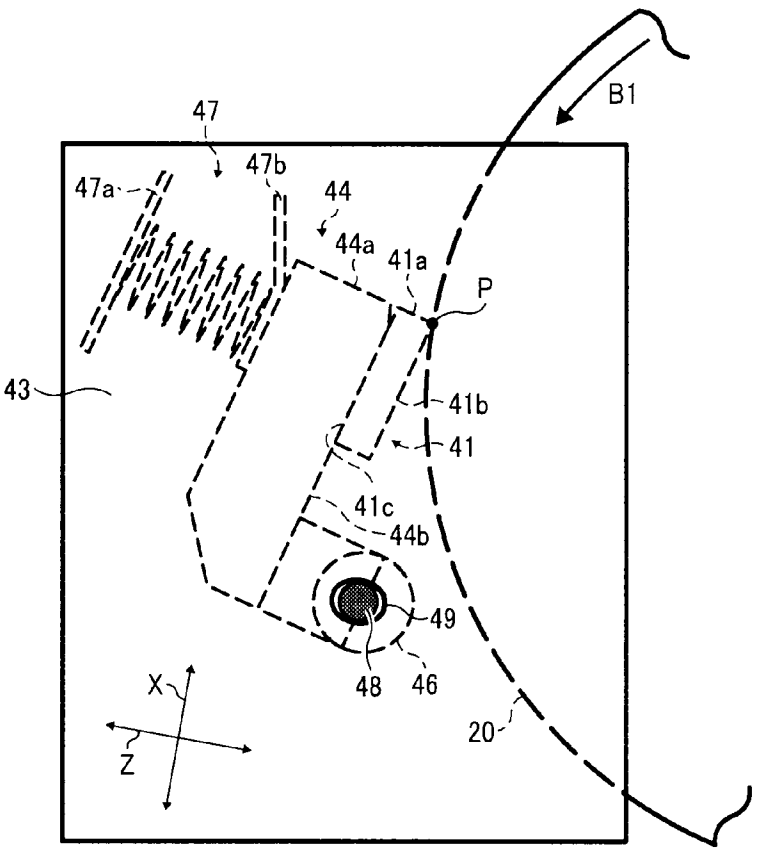
FIGS. 29A and 29B are diagrams showing a support aspect obtained by the supporting part of the supporting member provided in the cleaning device.
Figure 29A:
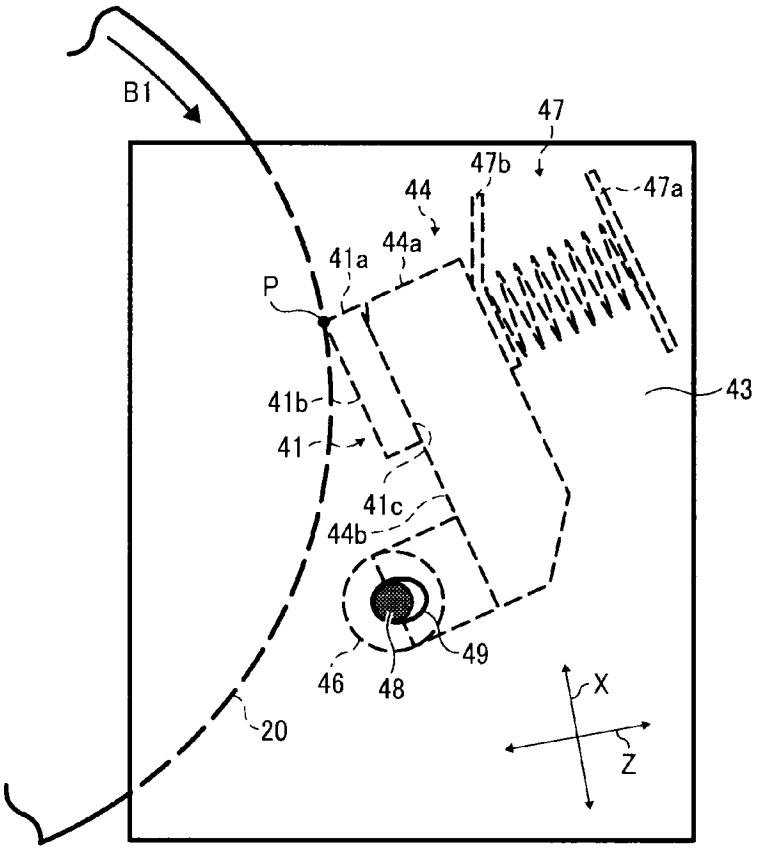

In this manner, since the shaft 48 is engaged with and supported by the bearing 49 with a certain degree of freedom, the position where the bearing 49 supports the shaft 48 changes on one side and the other side of the Y direction within the abovementioned range of the tolerance, such that the cleaning blade 41 comes into uniform press-contact the photosensitive drum 20 when the cleaning blade 41 comes into press-contact with the photosensitive drum 20, as shown in FIGS. 29A and 29B. Therefore, even when the position where the bearing 49 supports the shaft 48 changes on one side (see FIG. 29A) and the other side (see FIG. 29B) in the Y direction so that the cleaning blade 41 comes into uniform press-contact with the photosensitive drum 20, the position of engagement between the shaft 48 and the bearing 49 changes if necessary, as long as the difference in the support position is within the range of the tolerance, and the uniform abutment state between the cleaning blade 41 and the photosensitive drum 20 is maintained in the Y direction and the B1 direction.

Because the shaft hole of the bearing 49 is in the shape of a long hole extending in the Z direction, the shaft 48 is in engagement with the bearing 49 while contacting the inner rim of the bearing 49 in the X direction, and the side P is displaced in the Z direction affecting the pressing force Fp. Therefore, when driving the photosensitive drum 20, unnecessary displacement or vibration of the cleaning blade 41 in the B1 direction can be prevented effectively.

As described above, because the shaft 48 and the blade holder 44 are highly rigid, distortion hardly occurs and therefore the positional accuracy between the cleaning blade 41 and the photosensitive drum 20 is kept appropriately. Thus, a cleaning failure or damage to the photosensitive drum 20 or cleaning blade 41 can be prevented or inhibited. Note that the shaft 48 may be made of not only stainless steel but also any metallic material having iron or titanium as the main component, as long as it has a high rigidity.

Figure 30:
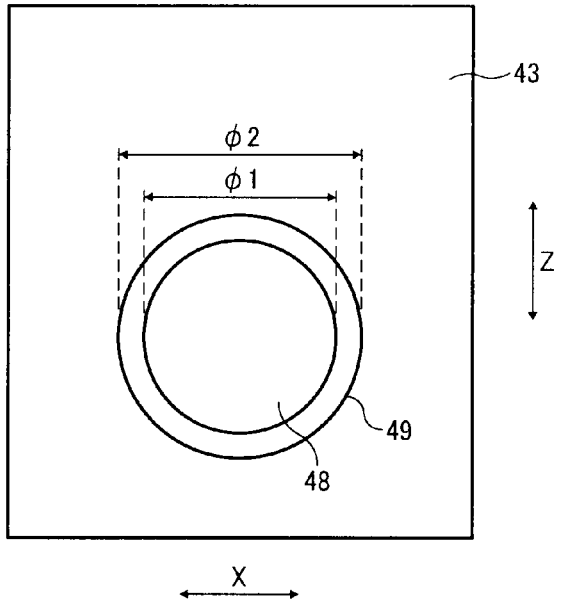
FIG. 30 is a schematic diagram showing another support aspect obtained by the supporting body of the supporting member provided in the cleaning device.

As shown in FIG. 30, when the shaft hole of the bearing 49 supporting the shaft 48 is formed into a round hole, the diameter Φ2 of the round hole is 15.60±0.05 [mm], which is the same as that of L2, for the same reason described above. Note that the curvature of the shaft 48 and the curvature of the bearing 49 may not be the same, or the curvature of the shaft 48 may be greater than the curvature of the long hole of the bearing 49.

Moreover, in order to support the shaft 48 with a certain degree of freedom, the bearing 49 may be configured by polyurethane or other elastic element. In this case, the position where the bearing 49 supports the shaft 48 may be changed by deforming the bearing 49.

As described above, although the shaft 48 is provided on the cleaning blade 41 side and the bearing 49 on the cleaning case 43 side, the bearing 49 may be provided on the cleaning blade 41 side and the shaft 48 on the cleaning case 43 side.

A configuration in which the biasing means 47 biases the cleaning blade 41 so that the pressing force Fp becomes greater than the pressing force Fq is described next.

In this configuration, the cleaning blade 41 is supported so as to be rotatable about the side P, the side P is taken as a rotating shaft to bring the cleaning blade into abutment against the photosensitive drum 20, the position where the bearing 49 supports the shaft 48 is changed easily, and the state of abutment between the cleaning blade 41 and the photosensitive drum 20 in the Y direction and the B1 direction is kept uniform.

Figure 31:
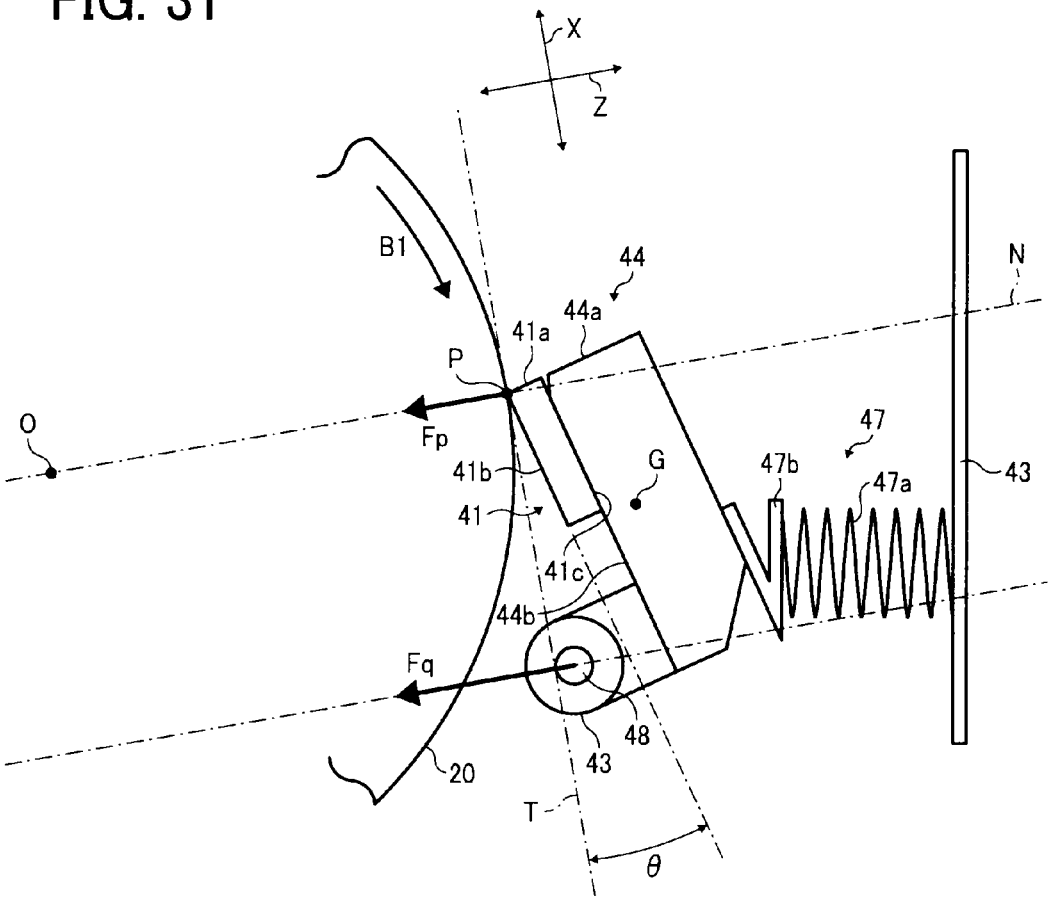
FIG. 31 is a diagram showing a comparison example of a biasing aspect obtained by biasing means.
Figure 32B:
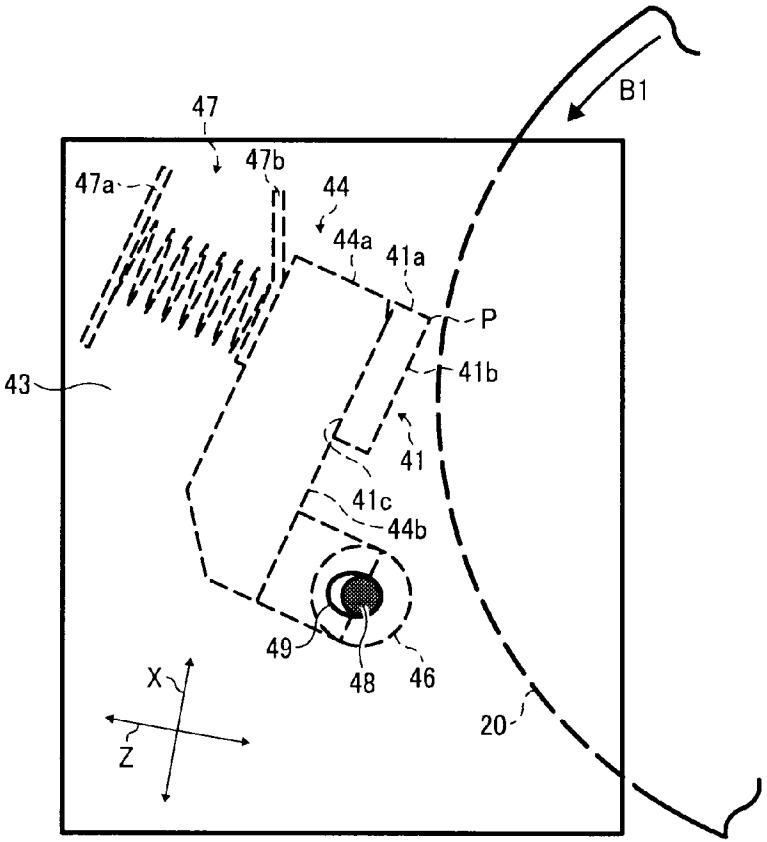
FIGS. 32A and 32B are diagrams showing a state in which the supporting part supports the supporting member in the example shown in FIG. 31.
Figure 32A:
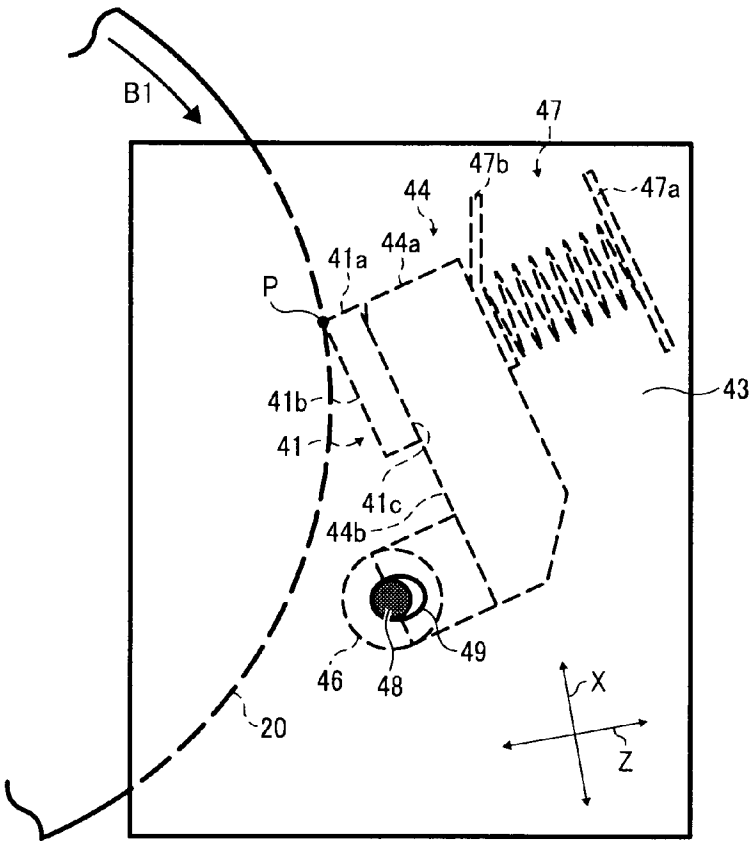

Supposed that the position where the biasing means 47 biases the cleaning blade 41 is taken as the position on the downstream side in the B1 direction of a straight line (not shown) that passes through the gravity center G and is parallel to the normal line N, and the biasing means 47 biases the cleaning blade 41 so that the pressing force Fq becomes greater than the pressing force Fp, as shown in FIG. 31. The shaft 48 is positioned in the nearest part of the photosensitive drum 20 in the Z direction of the shaft hole of the bearing 49, and the cleaning blade 41 rotates around the rotating shaft of the shaft 48. Therefore, for example, the cleaning blade 41 abuts against the photosensitive drum on one side in the Y direction (see FIG. 32A) but separates on the other side (see FIG. 32B), as show in FIGS. 32A and 32B, making it difficult for the cleaning blade 41 to abut against the photosensitive drum 20 uniformly in the Y direction or the like.

In order to bring the cleaning blade 41 into abutment against the photosensitive drum 20, with the side P as the rotating shaft, the position where the biasing means 47 biases the cleaning blade 41 is taken as the position on the upstream side in the B1 direction of the straight line (not shown) that is parallel to the normal line N and passes through the gravity center G, as described above. However, in order to allow the side P to function as the rotating shaft, the position where the biasing means 47 biases the cleaning blade 41 is preferably located on the upstream side in the B1 direction on the normal line N, in the vicinity of the normal line N, or in relation to the normal line N.

The biasing force adjusting means 47*c* has an adjusting screw (not shown) that is screwed to a screw hole (not shown) of the cleaning case 43 and connected to one end of each spring 47*a* at a leading end. When adjusting the biasing force applied by the biasing means 47, an adjusting rod (not shown) functioning as a jig is brought into engagement with the adjusting screw from the outside of the cleaning case 43, and the adjusting screw is rotated, whereby the length of the adjusting screw is adjusted. Note that the biasing force adjusting means 47*c* is not a required constituent of the biasing means 47, and therefore one end of each spring 47*a* may be fixed and attached to the cleaning case 43.

Next is described how the pressing force Fp applied by the biasing means 47 is adjusted.

Figure 33:
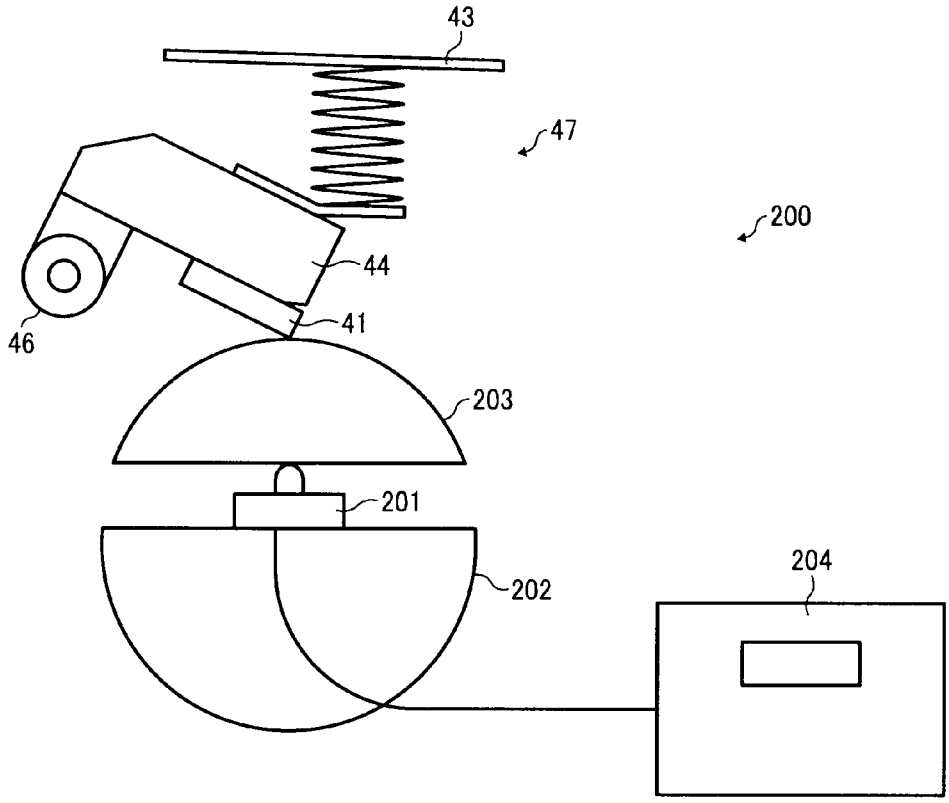
FIG. 33 is a diagram showing a schematic configuration of a measurement device for measuring a pressing force of the cleaning member.

FIG. 33 shows a measurement device for measuring the pressing force Fp. This measurement device 200 is a commercially available sensor conditioner (WGA-710B (manufactured by Kyowa Electronic Instruments, Co., Ltd.) and a load cell "LMA-A-20N (manufactured by Kyowa Electronic Instruments, Co., Ltd.) that can be combined. This measurement device 200 has three load cells 201, which are fixed to a total of three sections on a semi-cylindrical cell base 202, the three sections being the center of the cell base 202 in the Y direction and two points that are away from the center by 140 [mm] toward both ends in the Y direction. A jig 203 that has a curved surface having the same curvature radius as the photosensitive drum 20 is placed on each load cell 201. Three of this jig 203 are arranged along the Y direction, and each load cell 201 is set on the center of a bottom surface of each of these jigs 203.

The cleaning blade 41 is set in the measurement device 200 such that the positional relationship between the cleaning blade 41 and the jig 203 is same as the positional relationship between the cleaning blade 41 and the photosensitive drum 20.

When adjusting the pressing force Fp using the measurement device 200, the measurement device 200, in place of the photosensitive drum 20, is attached to the process cartridge 95 in which the cleaning device 40 is assembled to the image forming apparatus 100. Specifically, by using the support part for supporting the drive shaft of the photosensitive drum 20, the cell base 202 to which the three load cells 201 are fixed and the three jigs 203 are attached to the process cartridge 95. In so doing, virtual lines connecting the side P to the load cells 201 are set so as to be vertical with respect to the bottom surfaces of the jigs 203. Then, the load applied through each jig 203 is detected using each load cell 201, and the adjusting screw is adjusted while monitoring the values displayed on a sensor conditioner 204 connected to the measurement device 200, to adjust the pressing force Fp.

When measuring the pressing force, a prescribed weight is placed on each jig 203 beforehand, and the values displayed on the sensor conditioner 204 are set to be equal to each other, or the values displayed on the sensor conditioner 204 are set to cancel the load applied by the jigs 203.

When adjusting the load balance such that the pressing force Fp becomes uniform in the Y direction, in the present embodiment, each adjusting screw is rotated and adjusted so that the value of each load cell 201 displayed on the sensor conditioner 204 fluctuates within the range of ±10 [g].

When adjusting the pressing force Fp, it should be adjusted primarily so as to obtain a target value of the abutment pressure between the cleaning blade 41 and the photosensitive drum 20. However, because it is difficult to measure the abutment width, that is, the nip width, in the B1 direction between the cleaning blade 41 and the photosensitive drum 20, the pressing force Fp is generated adjusted to a target value of a linear pressure [N/cm]. Here, "linear pressure" means a force per unit length of the Y direction, which acts on the abutting part between the cleaning blade 41 and the surface of the photosensitive drum 20. In a specific method for obtaining the linear pressure, the values of the load cells 201 displayed on the sensor conditioner 204 are added up, and thus obtained total load is divided by the Y direction length T3 of the cleaning blade 41.

In the present embodiment, as with the first embodiment, by adjusting the pressing force Fp so that the total value of the values displayed on the sensor conditioner 204, that is, the total load, becomes 26.0±0.29 [N], the linear pressure becomes same as the linear pressure set by the conventional counter type cleaning device, that is, approximately 0.79 [N/cm].

Figure 34:
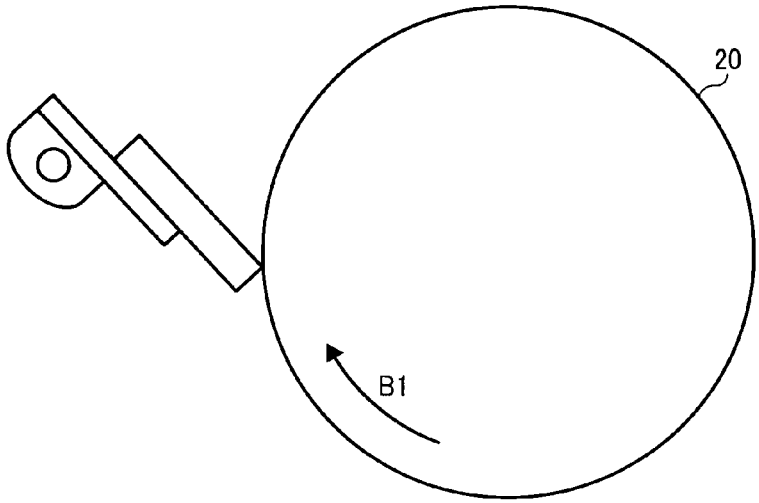
FIG. 34 PRIOR ART
FIG. 34 is a schematic diagram showing a conventional example of a state of abutment between the surface moving member and the cleaning member.

The greater the warpage of the cleaning blade 41 or the greater the deformation of the cleaning blade 41, the longer the abutment width between the cleaning blade 41 and the surface of the photosensitive drum 20 becomes. However, in the cleaning device 40, the warpage of the cleaning blade 41 is regulated by the blade holder 44 as described above, and warpage hardly occurs or is small enough that it can be ignored, compared to the warpage of the blade of the conventional counter type cleaning device shown in FIG. 34. Therefore, in the cleaning device 40, the abutment width between the cleaning blade 41 and the surface of the photosensitive drum 20 mainly depends only on elastic deformation caused by compression deformation in the Z direction of the cleaning blade 41. Hence, compared to the conventional counter type cleaning device shown in the diagram, in the cleaning device 40 the abutment width between the cleaning blade 41 and the surface of the photosensitive drum 20 is reduced, and as a result, unlike the conventional counter type cleaning device, the cleaning blade 41 and the photosensitive drum 20 are prevented from becoming worn, and a high contact pressure that can clean the spherical toner is applied.

According to the cleaning device 40, the abutment width between the cleaning blade 41 and the surface of the photosensitive drum 20 is reduced as described above, and even when the cleaning blade 41 is pressed against the surface of the photosensitive drum 20 with the linear pressure same as that of the conventional counter type cleaning device, the abutment pressure becomes higher than that of the conventional counter type cleaning device. in other words, the pressing force that is required for obtaining the abutment pressure same as that of the conventional counter cleaning device is made smaller than that of the conventional counter cleaning device. Note that the abutment width between the cleaning blade 41 and the surface of the photosensitive drum 20 is predicted to be quite shorter than the abutment width obtained when the conventional counter type cleaning device is used. Therefore, based on this prediction, approximately the same amount of abutment pressure as that of the cleaning device can be realized with linear pressure that is significantly smaller than the linear pressure obtained in the conventional counter type cleaning device, and approximately the same level of removing performance can be exhibited. This fact is also effective in preventing the abrasion of the cleaning blade 41 and the photosensitive drum 20.

According to the cleaning device 40 of the present embodiment, the abutment pressure of the cleaning blade 41 against the photosensitive drum 20 can be increased easily, compared to the conventional counter type cleaning device. Therefore, for the toner that has a spherical shape and small diameter that could not be removed in the conventional counter type cleaning device, sufficient removing performance can be achieved.

Because the cleaning blade 41 hardly warps, robustness to the environmental variations improves.

More specifically, in a configuration where the cleaning blade having a long free length warps, the force generated by the warpage of the cleaning blade is changed by temperature and humidity. For example, plastic deformation occurs when the warped cleaning blade is left along under a high-temperature and high-humidity environment, causing a phenomenon called "flattening." As a result, the abutment pressure between the surface of the photosensitive drum 20 and the cleaning blade decreases, and the cleaning property also decreases, causing a cleaning failure. Therefore, in the cleaning device 40 in which the cleaning blade 41 does not warp substantially, the robustness to the environmental variations can be improved.

When the cleaning blade warps, it means that the cleaning blade has a degree of freedom enough to make warpage. If the degree of freedom of the cleaning blade is large, in the case of the counter type cleaning device, a serious problem such as blade buckling occurs easily when the frictional force between the cleaning blade and the photosensitive drum 20 increases. However, in the cleaning device 40 in which the cleaning blade 41 does not warp substantially, buckling of the cleaning blade 41 can be prevented.

Moreover, the starting torque of the photosensitive drum 20 can be reduced. More specifically, when the cleaning blade warps, it means that the cleaning blade has a degree of freedom enough to make warpage, as described above. Because the frictional force is large when the photosensitive drum starts driving, a large degree of freedom of the blade causes significant deformation instantly, thereby increasing the torque. However, in the cleaning device 40 where the cleaning blade 41 does not warp substantially, the torque increase caused when the photosensitive drum 20 starts driving can be reduced.

As shown in FIG. 18, in a state in which the cleaning blade 41 is not pressed against the surface of the photosensitive drum 20, the abutment angle θ formed between the surface 41*b* and the tangential line T is approximately 15 [°], and, from this state, the cleaning blade 41 is pressed against the surface of the photosensitive drum 20 by the biasing means 47 (see FIG. 18). The abutment angle θ is appropriately set within the range of 5 [°] or higher and 50 [°] or lower. It is difficult to set the abutment angle θ at 5 [° ] or lower, in terms of the arrangement layout around the photosensitive drum 20, and the possibility that sufficient removing performance may not be achieved increases if the abutment angle θ is greater than 50 [°]. It is preferred that the abutment angle θ be set within a range of 7 to 40°.

Figure 35:
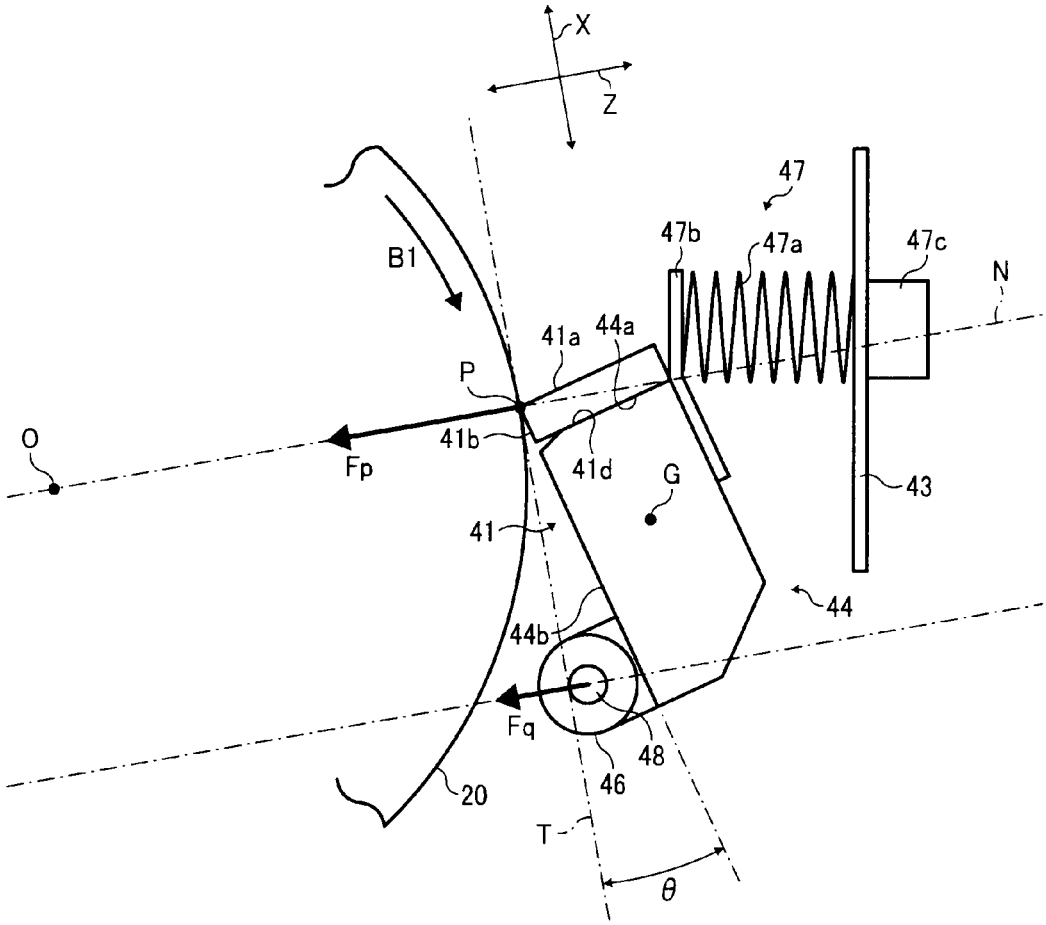
FIG. 35 is a diagram showing another schematic configuration example of the inside of the substantial parts of the cleaning device.
Figure 36:
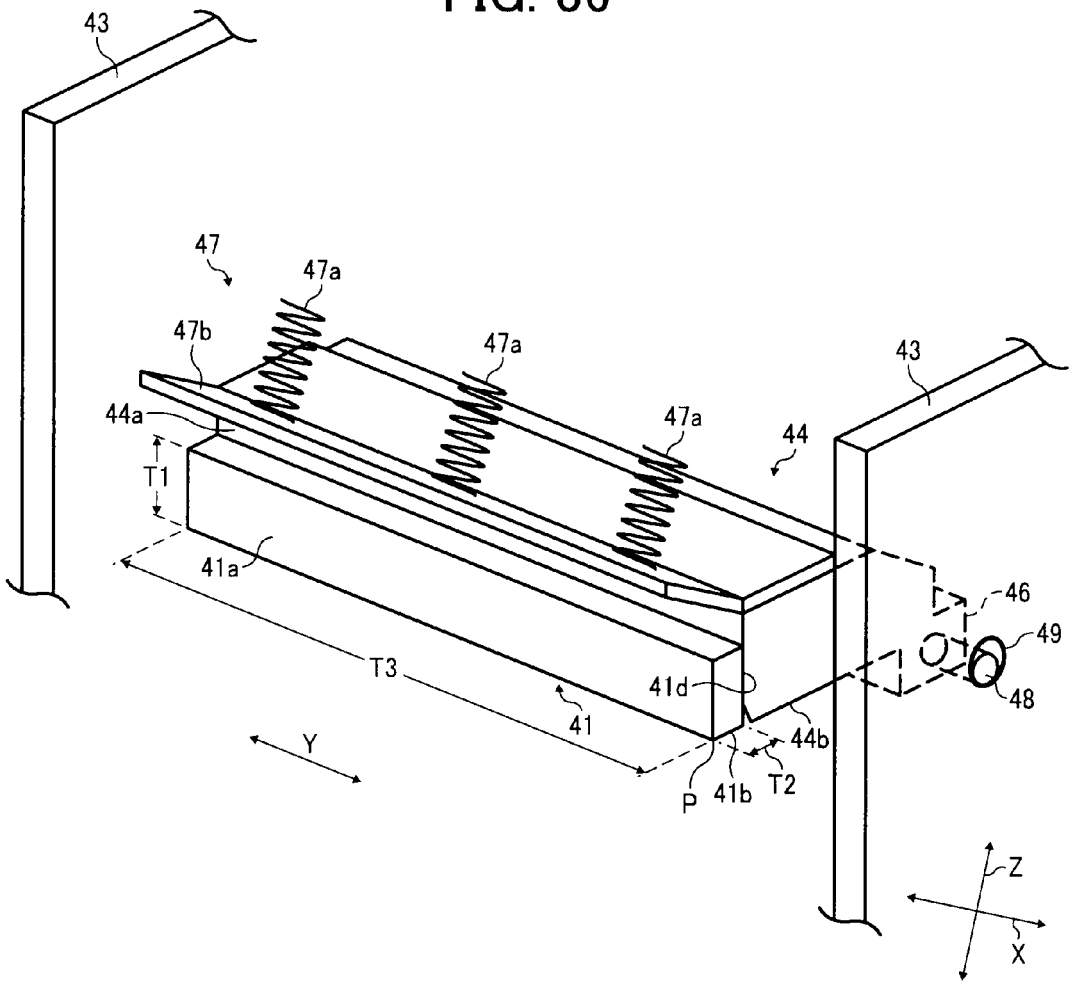
FIG. 36 is a perspective view showing another schematic configuration diagram of the substantial parts of the cleaning device.
Figure 37:
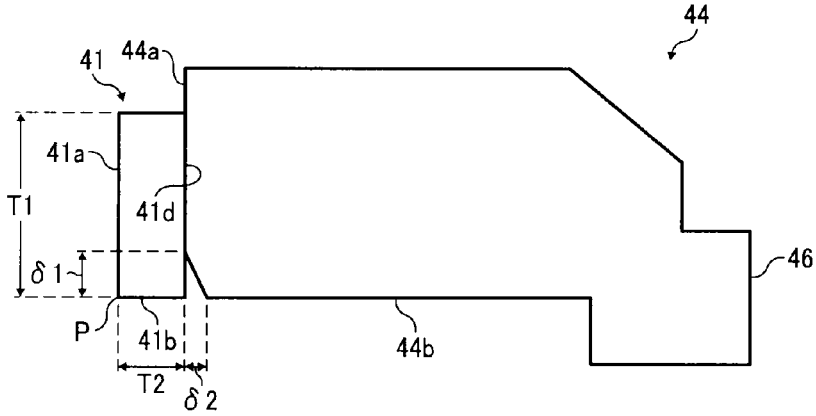
FIG. 37 is a conceptual diagram showing another support aspect obtained by the supporting member of the cleaning member provided in the cleaning device.

As shown in FIGS. 35 to 37, the cleaning blade 41 may be supported by the blade holder 44 so as to be compressed in the Z direction. In this configuration, the blade holder 44 holds the surface 41*a* and the surface 41*d* of the cleaning blade 41 by means of the surface 44*a*. The surface 41*b* is substantially flushed with the surface 44*b*. Also, T3>T1≧T2 is obtained. The rest of the configuration is the same as the above-described configuration, and various configurations can be appropriately applied to the configurations described above.

In addition, even in the configuration where the blade holder 44 holds the surface 41*c* or surface 41*d* of the cleaning blade 41, the shape of the cleaning blade 41 may be not only a rectangular solid but also any three-dimensional shape as long as it has the side P and secures the cleaning performance, and the surface may not only be flat but also curved.

Because the toner used in the image forming apparatus 100 of the first embodiment can be used in the image forming apparatus 100 of the second embodiment, the description of the redundant parts is omitted. Hence, the entire description related to the toner of the first embodiment, that is, the description from the "description of the average circularity degree of the toner" in the beginning to the "description of the toner 8" at the end, is applied directly to the second embodiment The above has described the second embodiment, the present invention is not limited to this embodiment.

For example, the process cartridge may integrally include at least the surface moving member and the cleaning device for cleaning the surface moving member and may be attachable to and detachable from the image forming apparatus main body. The other constituents configuring the process cartridge are selected appropriately in consideration of the life of the constituent, the cost, and the easiness of the structure of the process cartridge.

When the cleaning device and the image carrier corresponding thereto are integrated into the process cartridge or when the cleaning device and the recording material conveying member corresponding thereto are integrated into the process cartridge, these process cartridges may be integrated into one process cartridge.

The cleaning member may be brought into abutment against the surface moving member of the trailing type cleaning device, instead of the surface moving member of the counter type cleaning device. However, the counter type cleaning device can achieve the significant operational effects of the present invention, including prevention of the decrease in the abutment pressure that is caused by a small warpage and improvement of the cleaning performance based on a uniform abutment against the surface moving member, which can be achieved by setting the free length of the end part of the leading end of the cleaning member to substantially zero, and improvement of the cleaning performance based on a uniform abutment against the surface moving member, which can be achieved by providing a certain degree of freedom to the support of the cleaning member. Therefore, it is preferred that the cleaning member be brought into abutment against the surface moving member of the counter type cleaning device.

The present invention can be applied to not only a so-called tandem image forming apparatus, but also one-drum type image forming apparatus that can sequentially form toner images of respective colors on a single photosensitive drum, and overlap the toner images sequentially to obtain a color image. In any of types of the image forming apparatuses, the toner image of each color may be directly transferred to a transfer sheet or the like without using the intermediate transfer body.

The present invention can be applied to not only a color image forming apparatus but also a monochrome image forming apparatus.

Moreover, as long as the image forming apparatus is provided with a recording material conveying member as the surface moving member, the image forming apparatus may be not only the one that carries out image formation using a toner, but also the one that carries out image formation using inks, such as an inkjet printer and a printing device.

According to the present embodiment, the following characteristics are obtained:

(1) It is possible to provide a cleaning device, which is capable of performing favorable cleaning and contributing to favorable image formation even when a spherical toner with a small diameter is used for image formation, by allowing one side of the surface moving member in its longitudinal direction to adhere to and abut against the surface moving member with a high pressure.

(2) It is possible to provide a cleaning device, which is capable of performing favorable cleaning and contributing to favorable image formation even when a spherical toner with a small diameter is used for image formation, by allowing the cleaning member to move on one side thereof and allowing the cleaning blade to favorably adhere to and abut against the surface moving member at one side thereof in its longitudinal direction.

(3) It is possible to provide a cleaning device, which is capable of performing favorable cleaning and contributing to favorable image formation even when a spherical toner with a small diameter is used for image formation, by allowing the cleaning member to move on one side thereof, allowing the one side to adhere to the surface moving member so that the shaft moves with respect to the hole, and allowing the cleaning member to favorably adhere to and abut against the surface moving member with a uniform high pressure at one side of the surface moving member in its longitudinal direction.

(4) It is possible to provide a cleaning device, which is capable of performing favorable cleaning and contributing to favorable image formation even when a spherical toner with a small diameter is used for image formation, by allowing the cleaning member that is supported in any of the support aspects to adhere to or abut against the surface moving member with a uniform high pressure at the one side of the surface moving member in its longitudinal direction.

(5) It is possible to provide a cleaning device, which is capable of performing favorable cleaning and contributing to favorable image formation even when a spherical toner with a small diameter is used for image formation, by allowing the cleaning member to adhere to or abut against the surface moving member with a uniform high pressure at the one side of the surface moving member in its longitudinal direction, in the separated state formed in any of the aspects.

(6) It is possible to provide a process cartridge, which is capable of performing favorable cleaning, contributing to favorable image formation, being attachable to or detachable from the image forming apparatus integrating the cleaning device and the surface moving member, and contributing to improve the sense of use of the image forming apparatus, even when a spherical toner with a small diameter is used for image formation, by allowing the cleaning member to adhere to and abut against the surface moving member with a uniform high pressure at the one side of the surface moving member in its longitudinal direction.

(7) It is possible to provide an image forming apparatus, which is capable of performing favorable cleaning and favorable image formation even when a spherical toner with a small diameter is used, by allowing the cleaning member to adhere to and abut against the surface moving member with a uniform high pressure at the one side of the surface moving member in its longitudinal direction.

(8) It is possible to provide an image forming apparatus, which is capable of performing favorable cleaning and thus favorable image formation, being attachable to or detachable from the image forming apparatus integrating the cleaning device and the surface moving member, and contributing to improve the sense of use of the image forming apparatus, even when a spherical toner with a small diameter is used for image formation, by allowing the cleaning member to adhere to and abut against the surface moving member with a uniform high pressure at the one side of the surface moving member in its longitudinal direction.

(9) It is possible to provide an image forming apparatus, which is capable of performing favorable cleaning and favorable image formation while using a spherical toner with a small diameter that is relatively inexpensive and suitable for forming a high quality image, by allowing the cleaning member to adhere to and abut against the surface moving member with a uniform high pressure at the one side of the surface moving member in its longitudinal direction.

(10) It is possible to provide an image forming apparatus, which is capable of performing favorable cleaning and favorable image formation while using a spherical toner with a small diameter that is relatively inexpensive and suitable for forming a high quality image, by allowing the cleaning member to adhere to and abut against the surface moving member with a uniform high pressure at the one side of the surface moving member in its longitudinal direction.

Various modifications will become possible for those skilled in the art after receiving the teachings of the present disclosure without departing from the scope thereof.

What is claimed is:

1. A cleaning device for removing an object adhering to a surface of a surface moving member to be cleaned, the cleaning device comprising:

a long plate-shaped elastic member;

a holding member for holding the plate-shaped elastic member;

engaged means provided in the holding member;

engaging means engaged with the engaged means and supported in a device main body; and warpage regulating means for regulating warpage of the plate-shaped elastic member that is generated by pressing the plate-shaped elastic member against a surface of the surface moving member, wherein the engaged means and the engaging means are engaged with each other on a surface moving direction downstream side of the surface moving member from a normal line of a section of the surface of the surface moving member against which the plate-shaped elastic member abuts, the holding member holds the plate-shaped elastic member by means of the warpage regulating means, the plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member, the engaging means and the engaged means are configured to be engaged with each other with a degree of freedom such that the holding member is displaceable with respect to the device main body, and the holding member is positioned in relation to the device main body, such that one side of the plate-shaped elastic member abutting against the surface of the surface moving member and extending in the longitudinal direction contains two contact parts out of three contact parts between the holding member and the device main body, the three contact parts being outside a straight line for positioning the holding member in relation to the device main body.

2. The cleaning device according to claim 1, wherein the engaged means is a spindle, the engaging means is a circularly opened bearing part, and the spindle and the bearing part are engaged with each other with a degree of freedom in a radial direction of the bearing part.

3. The cleaning device according to claim 1, wherein the engaged means is a spindle, the engaging means is a bearing part that is opened in the shape of a long hole having a long axis extending in a direction substantially parallel to the normal line, and the spindle and the bearing part are engaged with each other with a degree of freedom in a long axis direction of the bearing part.

4. The cleaning device according to claim 1, wherein the engaged means is a spindle, the engaging means is a bearing part made of an elastic body, and the spindle and the bearing part are engaged with each other with a degree of freedom in a radial direction of the bearing part.

5. A cleaning device for removing an object adhering to a surface of a surface moving member to be cleaned, the cleaning device comprising:

a long plate-shaped elastic member;

a holding member for holding the plate-shaped elastic member;

engaged means provided in the holding member;

engaging means engaged with the engaged means and supported in a device main body;

warpage regulating means for regulating warpage of the plate-shaped elastic member that is generated by pressing the plate-shaped elastic member against a surface of the surface moving member; and biasing means for biasing the plate-shaped elastic member and the holding member toward the surface moving member, wherein the engaged means and the engaging means are engaged with each other on a surface moving direction downstream side of the surface moving member from a normal line of a section of the surface of the surface moving member against which the plate-shaped elastic member abuts, the holding member holds the plate-shaped elastic member by means of the warpage regulating means, the plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member, the engaging means and the engaged means are configured to be engaged with each other with a degree of freedom such that the holding member is displaceable with respect to the device main body, and a pressing force applied to the surface of the surface moving member by one side of the plate-shaped elastic member abutting against the surface of the surface moving member and extending in the longitudinal direction is greater than a pressing force applied to the engaging means by the engaged means of the holding member, the pressing forces being generated by the biasing means biasing the plate-shaped elastic member and the holding member.

6. The cleaning device according to claim 5, wherein the engaged means is a spindle, the engaging means is a circularly opened bearing part, and the spindle and the bearing part are engaged with each other with a degree of freedom in a radial direction of the bearing part.

7. The cleaning device according to claim 5, wherein the engaged means is a spindle, the engaging means is a bearing part that is opened in the shape of a long hole having a long axis extending in a direction substantially parallel to the normal line, and the spindle and the bearing part are engaged with each other with a degree of freedom in a long axis direction of the bearing part.

8. The cleaning device according to claim 5, wherein the engaged means is a spindle, the engaging means is a bearing part made of an elastic body, and the spindle and the bearing part are engaged with each other with a degree of freedom in a radial direction of the bearing part.

9. A cleaning device for removing an object adhering to a surface of a surface moving member to be cleaned, the cleaning device comprising:

a long plate-shaped elastic member;

a holding member for holding the plate-shaped elastic member;

engaged means provided in the holding member;

engaging means engaged with the engaged means and supported in a device main body;

warpage regulating means for regulating warpage of the plate-shaped elastic member that is generated by pressing the plate-shaped elastic member against a surface of the surface moving member; and biasing means for biasing the holding member such that the surface of the surface moving member is pressed by one side of the plate-shaped elastic member abutting against the surface of the surface moving member and extending in a longitudinal direction, wherein the engaged means and the engaging means are engaged with each other on a surface moving direction downstream side of the surface moving member from a normal line of a section of the surface of the surface moving member against which the plate-shaped elastic member abuts, the holding member holds the plate-shaped elastic member by means of the warpage regulating means, the plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member, the engaging means and the engaged means are configured to be engaged with each other with a degree of freedom such that the holding member is displaceable with respect to the device main body, and the biasing means biases the holding member on a surface moving direction upstream side of the surface moving member from a gravity center position of an elastic member unit that integrally supports at least the plate-shaped elastic member and the holding member and is displaced with respect to the device main body.

10. The cleaning device according to claim 9, wherein the engaged means is a spindle, the engaging means is a circularly opened bearing part, and the spindle and the bearing part are engaged with each other with a degree of freedom in a radial direction of the bearing part.

11. The cleaning device according to claim 9, wherein the engaged means is a spindle, the engaging means is a bearing part that is opened in the shape of a long hole having a long axis extending in a direction substantially parallel to the normal line, and the spindle and the bearing part are engaged with each other with a degree of freedom in a long axis direction of the bearing part.

12. The cleaning device according to claim 9, wherein the engaged means is a spindle, the engaging means is a bearing part made of an elastic body, and the spindle and the bearing part are engaged with each other with a degree of freedom in a radial direction of the bearing part.

13. A cleaning device, comprising:

a cleaning member, which abuts against a surface moving member to clean the surface moving member at one side on a leading end part side of the cleaning member that extends in a direction perpendicular to a moving direction of the surface moving member; and a supporting member that supports the cleaning member, wherein a base end part of the cleaning member is supported by the supporting member such that a free length of an end part on the leading end part side becomes substantially zero to regulate warpage of the cleaning member when the cleaning member abuts against the surface moving member, and the end part separates from the supporting member when the cleaning member is not in abutment against the surface moving member, but abuts against the supporting member from the base end part throughout the one side when the cleaning member is in abutment against the surface moving member.

14. The cleaning device according to claim 13, wherein a state in which the end part on the leading end part side is separated from the supporting member when the cleaning member is not in abutment against the surface moving member is formed by a step part formed in the supporting member, a step part formed in the cleaning member, and/or an integration layer for integrating the supporting member and the cleaning member.

15. A process cartridge that is configured to be attachable to and detachable from a main body of an image forming apparatus for eventually transferring to a recording material an image formed on an image carrier functioning as a surface moving member, and integrally supports at least the image carrier and cleaning means for removing an unwanted object adhering to the image carrier, the cleaning means comprising:

a long plate-shaped elastic member;

a holding member for holding the plate-shaped elastic member;

engaged means provided in the holding member;

engaging means engaged with the engaged means and supported in a device main body; and warpage regulating means for regulating warpage of the plate-shaped elastic member that is generated by pressing the plate-shaped elastic member against a surface of the surface moving member, wherein the engaged means and the engaging means are engaged with each other on a surface moving direction downstream side of the surface moving member from a normal line of a section of the surface of the surface moving member against which the plate-shaped elastic member abuts, the holding member holds the plate-shaped elastic member by means of the warpage regulating means, the plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member, the engaging means and the engaged means are configured to be engaged with each other with a degree of freedom such that the holding member is displaceable with respect to the device main body, and the holding member is positioned in relation to the device main body, such that one side of the plate-shaped elastic member abutting against the surface of the surface moving member and extending in the longitudinal direction contains two contact parts out of three contact parts between the holding member and the device main body, the three contact parts being outside a straight line for positioning the holding member in relation to the device main body.

16. A process cartridge that is configured to be attachable to and detachable from a main body of an image forming apparatus for eventually transferring to a recording material an image formed on an image carrier functioning as a surface moving member, and integrally supports at least the image carrier and cleaning means for removing an unwanted object adhering to the image carrier, the cleaning means comprising:

a long plate-shaped elastic member;

a holding member for holding the plate-shaped elastic member;

engaged means provided in the holding member;

engaging means engaged with the engaged means and supported in a device main body;

warpage regulating means for regulating warpage of the plate-shaped elastic member that is generated by pressing the plate-shaped elastic member against a surface of the surface moving member; and biasing means for biasing the plate-shaped elastic member and the holding member toward the surface moving member, wherein the engaged means and the engaging means are engaged with each other on a surface moving direction downstream side of the surface moving member from a normal line of a section of the surface of the surface moving member against which the plate-shaped elastic member abuts, the holding member holds the plate-shaped elastic member by means of the warpage regulating means, the plate-shaped elastic member is pressed against the surface of the surface moving member such that one side of the plate-shaped elastic member that extends in a longitudinal direction is perpendicular to a surface moving direction of the surface moving member, to remove the object adhering to the surface of the surface moving member, the engaging means and the engaged means are configured to be engaged with each other with a degree of freedom such that the holding member is displaceable with respect to the device main body, and a pressing force applied to the surface of the surface moving member by one side of the plate-shaped elastic member abutting against the surface of the surface moving member and extending in the longitudinal direction is greater than a pressing force applied to the engaging means by the engaged means of the holding member, the pressing forces being generated by the biasing means biasing the plate-shaped elastic member and the holding member.

17. A process cartridge that is configured to be attachable to and detachable from a main body of an image forming apparatus for eventually transferring to a recording material an image formed on an image carrier functioning as a surface moving member, and integrally supports at least the image carrier and cleaning means for removing an unwanted object adhering to the image carrier, the cleaning means comprising:

a long plate-shaped elastic member;

a holding member for holding the plate-shaped elastic member;

engaged means provided in the holding member;

engaging means engaged with the engaged means and supported in a device main body;

warpage regulating means for regulating warpage of the plate-shaped elastic member that is generated by pressing the plate-shaped elastic member against a surface of the surface moving member; and biasing means for biasing the holding member such that the surface of the surface moving member is pressed by one side of the plate-shaped elastic member abutting against the surface of the surface moving member and extending in a longitudinal direction, wherein the engaged means and the engaging means are engaged with each other on a surface moving direction downstream side of the surface moving member from a normal line of a section of the surface of the surface moving member against which the plate-shaped elastic member abuts, the holding member holds the plate-shaped elastic member by means of the warpage regulating means, the plate-shaped elastic member is pressed against the surface of the surface moving member such that one side of the plate-shaped elastic member that extends in the longitudinal direction is perpendicular to a surface moving direction of the surface moving member, to remove the object adhering to the surface of the surface moving member, the engaging means and the engaged means are configured to be engaged with each other with a degree of freedom such that the holding member is displaceable with respect to the device main body, and the biasing means biases the holding member on a surface moving direction upstream side of the surface moving member from a gravity center position of an elastic member unit that integrally supports at least the plate-shaped elastic member and the holding member and is displaced with respect to the device main body.

* * * * *